US010674782B2

(12) United States Patent
Molyneux et al.

(10) Patent No.: US 10,674,782 B2
(45) **Date of Patent: *Jun. 9, 2020**

(54) FOOTWEAR HAVING SENSOR SYSTEM

(71) Applicant: NIKE, Inc., Beaverton, OR (US)

(72) Inventors: James Molyneux, Portland, OR (US); Jordan M. Rice, Portland, OR (US); Aaron B. Weast, Portland, OR (US); Jeffrey J. Hebert, Seattle, WA (US); Martine W. Stillman, Seattle, WA (US); Dane Weitmann, Seattle, WA (US); Joseph B. Horrell, Seattle, WA (US); Jonathan B. Knight, Seattle, WA (US)

(73) Assignee: NIKE, Inc., Beaverton, OR (US)

( * ) Notice: Subject to any disclaimer, the term of this patent is extended or adjusted under 35 U.S.C. 154(b) by 140 days.

This patent is subject to a terminal disclaimer.

(21) Appl. No.: 15/896,801

(22) Filed: Feb. 14, 2018

(65) Prior Publication Data

US 2018/0184751 A1 Jul. 5, 2018

Related U.S. Application Data

(63) Continuation of application No. 14/949,521, filed on Nov. 23, 2015, now Pat. No. 9,924,760, which is a (Continued)

(51) Int. Cl.
*A43B 3/00* (2006.01)
*A63B 24/00* (2006.01)
(Continued)

(52) U.S. Cl.
CPC ..... *A43B 3/0005* (2013.01); *A43B 3/001* (2013.01); *A43B 3/0015* (2013.01);
(Continued)

(58) Field of Classification Search
CPC ..... A43B 3/0021; A43B 3/0031; A43B 5/00; A43B 7/1425; A43B 7/144; A43B 7/145;
(Continued)

(56) References Cited

U.S. PATENT DOCUMENTS 4,578,769 A 3/1986 Frederick
4,647,918 A 3/1987 Goforth
(Continued)

FOREIGN PATENT DOCUMENTS

CN 200994779 Y 12/2007
CN 102143695 A 8/2011
(Continued)

OTHER PUBLICATIONS

Mar. 15, 2017—(EP) ESR—App. No. 16199665.7.

*Primary Examiner* — Max H Noori
(74) *Attorney, Agent, or Firm* — Banner & Witcoff, Ltd.

(57) ABSTRACT

An article of footwear includes an upper member and a sole structure, with a sensor system connected to the sole structure. The sensor system includes a plurality of sensors that are configured for detecting forces exerted by a user's foot on the sensor. The sensor system also includes a port that is configured to receive a module to place the module in communication with the sensors. The port includes a housing with a chamber configured to receive the module and an interface engaged with the housing and having at least one electrical contact exposed to the chamber. Additional retaining structure and interface structure may be included.

30 Claims, 25 Drawing Sheets

Related U.S. Application Data continuation of application No. 13/399,916, filed on Feb. 17, 2012, now Pat. No. 9,192,816.

(60) Provisional application No. 61/443,801, filed on Feb. 17, 2011.

(51) Int. Cl.

| | |
|---|---|
| ***A43B 7/14*** | (2006.01) |
| ***A43B 5/00*** | (2006.01) |
| ***A43B 13/04*** | (2006.01) |
| ***A43B 13/12*** | (2006.01) |
| ***A43B 13/14*** | (2006.01) |
| ***A43B 13/18*** | (2006.01) |
| ***A43B 17/00*** | (2006.01) |

(52) U.S. Cl.

CPC ..... *A43B 3/0021* (2013.01); *A43B 3/0031* (2013.01); *A43B 5/00* (2013.01); *A43B 7/144* (2013.01); *A43B 7/145* (2013.01); *A43B 7/149* (2013.01); *A43B 7/1425* (2013.01); *A43B 13/04* (2013.01); *A43B 13/122* (2013.01); *A43B 13/141* (2013.01); *A43B 13/181* (2013.01); *A43B 13/187* (2013.01); *A43B 17/006* (2013.01); *A63B 24/0062* (2013.01); *A63B 2220/51* (2013.01); *A63B 2220/836* (2013.01)

(58) Field of Classification Search

CPC ..... A43B 7/149; A43B 13/04; A43B 13/122; A43B 13/141; A43B 13/181; A43B 13/187; A43B 17/006; A63B 24/0062; A63B 2220/51; A63B 2220/836

USPC ..... 73/862.041

See application file for complete search history.

(56) References Cited

U.S. PATENT DOCUMENTS

| | | | |
|---|---|---|---|
| 4,745,930 | A | 5/1988 | Confer |
| 4,814,661 | A | 3/1989 | Ratzlaff et al. |
| 4,862,743 | A | 9/1989 | Seitz |
| 4,866,412 | A | 9/1989 | Rzepczynski |
| 5,010,774 | A | 4/1991 | Kikuo et al. |
| 5,033,291 | A | 7/1991 | Podoloff et al. |
| 5,154,960 | A | 10/1992 | Mucci et al. |
| 5,253,656 | A | 10/1993 | Rincoe et al. |
| 5,303,131 | A | 4/1994 | Wu |
| 5,373,651 | A | 12/1994 | Wood |
| 5,374,821 | A | 12/1994 | Muhs et al. |
| 5,408,873 | A | 4/1995 | Schmidt et al. |
| 5,471,405 | A | 11/1995 | Marsh |
| 5,500,635 | A | 3/1996 | Mott |
| 5,644,858 | A | 7/1997 | Bemis |
| 5,655,316 | A | 8/1997 | Huang |
| 5,714,706 | A | 2/1998 | Nakada et al. |
| 5,813,406 | A | 9/1998 | Kramer et al. |
| 5,889,464 | A | 3/1999 | Huang |
| 5,929,332 | A | 7/1999 | Brown |
| 6,017,128 | A | 1/2000 | Goldston et al. |
| 6,122,846 | A | 9/2000 | Gray et al. |
| 6,155,120 | A | 12/2000 | Taylor |
| 6,174,294 | B1 | 1/2001 | Crabb et al. |
| 6,195,921 | B1 | 3/2001 | Truong |
| 6,330,757 | B1 | 12/2001 | Russell |
| 6,360,597 | B1 | 3/2002 | Hubbard, Jr. |
| 6,539,336 | B1 | 3/2003 | Vock et al. |
| 6,578,291 | B2 | 6/2003 | Hirsch et al. |
| 7,219,449 | B1 | 5/2007 | Hoffberg et al. |
| 7,277,021 | B2 | 10/2007 | Beebe et al. |
| RE40,474 | E | 9/2008 | Quellais et al. |
| 7,426,873 | B1 | 9/2008 | Kholwadwala et al. |
| 7,497,037 | B2 | 3/2009 | Vick et al. |
| 7,552,549 | B2 | 6/2009 | Whittlesey et al. |
| 7,596,891 | B2 | 10/2009 | Carnes et al. |
| 7,607,243 | B2 | 10/2009 | Bemer, Jr. et al. |
| 7,726,206 | B2 | 6/2010 | Terrafranca, Jr. et al. |
| 7,758,523 | B2 | 7/2010 | Collings et al. |
| 7,997,007 | B2 | 8/2011 | Sanabria-Hernandez |
| 8,061,061 | B1 | 11/2011 | Rivas |
| 8,155,525 | B2 | 4/2012 | Cox |
| 8,212,158 | B2 | 7/2012 | Wiest |
| 8,216,081 | B2 | 7/2012 | Snyder et al. |
| 8,467,979 | B2 | 6/2013 | Sobolewski |
| 8,479,416 | B2 | 7/2013 | Auger et al. |
| 8,676,541 | B2 | 3/2014 | Schrock et al. |
| 8,739,639 | B2 | 6/2014 | Owings et al. |
| 9,002,680 | B2 | 4/2015 | Nurse et al. |
| 9,089,182 | B2 | 7/2015 | Schrock et al. |
| 9,462,844 | B2 | 10/2016 | Schrock et al. |
| 9,642,415 | B2 | 5/2017 | Pease et al. |
| 2001/0003665 | A1 | 6/2001 | Kim |
| 2001/0054043 | A1 | 12/2001 | Harlan |
| 2002/0133069 | A1 | 9/2002 | Roberts |
| 2003/0009308 | A1 | 1/2003 | Kirtley |
| 2003/0097878 | A1 | 5/2003 | Farringdon et al. |
| 2003/0163287 | A1 | 8/2003 | Vock et al. |
| 2004/0154190 | A1 | 8/2004 | Munster |
| 2004/0162702 | A1 | 8/2004 | Pandipati et al. |
| 2004/0177531 | A1 | 9/2004 | DiBenedetto et al. |
| 2004/0225467 | A1 | 11/2004 | Vock et al. |
| 2004/0226192 | A1 | 11/2004 | Geer et al. |
| 2005/0011085 | A1 | 1/2005 | Swigart et al. |
| 2005/0183292 | A1 | 8/2005 | DiBenedetto et al. |
| 2005/0188566 | A1 | 9/2005 | Whittlesey et al. |
| 2006/0010174 | A1 | 1/2006 | Nguyen et al. |
| 2006/0082977 | A1 | 4/2006 | Kim |
| 2006/0143645 | A1 | 6/2006 | Vock et al. |
| 2006/0144152 | A1 | 7/2006 | Cabuz et al. |
| 2006/0248749 | A1 | 11/2006 | Ellis |
| 2006/0282017 | A1 | 12/2006 | Avni et al. |
| 2006/0283050 | A1 | 12/2006 | Carnes et al. |
| 2007/0006489 | A1 | 1/2007 | Case et al. |
| 2007/0032748 | A1 | 2/2007 | McNeil et al. |
| 2007/0033838 | A1 | 2/2007 | Luce et al. |
| 2007/0068244 | A1 | 3/2007 | Billing et al. |
| 2007/0118328 | A1 | 5/2007 | Vock et al. |
| 2007/0157488 | A1 | 7/2007 | Guzman |
| 2007/0204687 | A1 | 9/2007 | Haselhurst et al. |
| 2007/0260421 | A1 | 11/2007 | Bemer et al. |
| 2007/0261271 | A1 | 11/2007 | Krouse |
| 2007/0283599 | A1 | 12/2007 | Talbott |
| 2008/0058126 | A1 | 3/2008 | House |
| 2008/0060224 | A1 | 3/2008 | Whittlesey et al. |
| 2008/0066343 | A1 | 3/2008 | Sanabria-Hernandez |
| 2008/0127527 | A1 | 6/2008 | Chen |
| 2008/0186143 | A1 | 8/2008 | George et al. |
| 2008/0258921 | A1 | 10/2008 | Woo et al. |
| 2008/0287832 | A1 | 11/2008 | Collins et al. |
| 2008/0289217 | A1 | 11/2008 | Horvath |
| 2008/0307899 | A1 | 12/2008 | Von Lilienfeld-Toal et al. |
| 2008/0318679 | A1 | 12/2008 | Tran et al. |
| 2009/0075781 | A1 | 3/2009 | Schwarzberg et al. |
| 2009/0137933 | A1 | 5/2009 | Lieberman et al. |
| 2009/0152456 | A1 | 6/2009 | Waid et al. |
| 2009/0163322 | A1* | 6/2009 | Andren ..... A63B 24/00 482/8 |
| 2009/0167677 | A1 | 7/2009 | Kruse et al. |
| 2009/0293319 | A1 | 12/2009 | Avni |
| 2010/0000121 | A1 | 1/2010 | Brodie et al. |
| 2010/0004566 | A1 | 1/2010 | Son et al. |
| 2010/0009810 | A1 | 1/2010 | Trzecieski |
| 2010/0054746 | A1 | 3/2010 | Logan |
| 2010/0063778 | A1 | 3/2010 | Schrock et al. |
| 2010/0063779 | A1 | 3/2010 | Schrock et al. |
| 2010/0134701 | A1 | 6/2010 | Eyer |
| 2011/0003665 | A1 | 1/2011 | Burton et al. |
| 2011/0167678 | A1 | 7/2011 | Peikert |
| 2011/0203390 | A1 | 8/2011 | Tao et al. |
| 2011/0214501 | A1 | 9/2011 | Ross et al. |
| 2012/0035509 | A1 | 2/2012 | Wilson et al. |
| 2012/0166091 | A1 | 6/2012 | Kim et al. |

(56) References Cited

U.S. PATENT DOCUMENTS

| | | | | |
|---|---|---|---|---|
| 2012/0234111 | A1 | 9/2012 | Molyneux et al. | |
| 2012/0291563 | A1 | 11/2012 | Schrock et al. | |
| 2012/0291564 | A1 | 11/2012 | Amos et al. | |
| 2013/0002533 | A1 | 1/2013 | Burroughs et al. | |
| 2013/0019694 | A1 | 1/2013 | Molyneux et al. | |
| 2013/0110264 | A1* | 5/2013 | Weast | G06F 19/3481 700/91 |
| 2013/0165820 | A1 | 6/2013 | Lin et al. | |
| 2013/0190903 | A1 | 7/2013 | Balakrishnan et al. | |
| 2013/0213145 | A1 | 8/2013 | Owings et al. | |
| 2013/0213146 | A1 | 8/2013 | Amos et al. | |
| 2014/0222173 | A1 | 8/2014 | Giedwoyn et al. | |
| 2014/0259779 | A1 | 9/2014 | Hashish et al. | |
| 2014/0350435 | A1 | 11/2014 | Lam | |
| 2015/0257475 | A1 | 9/2015 | Langvin et al. | |
| 2016/0242500 | A1 | 8/2016 | Langvin et al. | |
| 2016/0345663 | A1 | 12/2016 | Walker et al. | |
| 2017/0079374 | A1* | 3/2017 | Farris | A43B 13/04 |
| 2017/0306539 | A1 | 10/2017 | Gladish et al. | |

FOREIGN PATENT DOCUMENTS

| | | | |
|---|---|---|---|
| EP | 1707065 | A1 | 10/2006 |
| GB | 251054 | A | 4/1926 |
| GB | 2421416 | A | 6/2006 |
| JP | S61176429 | U | 11/1986 |
| JP | H023020 | A | 1/1990 |
| JP | H03114209 | U | 11/1991 |
| JP | H05161724 | A | 6/1993 |
| JP | H06014803 | A | 1/1994 |
| JP | H0889482 | A | 4/1996 |
| JP | H10241648 | A | 9/1998 |
| JP | 2000516509 | A | 12/2000 |
| JP | 2001351591 | A | 12/2001 |
| JP | 2002131155 | A | 5/2002 |
| JP | 2003061779 | A | 3/2003 |
| JP | 2004158242 | A | 6/2004 |
| JP | 2005019305 | A | 1/2005 |
| JP | 2005079019 | A | 3/2005 |
| JP | 2005507678 | A | 3/2005 |
| JP | 2005156531 | A | 6/2005 |
| JP | 2005270640 | A | 10/2005 |
| JP | 2006086072 | A | 3/2006 |
| JP | 2006280955 | A | 10/2006 |
| JP | 2007134473 | A | 5/2007 |
| JP | 2009535157 | A | 10/2009 |
| JP | 2011524207 | A | 9/2011 |
| JP | 2011196931 | A | 10/2011 |
| JP | 2012065942 | A | 4/2012 |
| JP | 2012115709 | A | 6/2012 |
| JP | 2012524638 | A | 10/2012 |
| JP | 2013106773 | A | 6/2013 |
| JP | 2013537436 | A | 10/2013 |
| JP | 2014505577 | A | 3/2014 |
| KR | 20010035162 | A | 5/2001 |
| KR | 20010079094 | A | 8/2001 |
| KR | 100386788 | B1 | 6/2003 |
| KR | 20060034353 | A | 4/2006 |
| KR | 20090052762 | A | 5/2009 |
| KR | 20100127148 | A | 12/2010 |
| KR | 20100130860 | A | 12/2010 |
| KR | 20110071728 | A | 6/2011 |
| KR | 20110124964 | A | 11/2011 |
| KR | 20130130051 | | 11/2013 |
| KR | 20140004206 | A | 1/2014 |
| KR | 20167008215 | | 3/2016 |
| WO | 98007341 | A2 | 2/1998 |
| WO | 03045239 | A1 | 6/2003 |
| WO | 2006035469 | A2 | 4/2006 |
| WO | 2006067434 | A1 | 6/2006 |
| WO | 2006091715 | A1 | 8/2006 |
| WO | 2007064735 | A2 | 6/2007 |
| WO | 2007128049 | A1 | 11/2007 |
| WO | 2007130287 | A2 | 11/2007 |
| WO | 2008061023 | A2 | 5/2008 |
| WO | 2009152456 | A2 | 12/2009 |
| WO | 2011157607 | A1 | 12/2011 |
| WO | 2012109244 | A1 | 8/2012 |
| WO | 2012112930 | A1 | 8/2012 |
| WO | 2012112931 | A2 | 8/2012 |
| WO | 2012112934 | A2 | 8/2012 |
| WO | 2012112938 | A2 | 8/2012 |
| WO | 2012143274 | A2 | 10/2012 |

* cited by examiner

FOOTWEAR HAVING SENSOR SYSTEM

CROSS-REFERENCE TO RELATED APPLICATIONS

The present application is a continuation of U.S. application Ser. No. 14/949,521, filed Nov. 23, 2015, which is a continuation of U.S. application Ser. No. 13/399,916, filed Feb. 17, 2012, and issued as U.S. Pat. No. 9,192,816 on Nov. 24, 2015, which claims priority to and the benefit of U.S. Provisional Application No. 61/443,801, filed Feb. 17, 2011, all of which prior applications are incorporated by reference herein in their entireties.

TECHNICAL FIELD

The present invention generally relates to footwear having a sensor system and, more particularly, to a shoe having a force sensor assembly operably connected to a communication port located in the shoe.

BACKGROUND

Shoes having sensor systems incorporated therein are known. Sensor systems collect performance data wherein the data can be accessed for later use such as for analysis purposes. In certain systems, the sensor systems are complex or data can only be accessed or used with certain operating systems. Thus, uses for the collected data can be unnecessarily limited. Accordingly, while certain shoes having sensor systems provide a number of advantageous features, they nevertheless have certain limitations. The present invention seeks to overcome certain of these limitations and other drawbacks of the prior art, and to provide new features not heretofore available.

BRIEF SUMMARY

The present invention relates generally to footwear having a sensor system. Aspects of the invention relate to an article of footwear that includes an upper member and a sole structure, with a sensor system connected to the sole structure. The sensor system includes a plurality of sensors that are configured for detecting forces exerted by a user's foot on the sensor.

According to one aspect, the footwear further contains a communication port operably connected with the sensors. In one embodiment, the communication port is configured for transmitting data regarding forces detected by each sensor in a universally readable format. The port may also be configured for connection to an electronic module to allow communication between the sensors and the module.

Additional aspects of the invention relate to a port for use with an article of footwear may include a housing adapted to be at least partially received within the sole structure of the article of footwear. The housing includes a plurality of side walls defining a chamber adapted to receive an electronic module therein. An interface is engaged with the housing and has at least one electrical contact exposed to the chamber. In this configuration, the interface is adapted to form an electrical connection with the module such that the module engages the at least one electrical contact when the module is received within the chamber.

Further aspects of the invention relate to an article of footwear adapted to receive a foot and including a sole structure, an upper portion, a sensor system, and a port as described above. The sole structure includes an outsole member and a midsole member supported by the outsole member, the midsole member having a well therein. The upper portion is connected to the sole structure. The sensor system includes a force sensor connected to the sole structure and a sensor lead extending away from the force sensor, the force sensor being adapted to sense a force exerted on the sole structure by the foot. The interface of the port includes an electrical contact that is connected to the sensor lead and thereby in electronic communication with the force sensor.

Still further aspects of the invention relate to a system for use with article of footwear adapted to engage a foot. The system includes a sole structure having an outsole member and a midsole member supported by the outsole member, the midsole member having a well therein and an upper portion connected to the sole structure. The system also includes a sensor system having a plurality of force sensors connected to the sole structure and a plurality of sensor leads extending away from the force sensors, the force sensors each being adapted to sense a force exerted on the sole structure by the foot. A port is connected to the sole structure and the sensor system. The port includes a housing at least partially received within the well in the midsole member and an interface engaged with the housing. The housing includes a plurality of side walls defining a chamber and a retaining member connected to at least one of the side walls. The interface has a plurality of electrical contacts exposed to the chamber, such that the electrical contacts are connected to the plurality of sensor leads and are thereby in electronic communication with the force sensors. The system further includes an electronic module received in the chamber of the port, such that the module engages the plurality of electrical contacts of the interface when the module is received within the chamber, forming an electrical connection with the interface. The module is configured to receive signals from the force sensor through the electrical connection with the interface and store data received from the force sensor. Additionally, the retaining member of the housing exerts a force on the module to retain the module within the chamber.

Still other features and advantages of the invention will be apparent from the following specification taken in conjunction with the following drawings.

DETAILED DESCRIPTION

Figure 1:
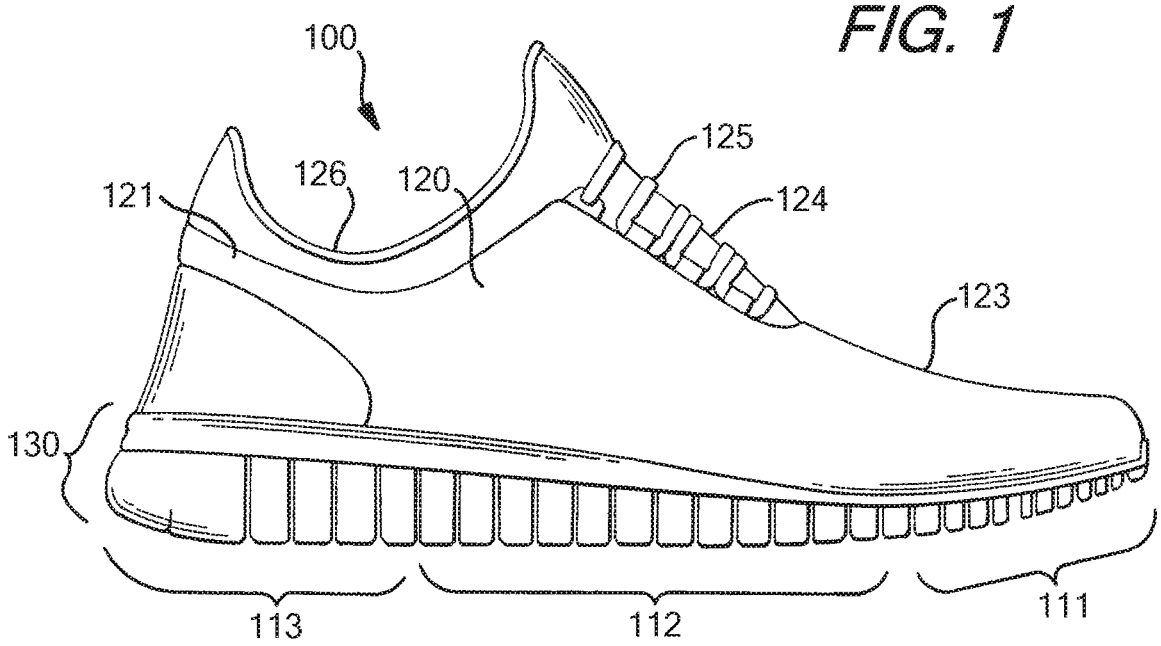
FIG. 1 is a side view of a shoe.

While this invention is susceptible of embodiment in many different forms, there are shown in the drawings, and will herein be described in detail, preferred embodiments of the invention with the understanding that the present disclosure is to be considered as an exemplification of the principles of the invention and is not intended to limit the broad aspects of the invention to the embodiments illustrated and described.

Figure 2:
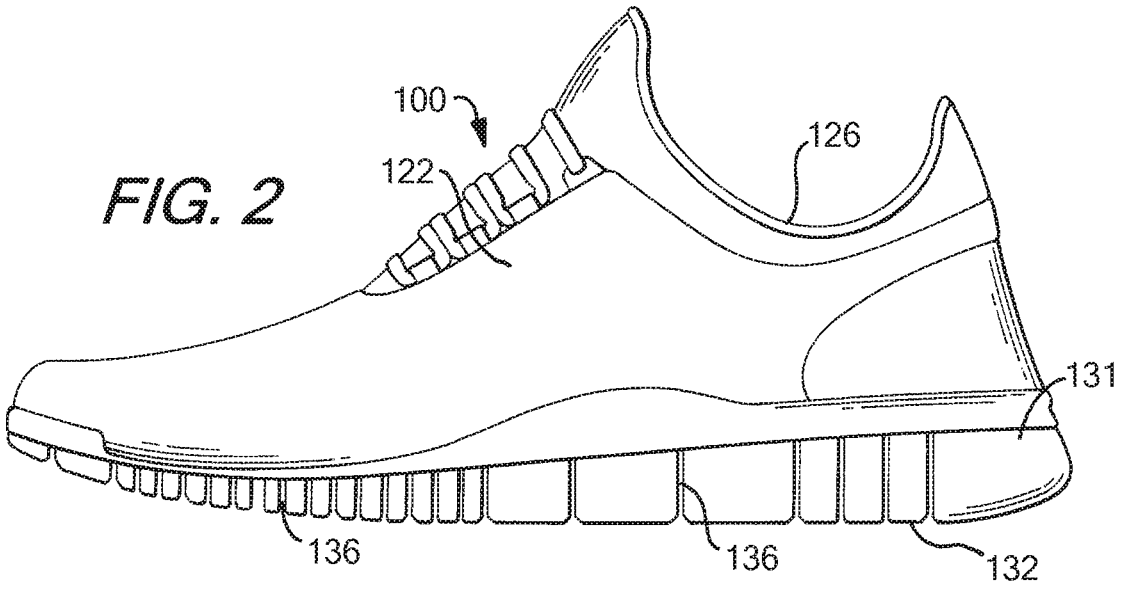
FIG. 2 is an opposed side view of the shoe of FIG. 1.

Footwear, such as a shoe, is shown as an example in FIGS. 1-2 and generally designated with the reference numeral 100. The footwear 100 can take many different forms, including, for example, various types of athletic footwear. In one exemplary embodiment, the shoe 100 generally includes a force sensor system 12 operably connected to a universal communication port 14. As described in greater detail below, the sensor system 12 collects performance data relating to a wearer of the shoe 100. Through connection to the universal communication port 14, multiple different users can access the performance data for a variety of different uses as described in greater detail below.

An article of footwear 100 is depicted in FIGS. 1-2 as including an upper 120 and a sole structure 130. For purposes of reference in the following description, footwear 100 may be divided into three general regions: a forefoot region 111, a midfoot region 112, and a heel region 113, as illustrated in FIG. 1. Regions 111-113 are not intended to demarcate precise areas of footwear 100. Rather, regions 111-113 are intended to represent general areas of footwear 100 that provide a frame of reference during the following discussion. Although regions 111-113 apply generally to footwear 100, references to regions 111-113 also may apply specifically to upper 120, sole structure 130, or individual components included within and/or formed as part of either upper 120 or sole structure 130.

As further shown in FIGS. 1 and 2, the upper 120 is secured to sole structure 130 and defines a void or chamber for receiving a foot. For purposes of reference, upper 120 includes a lateral side 121, an opposite medial side 122, and a vamp or instep area 123. Lateral side 121 is positioned to extend along a lateral side of the foot (i.e., the outside) and generally passes through each of regions 111-113. Similarly, medial side 122 is positioned to extend along an opposite medial side of the foot (i.e., the inside) and generally passes through each of regions 111-113. Vamp area 123 is positioned between lateral side 121 and medial side 122 to correspond with an upper surface or instep area of the foot. Vamp area 123, in this illustrated example, includes a throat 124 having a lace 125 or other desired closure mechanism that is utilized in a conventional manner to modify the dimensions of upper 120 relative the foot, thereby adjusting the fit of footwear 100. Upper 120 also includes an ankle opening 126 that provides the foot with access to the void within upper 120. A variety of materials may be used for constructing upper 120, including materials that are conventionally utilized in footwear uppers. Accordingly, upper 120 may be formed from one or more portions of leather, synthetic leather, natural or synthetic textiles, polymer sheets, polymer foams, mesh textiles, felts, non-woven polymers, or rubber materials, for example. The upper 120 may be formed from one or more of these materials wherein the materials or portions thereof are stitched or adhesively bonded together, e.g., in manners that are conventionally known and used in the art.

Upper 120 may also include a heel element (not shown) and a toe element (not shown). The heel element, when present, may extend upward and along the interior surface of upper 120 in the heel region 113 to enhance the comfort of footwear 100. The toe element, when present, may be located in forefoot region 111 and on an exterior surface of upper 120 to provide wear-resistance, protect the wearer's toes, and assist with positioning of the foot. In some embodiments, one or both of the heel element and the toe element may be absent, or the heel element may be positioned on an exterior surface of the upper 120, for example. Although the configuration of upper 120 discussed above is suitable for footwear 100, upper 120 may exhibit the configuration of any desired conventional or non-conventional upper structure without departing from this invention.

Sole structure 130 is secured to a lower surface of upper 120 and may have a generally conventional shape. The sole structure 130 may have a multipiece structure, e.g., one that includes a midsole 131, an outsole 132, and a foot contacting member 133, which may be a sockliner, a strobel, an insole member, a bootie element, a sock, etc. (See FIGS. 4-5). In the embodiment shown in FIGS. 4-5, the foot contacting member 133 is an insole member or sockliner. The term "foot contacting member," as used herein does not necessarily imply direct contact with the user's foot, as another element may interfere with direct contact. Rather, the foot contacting member forms a portion of the inner surface of the foot-receiving chamber of an article of footwear. For example, the user may be wearing a sock that interferes with direct contact. As another example, the sensor system 12 may be incorporated into an article of footwear that is designed to slip over a shoe or other article of footwear, such as an external bootie element or shoe cover. In such an article, the upper portion of the sole structure may be considered a foot contacting member, even though it does not directly contact the foot of the user.

Midsole member 131 may be an impact attenuating member. For example, the midsole member 131 may be formed of polymer foam material, such as polyurethane, ethylvinylacetate, or other materials (such as phylon, phylite, etc.) that compress to attenuate ground or other contact surface reaction forces during walking, running, jumping, or other activities. In some example structures according to this invention, the polymer foam material may encapsulate or include various elements, such as a fluid-filled bladder or moderator, that enhance the comfort, motion-control, stability, and/or ground or other contact surface reaction force attenuation properties of footwear 100. In still other example structures, the midsole 131 may include additional elements that compress to attenuate ground or other contact surface reaction forces. For instance, the midsole may include column type elements to aid in cushioning and absorption of forces.

Outsole 132 is secured to a lower surface of midsole 131 in this illustrated example footwear structure 100 and is formed of a wear-resistant material, such as rubber or a flexible synthetic material, such as polyurethane, that contacts the ground or other surface during ambulatory or other activities. The material forming outsole 132 may be manufactured of suitable materials and/or textured to impart enhanced traction and slip resistance. The structure and methods of manufacturing the outsole 132 will be discussed further below. A foot contacting member 133 (which may be an insole member, a sockliner, a bootie member, a strobel, a sock, etc.) is typically a thin, compressible member that may be located within the void in upper 120 and adjacent to a lower surface of the foot (or between the upper 120 and midsole 131) to enhance the comfort of footwear 100. In some arrangements, an insole or sockliner may be absent, and in other embodiments, the footwear 100 may have a foot contacting member positioned on top of an insole or sockliner.

The outsole 132 shown in FIGS. 1 and 2 includes a plurality of incisions or sipes 136 in either or both sides of the outsole 132. These sipes 136 may extend from the bottom of the outsole 132 to an upper portion thereof or to the midsole 131. In one arrangement, the sipes 136 may extend from a bottom surface of the outsole 132 to a point halfway between the bottom of the outsole 132 and the top of the outsole 132. In another arrangement, the sipes 136 may extend from the bottom of the outsole 132 to a point greater than halfway to the top of the outsole 132. In yet another arrangement, the sipes 136 may extend from the bottom of the outsole 132 to a point where the outsole 132 meets the midsole 131. The sipes 136 may provide additional flexibility to the outsole 132, and thereby allow the outsole to more freely flex in the natural directions in which the wearer's foot flexes. In addition, the sipes 136 may aid in providing traction for the wearer. It is understood that embodiments of the present invention may be used in connection with other types and configurations of shoes, as well as other types of footwear and sole structures.

Figure 3:
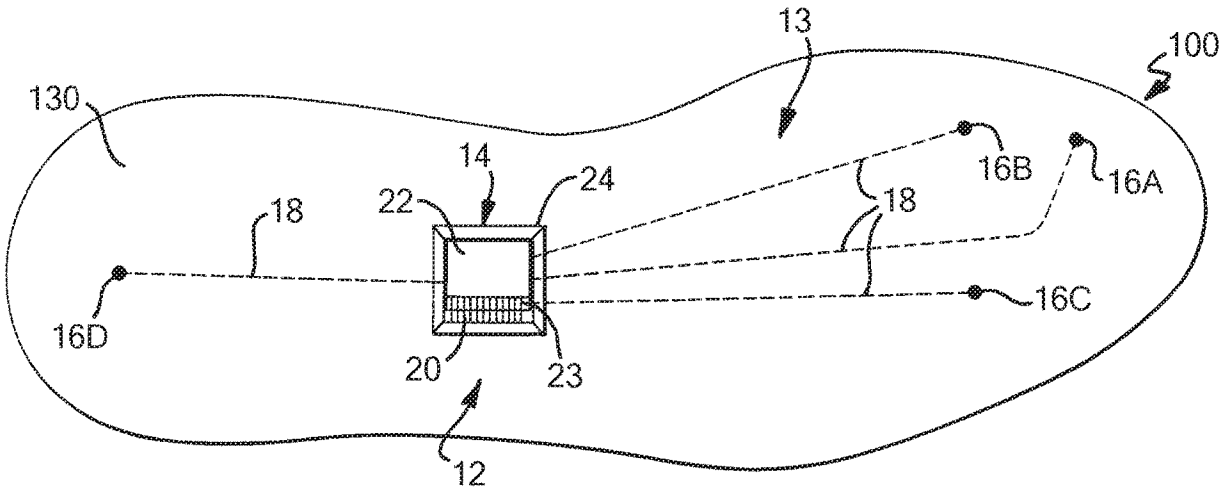
FIG. 3 is a top view of a sole of a shoe incorporating one embodiment of a sensor system.
Figure 4:
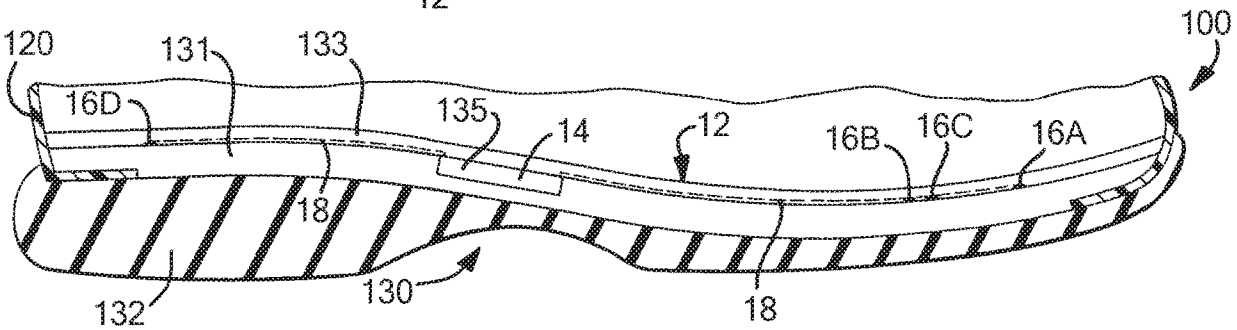
FIG. 4 is a side cross-sectional view of one embodiment of a shoe incorporating the sensor system of FIG. 3.
Figure 5:
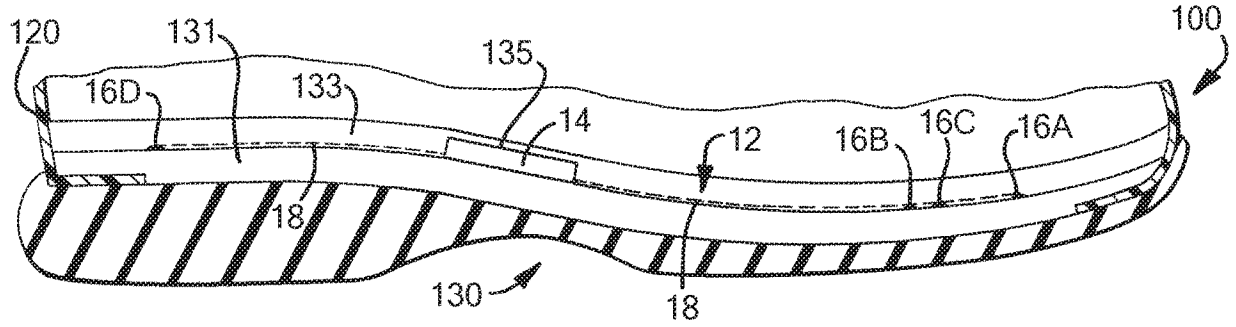
FIG. 5 is a side cross-sectional view of another embodiment of a shoe incorporating the sensor system of FIG. 3.

FIGS. 3-5 illustrate exemplary embodiments of the footwear 100 incorporating a sensor system 12 in accordance with the present invention. The sensor system 12 includes a force sensor assembly 13, having a plurality of sensors 16, and a communication or output port 14 in communication with the sensor assembly 13 (e.g., electrically connected via conductors). In the embodiment illustrated in FIG. 3, the system 12 has four sensors 16: a first sensor 16A at the big toe (first phalange) area of the shoe, two sensors 16B-C at the forefoot area of the shoe, including a second sensor 16B at the first metatarsal head region and a third sensor 16C at the fifth metatarsal head region, and a fourth sensor 16D at the heel. These areas of the foot typically experience the greatest degree of pressure during movement. The embodiment described below and shown in FIGS. 7-9 utilizes a similar configuration of sensors 16. Each sensor 16 is configured for detecting a force exerted by a user's foot on the sensor 16. The sensors communicate with the port 14 through sensor leads 18, which may be wire leads and/or another electrical conductor or suitable communication medium. For example, in one embodiment, the sensor leads 18 may be an electrically conductive medium printed on the foot contacting member 133, the midsole member 131, or another member of the sole structure 130, such as a layer between the foot contacting member 133 and the midsole member 131.

Other embodiments of the sensor system 12 may contain a different number or configuration of sensors 16, such as the embodiments described below and shown in FIGS. 7-9 and generally include at least one sensor 16. For example, in one embodiment, the system 12 includes a much larger number of sensors, and in another embodiment, the system 12 includes two sensors, one in the heel and one in the forefoot of the shoe 100. In addition, the sensors 16 may communicate with the port 14 in a different manner, including any known type of wired or wireless communication, including Bluetooth and near-field communication. A pair of shoes may be provided with sensor systems 12 in each shoe of the pair, and it is understood that the paired sensor systems may operate synergistically or may operate independently of each other, and that the sensor systems in each shoe may or may not communicate with each other. The communication of the sensor systems 12 is described in greater detail below. It is understood that the sensor system 12 may be provided with computer programs/algorithms to control collection and storage of data (e.g., pressure data from interaction of a user's foot with the ground or other contact surface), and that these programs/algorithms may be stored in and/or executed by the sensors 16, the port 14, the module 22, and/or the external device 110. The sensors 16 may include necessary components (e.g. a processor, memory, software, TX/RX, etc.) in order to accomplish storage and/or execution of such computer programs/algorithms and/or direct (wired or wireless) transmission of data and/or other information to the port 14 and/or the external device 110.

The sensor system 12 can be positioned in several configurations in the sole 130 of the shoe 100. In the examples shown in FIGS. 4-5, the port 14, the sensors 16, and the leads 18 can be positioned between the midsole 131 and the foot contacting member 133, such as by connecting the port 14, the sensors 16, and/or the leads 18 to the top surface of the midsole 131 or the bottom surface of the foot contacting member 133. A cavity or well 135 can be located in the midsole 131 (FIG. 4) or in the foot contacting member 133 (FIG. 5) for receiving an electronic module, as described below, and the port 14 may be accessible from within the well 135. In the embodiment shown in FIG. 4, the well 135 is formed by an opening in the upper major surface of the midsole 131, and in the embodiment shown in FIG. 5, the well 135 is formed by an opening in the lower major surface of the foot contacting member 133. The well 135 may be located elsewhere in the sole structure 130 in other embodiments. For example, the well 135 may be located partially within both the foot contacting member 133 and the midsole member 131 in one embodiment, or the well 135 may be located in the lower major surface of the midsole 131 or the upper major surface of the foot contacting member 133. In a further embodiment, the well 135 may be located in the outsole 132 and may be accessible from outside the shoe 100, such as through an opening in the side, bottom, or heel of the sole 130. In the configurations illustrated in FIGS. 4-5, the port 14 is easily accessible for connection or disconnection of an electronic module, as described below. In other embodiments, the sensor system 12 can be positioned differently. For example, in one embodiment, the port 14, the sensors 16, and/or the leads 18 can be positioned within the outsole 132, midsole 131, or foot contacting member 133. In one exemplary embodiment, the port 14, the sensors 16, and/or the leads 18 may be positioned within a foot contacting member 133 positioned above the foot contacting member 133, such as a sock, sockliner, interior footwear bootie, or other similar article. In a further embodiment, the port 14, the sensors 16, and/or the leads 18 can be formed into an insert or a liner, designed to be quickly and easily engaged with the sole structure 130, such as by inserting the insert between the foot contacting member 133 and the midsole 131, such as shown in FIGS. 4-5 and 7-10. Still other configurations are possible, and some examples of other configurations are described below. As discussed, it is understood that the sensor system 12 may be included in each shoe in a pair.

Figure 7:
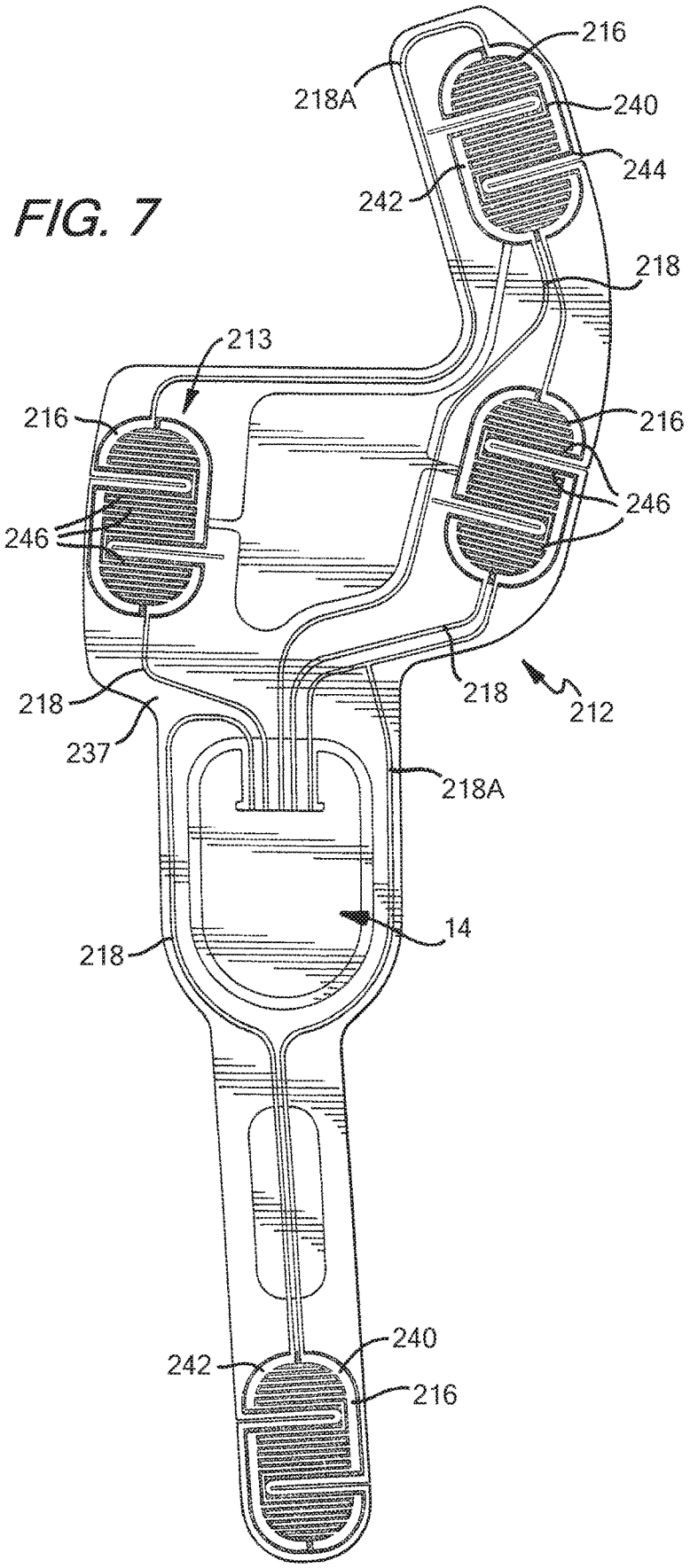
FIG. 7 is a top view of another embodiment of an insert member containing a sensor system according to aspects of the invention.
Figure 8:
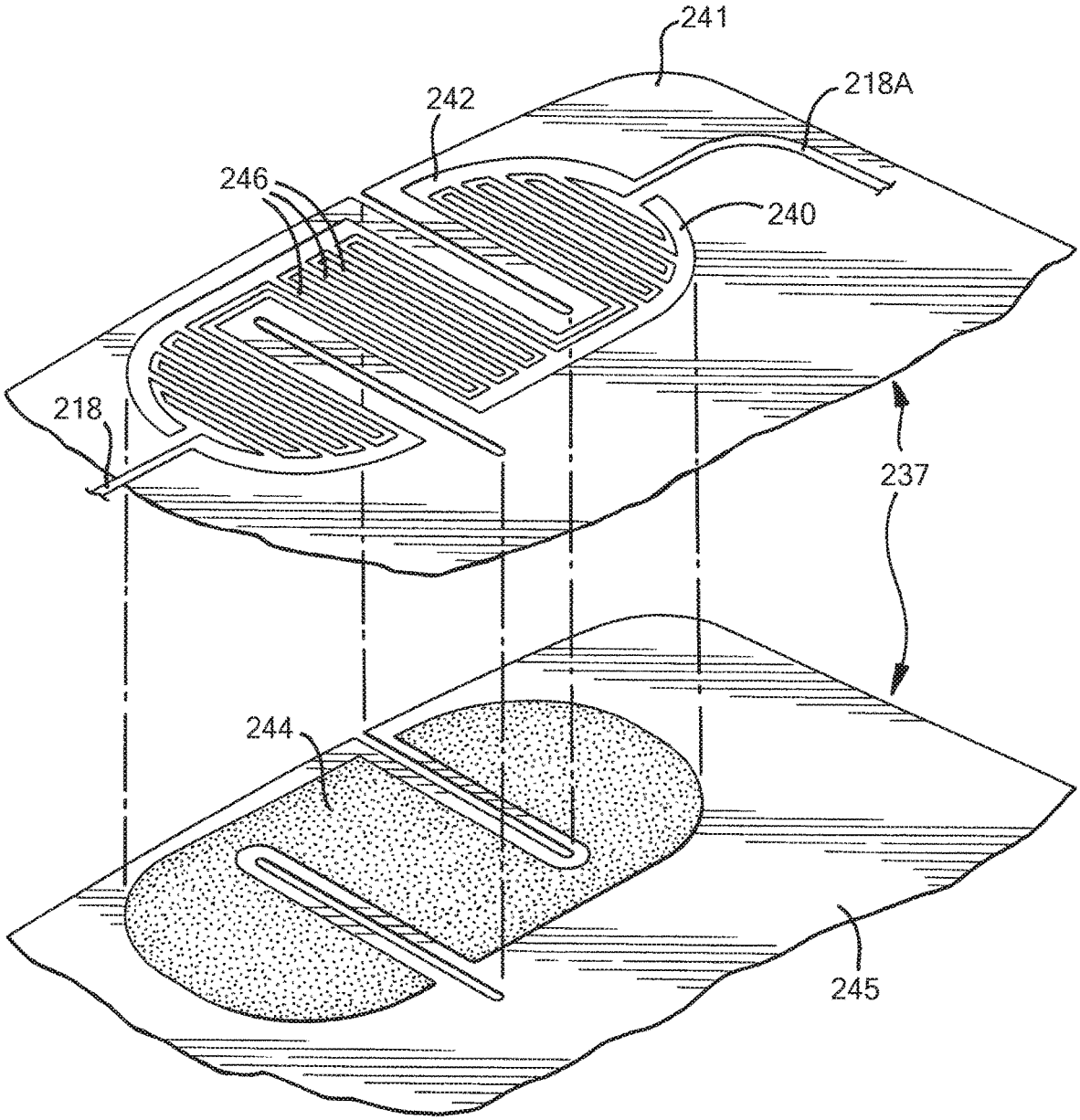
FIG. 8 is a top view of a left and right pair of insert members as shown in FIG. 7.
Figure 9:
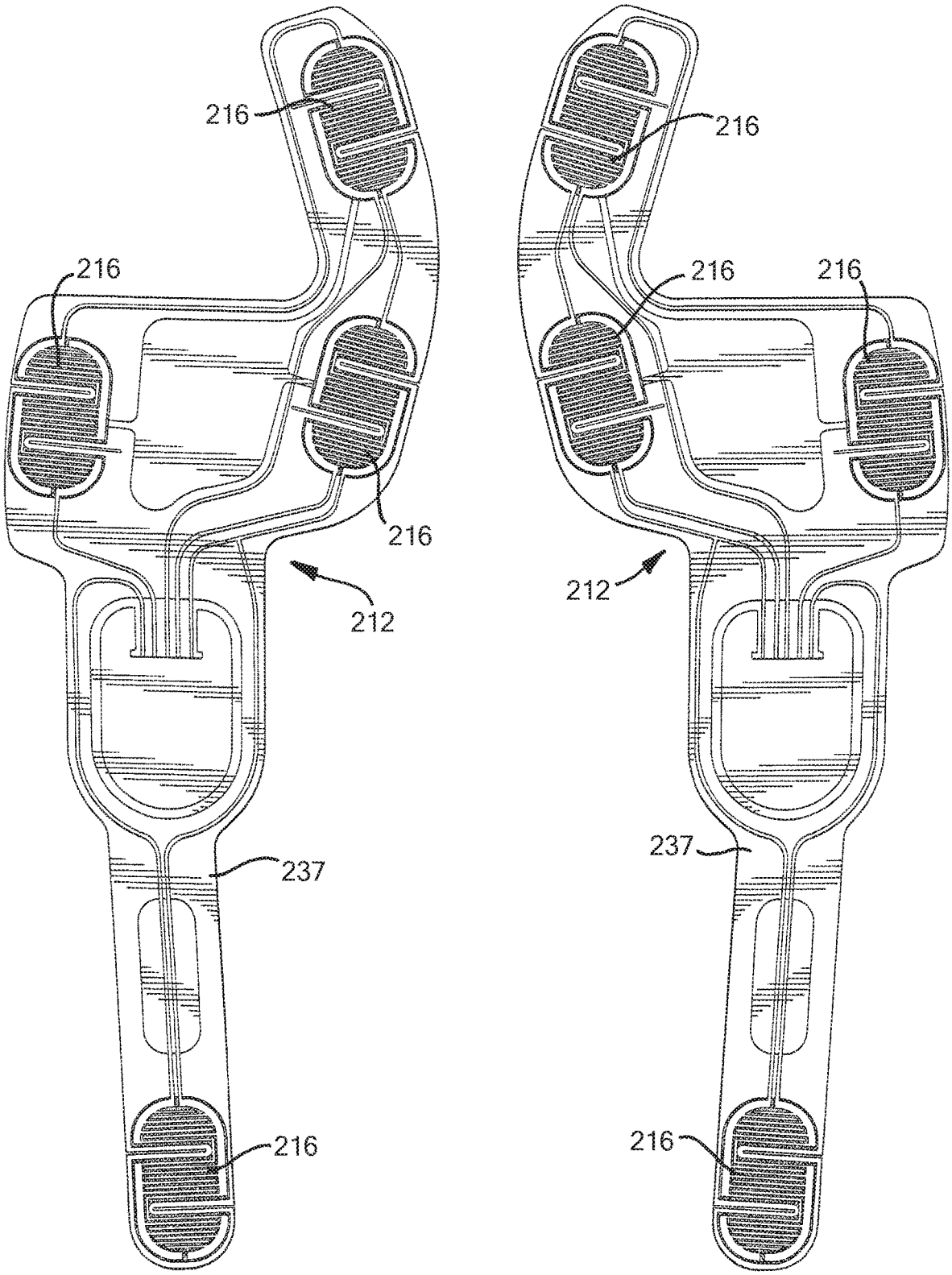
FIG. 9 is a magnified exploded view of a portion of the insert member and sensor system of FIG. 7.
Figure 10:
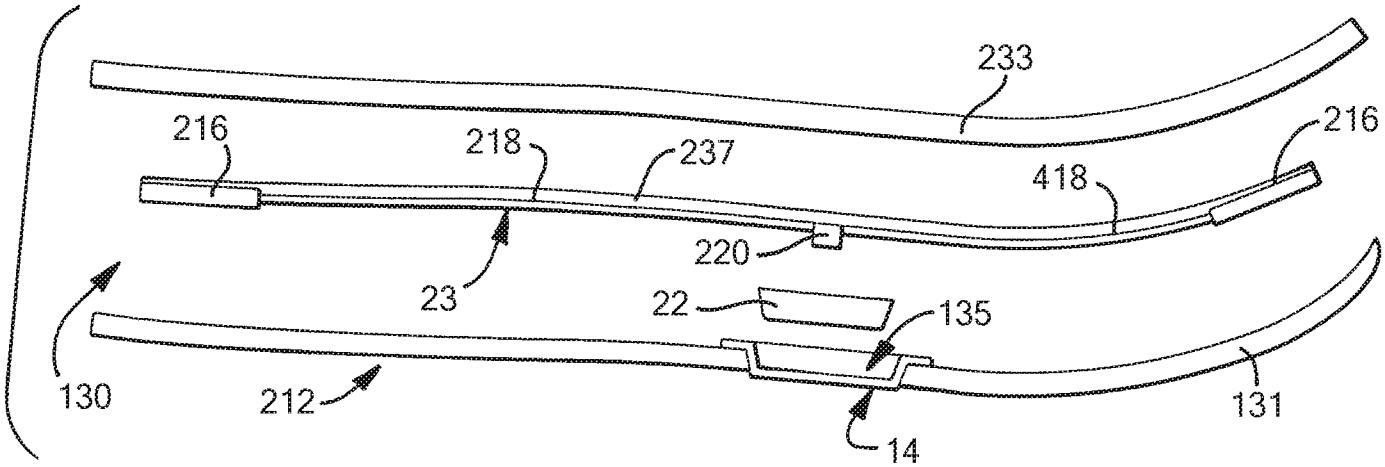
FIG. 10 is a side cross-sectional view of one embodiment of a shoe incorporating the insert member of FIG. 7.

In one embodiment, as shown in FIGS. 7-9, the sensors 16 are force sensors for measuring stress, compression, or other force and/or energy exerted on or otherwise associated with the sole 130, particularly during use of the footwear 100. For example, the sensors 16 may be or comprise force-sensitive resistor (FSR) sensors or other sensors utilizing a force-sensitive resistive material (such as a quantum tunneling composite, a custom conductive foam, or a force-transducing rubber, described in more detail below), magnetic resistance sensors, piezoelectric or piezoresistive sensors, strain gauges, spring based sensors, fiber optic based sensors, polarized light sensors, mechanical actuator based sensors, displacement based sensors, and/or any other types of known sensors or switches capable of measuring force and/or compression of the foot contacting member 133, midsole 131, outsole 132, etc. A sensor may be or comprise an analog device or other device that is capable of detecting or measuring force quantitatively, or it may simply be a binary-type ON/OFF switch (e.g., a silicone membrane type switch). It is understood that quantitative measurements of force by the sensors may include gathering and transmitting or otherwise making available data that can be converted into quantitative force measurements by an electronic device, such as the module 22 or the external device 110. Some sensors as described herein, such as piezo sensors, force-sensitive resistor sensors, quantum tunneling composite sensors, custom conductive foam sensors, etc., can detect or measure differences or changes in resistance, capacitance, or electric potential, such that the measured differential can be translated to a force component. A spring-based sensor, as mentioned above, can be configured to measure deformation or change of resistance caused by pressure and/or deformation. A fiber optic based sensor, as described above, contains compressible tubes with a light source and a light measurement device connected thereto. In such a sensor, when the tubes are compressed, the wavelength or other property of light within the tubes changes, and the measurement device can detect such changes and translate the changes into a force measurement. Nanocoatings could also be used, such as a midsole dipped into conductive material. Polarized light sensors could be used, wherein changes in light transmission properties are measured and correlated to the pressure or force exerted on the sole. One embodiment utilizes a multiple array (e.g. 100) of binary on/off sensors, and force components can be detected by "puddling" of sensor signals in specific areas. Still other types of sensors not mentioned herein may be used. It is understood that the sensors can be relatively inexpensive and capable of being placed in shoes in a mass-production process. More complex sensor systems that may be more expensive could be incorporated in a training type shoe. It is understood that a combination of different types of sensors may be used in one embodiment.

Additionally, the sensors 16 may be placed or positioned in engagement with the shoe structure in many different manners. In one example, the sensors 16 may be printed conductive ink sensors, electrodes, and/or leads deposited on a sole member, such as an airbag or other fluid-filled chamber, a foam material, or another material for use in the shoe 100, or a sock, bootie, insert, liner, insole, midsole, etc. The sensors 16 and/or leads 18 may be woven into garment or fabric structures (such as sockliners, booties, uppers, inserts, etc.), e.g., using conductive fabric or yarns when weaving or knitting the garment or fabric structures. Many embodiments of the sensor system 12 can be made inexpensively, for example, by using a force-sensitive resistor sensor or a force-sensitive resistive material, as described below and shown in FIG. 9. It is understood that the sensors 16 and/or leads 18 also may be deposited on or engaged with a portion of the shoe structure in any desired manner, such as by conventional deposition techniques, by conductive nano-coating, by conventional mechanical connectors, and any other applicable known method. The sensor system can also be configured to provide mechanical feedback to the wearer. Additionally, the sensor system 12 may include a separate power lead to supply power or act as a ground to the sensors 16. In the embodiments described below and shown in FIGS. 7-9, the sensor system 12 includes a separate power lead 18A that is used to connect the sensors 16, to the port 14A-E to supply power from the module 22 to the sensors 16. As a further example, the sensor system 12 can be made by incorporating printed conductive ink sensors 16 or electrodes and conductive fabric or yarn leads 18, or forming such sensors on the foam or airbag of a shoe. Sensors 16 could be incorporated onto or into an airbag in a variety of manners. In one embodiment, the sensors 16 could be made by printing a conductive, force-sensitive material on the airbag on one or more surfaces of the airbag to achieve a strain gauge-like effect. When the bag surfaces expand and/or contract during activity, the sensors can detect such changes through changes in resistance of the force-sensitive material to detect the forces on the airbag. In a bag having internal fabrics to maintain a consistent shape, conductive materials can be located on the top and bottom of the airbag, and changes in the capacitance between the conductive materials as the bag expands and compresses can be used to determine force. Further, devices that can convert changes in air pressure into an electrical signal can be used to determine force as the airbag is compressed.

Figure 6:
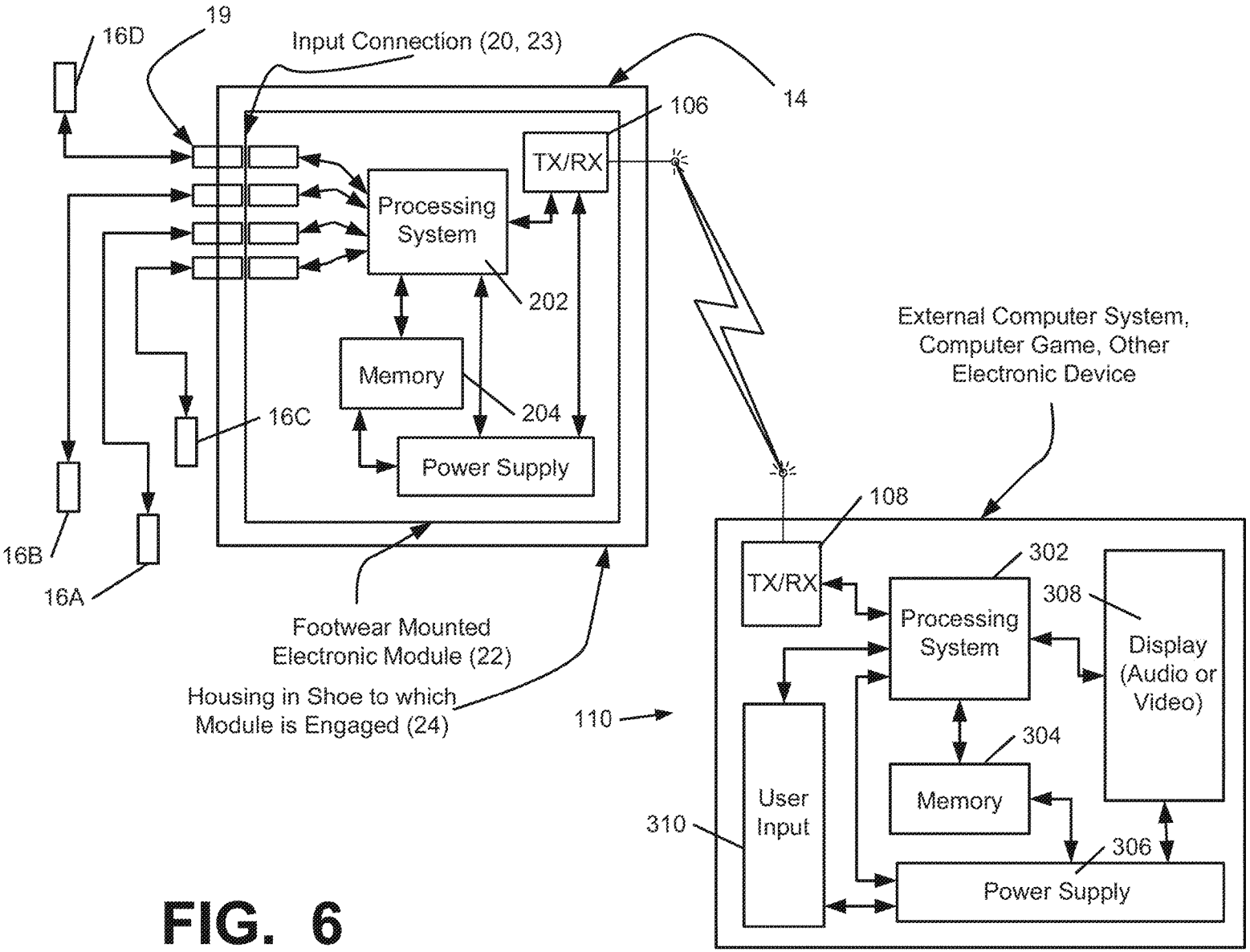
FIG. 6 is a schematic diagram of one embodiment of an electronic module capable of use with a sensor system, in communication with an external electronic device.

The port 14 is configured for communication of data collected by the sensors 16 to an outside source, in one or more known manners. In one embodiment, the port 14 is a universal communication port, configured for communication of data in a universally readable format. In the embodiments shown in FIGS. 3-5, the port 14 includes an interface 20 for connection to an electronic module 22, shown in connection with the port 14 in FIG. 3. In the embodiment shown in FIGS. 3-5, the interface 20 includes a plurality of electrical contacts, similarly to the interfaces 320, et seq. described below. Additionally, in this embodiment, the port 14 is associated with a housing 24 for insertion of the electronic module 22, located in the well 135 in the middle arch or midfoot region of the article of footwear 100. The positioning of the port 14 in FIGS. 3-5 not only presents minimal contact, irritation, or other interference with the user's foot, but also provides easy accessibility by simply lifting the foot contacting member 133. Additionally, as illustrated in FIG. 6, the sensor leads 18 also form a consolidated interface or connection 19 at their terminal ends, in order to connect to the port 14 and the port interface 20. In one embodiment, the consolidated interface 19 may include individual connection of the sensor leads 18 to the port interface 20, such as through a plurality of electrical contacts. In another embodiment, the sensor leads 18 could be consolidated to form an external interface, such as a plug-type interface, or in another manner, and in a further embodiment, the sensor leads 18 may form a non-consolidated interface, with each lead 18 having its own sub-interface. As illustrated in FIG. 6, the sensor leads 18 can converge to a single location to form the consolidated interface. As also described below, the module 22 may have an interface 23 for connection to the port interface 20 and/or the sensor leads 18.

The port 14 is adapted for connection to one or a variety of different electronic modules 22, which may be as simple as a memory component (e.g., a flash drive) or which may contain more complex features. It is understood that the module 22 could be as complex a component as a personal computer, mobile device, server, etc. The port 14 is configured for transmitting data gathered by the sensors 16 to the module 22 for storage and/or processing. In another embodiment, the port 14 may include necessary components (e.g. a processor, memory, software, TX/RX, etc.) in order to accomplish storage and/or execution of such computer programs/algorithms and/or direct (wired or wireless) transmission of data and/or other information to an external device 110. Examples of a housing and electronic modules in a footwear article are illustrated in U.S. patent application Ser. No. 11/416,458, published as U.S. Patent Application Publication No. 2007/0260421, which is incorporated by reference herein and made part hereof. Although the port 14 is illustrated with electrical contacts forming an interface 20 for connection to a module, in other embodiments, the port 14 may contain one or more additional or alternate communication interfaces for communication with the sensors 16, the module 22, the external device 110, and/or another component. For example, the port 14 may contain or comprise a USB port, a Firewire port, 16-pin port, or other type of physical contact-based connection, or may include a wireless or contactless communication interface, such as an interface for Wi-Fi, Bluetooth, near-field communication, RFID, Bluetooth Low Energy, Zigbee, or other wireless communication technique, or an interface for infrared or other optical communication technique (or combination of such techniques).

The port 14 and/or the module 22 may have one or more interfaces 20, 23, and the port 14 may have internal circuitry to connect all of the leads 18, 18A to the interfaces 20, 23. Additionally, the module 22 may have one or more interfaces 23 that are complementary to the interface(s) 20 of the port 14, for connection thereto. For example, if the port 14 has interface(s) 20 in the side walls 139 and/or base wall 143 thereof, the module 22 may have complementary interface(s) 23 in the side walls and/or base wall as well. It is understood that the module 22 and the port 14 may not have identically complementary interfaces 20, 23, and that only one pair of complementary interfaces 20, 23 may be able to achieve communication between the components. In other embodiments, the port 14 and the well 135 may have a different configuration for connection of the leads 18, 18A. Additionally, the port 14 may have a different shape, which may enable a greater variety of connection configurations. Further, any of the connection configurations described herein, or combinations thereof, can be utilized with the various embodiments of sensor systems described herein.

The module 22 may additionally have one or multiple communication interfaces for connecting to an external device 110 to transmit the data, e.g. for processing, as described below and shown in FIG. 6. Such interfaces can include any of the contacted or contactless interfaces described above. In one example, the module 22 includes at least a retractable USB connection for connection to a computer. In another example, the module 22 may be configured for contacted or contactless connection to a mobile device, such as a watch, cell phone, portable music player, etc. The module 22 may be configured to be removed from the footwear 100 to be directly connected to the external device 110 for data transfer, such as by the retractable USB connection described above or another connection interface. However, in another embodiment, the module 22 may be configured for wireless communication with the external device 110, which allows the device 22 to remain in the footwear 100 if desired. In a wireless embodiment, the module 22 may be connected to an antenna for wireless communication. The antenna may be shaped, sized, and positioned for use with the appropriate transmission frequency for the selected wireless communication method. Additionally, the antenna may be located internally within the module 22 or external to the module 22, such as at the port 14 or another location. In one example, the sensor system 12 itself (such as the leads 18 and conductive portions of the sensors 16) could be used to form an antenna in whole or in part. It is understood that the module 22 may contain an antenna in addition to an antenna connected elsewhere in the sensor system 12, such as at the port 14, at one or more of the sensors 16, etc. In one embodiment, the module 22 may be permanently mounted within the footwear 100, or alternately may be removable at the option of the user and capable of remaining in the footwear 100 if desired. Additionally, as further explained below, the module 22 may be removed and replaced with another module 22 programmed and/or configured for gathering and/or utilizing data from the sensors 16 in another manner. If the module 22 is permanently mounted within the footwear 100, the sensor system 12 may further contain an external port 15 to allow for data transfer and/or battery charging, such as a USB or Firewire port. Such an external port 15 may additionally or alternately be used for communication of information. The module 22 may further be configured for contactless charging, such as inductive charging. It is understood that the module 22 may be configured for contacted and/or contactless communication.

While the port 14 may be located in a variety of positions without departing from the invention, in one embodiment, the port 14 is provided at a position and orientation and/or is otherwise structured so as to avoid or minimize contact with and/or irritation of the wearer's foot, e.g., as the wearer steps down in and/or otherwise uses the article of footwear 100, such as during an athletic activity. The positioning of the port 14 in FIGS. 3-5 illustrates one such example. In another embodiment, the port 14 is located proximate the heel or instep regions of the shoe 100. Other features of the footwear structure 100 may help reduce or avoid contact between the wearer's foot and the port 14 (or an element connected to the port 14) and improve the overall comfort of the footwear structure 100. For example, as illustrated in FIGS. 4-5, the foot contacting member 133, or other foot contacting member, may fit over and at least partially cover the port 14, thereby providing a layer of padding between the wearer's foot and the port 14. Additional features for reducing contact between and modulating any undesired feel of the port 14 at the wearer's foot may be used. Of course, if desired, the opening to the port 14 may be provided through the top surface of the foot contacting member 133 without departing from the invention. Such a construction may be used, for example, when the housing 24, electronic module 22, and other features of the port 14 include structures and/or are made from materials so as to modulate the feel at the user's foot, when additional comfort and feel modulating elements are provided, etc. Any of the various features described above that help reduce or avoid contact between the wearer's foot and a housing (or an element received in the housing) and improve the overall comfort of the footwear structure may be provided without departing from this invention, including the various features described above in conjunction with FIGS. 4-5, as well as other known methods and techniques.

In one embodiment, where the port 14 is configured for contacted communication with a module 22 contained in a well 135 in the sole structure 130, the port 14 is positioned within or immediately adjacent the well 135, for connection to the module 22. It is understood that if the well 135 further contains a housing 24 for the module 22, the housing 24 may be configured for connection to the interface 20, such as by providing physical space for the interface 20 or by providing hardware for interconnection between the interface 20 and the module 22. The positioning of the interface 20 in FIG. 3 illustrates one such example, where the housing 24 provides physical space to receive the interface 20 for connection to the module 22.

FIG. 6 shows a schematic diagram of an example electronic module 22 including data transmission/reception capabilities through a data transmission/reception system 106, which may be used in accordance with at least some examples of this invention. While the example structures of FIG. 6 illustrate the data transmission/reception system (TX-RX) 106 as integrated into the electronic module structure 22, those skilled in the art will appreciate that a separate component may be included as part of a footwear structure 100 or other structure for data transmission/reception purposes and/or that the data transmission/reception system 106 need not be entirely contained in a single housing or a single package in all examples of the invention. Rather, if desired, various components or elements of the data transmission/reception system 106 may be separate from one another, in different housings, on different boards, and/or separately engaged with the article of footwear 100 or other device in a variety of different manners without departing from this invention. Various examples of different potential mounting structures are described in more detail below.

In the example of FIG. 6, the electronic module 22 may include a data transmission/reception element 106 for transmitting data to and/or receiving data from one or more remote systems. In one embodiment, the transmission/reception element 106 is configured for communication through the port 14, such as by the contacted or contactless interfaces described above. In the embodiment shown in FIG. 6, the module 22 includes an interface 23 configured for connection to the port 14 and/or sensors 16. In the module 22 illustrated in FIG. 3, the interface 23 has contacts that are complementary with the contacts of the interface 20 of the port 14, to connect with the port 14. In other embodiments, as described above, the port 14 and the module 22 may contain different types of interfaces 20, 23, which may be wired or wireless. It is understood that in some embodiments, the module 22 may interface with the port 14 and/or sensors 16 through the TX-RX element 106. Accordingly, in one embodiment, the module 22 may be external to the footwear 100, and the port 14 may comprise a wireless transmitter interface for communication with the module 22. The electronic component 22 of this example further includes a processing system 202 (e.g., one or more microprocessors), a memory system 204, and a power supply 206 (e.g., a battery or other power source). The power supply 206 may supply power to the sensors 16 and/or other components of the sensor system 12. The shoe 100 may additionally or alternately include a separate power source to operate the sensors 16 if necessary, such as a battery, piezoelectric, solar power supplies, or others.

Connection to the one or more sensors can be accomplished through TX-RX element 106, and additional sensors (not shown) may be provided to sense or provide data or information relating to a wide variety of different types of parameters. Examples of such data or information include physical or physiological data associated with use of the article of footwear 100 or the user, including pedometer type speed and/or distance information, other speed and/or distance data sensor information, temperature, altitude, barometric pressure, humidity, GPS data, accelerometer output or data, heart rate, pulse rate, blood pressure, body temperature, EKG data, EEG data, data regarding angular orientation and changes in angular orientation (such as a gyroscope-based sensor), etc., and this data may be stored in memory 204 and/or made available, for example, for transmission by the transmission/reception system 106 to some remote location or system. The additional sensor(s), if present, may also include an accelerometer (e.g., for sensing direction changes during steps, such as for pedometer type speed and/or distance information, for sensing jump height, etc.).

As additional examples, electronic modules, systems, and methods of the various types described above may be used for providing automatic impact attenuation control for articles of footwear. Such systems and methods may operate, for example, like those described in U.S. Pat. No. 6,430,843, U.S. Patent Application Publication No. 2003/0009913, and U.S. Patent Application Publication No. 2004/0177531, which describe systems and methods for actively and/or dynamically controlling the impact attenuation characteristics of articles of footwear (U.S. Pat. No. 6,430,843, U.S. Patent Application Publication No. 2003/0009913, and U.S. patent application Publication No. 2004/0177531 each are entirely incorporated herein by reference and made part hereof). When used for providing speed and/or distance type information, sensing units, algorithms, and/or systems of the types described in U.S. Pat. Nos. 5,724,265, 5,955,667, 6,018,705, 6,052,654, 6,876,947 and 6,882,955 may be used. These patents each are entirely incorporated herein by reference.

In the embodiment of FIG. 6, an electronic module 22 can include an activation system (not shown). The activation system or portions thereof may be engaged with the module 22 or with the article of footwear 100 (or other device) together with or separate from other portions of the electronic module 22. The activation system may be used for selectively activating the electronic module 22 and/or at least some functions of the electronic module 22 (e.g., data transmission/reception functions, etc.). A wide variety of different activation systems may be used without departing from this invention. In one example, the sensor system 12 may be activated and/or deactivated by activating the sensors 16 in a specific pattern, such as consecutive or alternating toe/heel taps, or a threshold force exerted on one or more sensors 16. In another example, the sensor system 12 may be activated by a button or switch, which may be located on the module 22, on the shoe 100, or on an external device in communication with the sensor system 12, as well as other locations. In any of these embodiments, the sensor system 12 may contain a "sleep" mode, which can deactivate the system 12 after a set period of inactivity. In one embodiment, the sensor system 12 may return to "sleep" mode if no further activity occurs in a short time after activation, in case of unintentional activation. In an alternate embodiment, the sensor system 12 may operate as a low-power device that does not activate or deactivate.

The module 22 may further be configured for communication with an external device 110, which may be an external computer or computer system, mobile device, gaming system, or other type of electronic device, as shown in FIG. 6. The exemplary external device 110 shown in FIG. 6 includes a processor 302, a memory 304, a power supply 306, a display 308, a user input 310, and a data transmission/reception system 108. The transmission/reception system 108 is configured for communication with the module 22 via the transmission/reception system 106 of the module 22, through any type of known electronic communication, including the contacted and contactless communication methods described above and elsewhere herein. It is understood that the module 22 can be configured for communication with a plurality of external devices, including a wide variety of different types and configurations of electronic devices, and that the device(s) with which the module 22 communicates can change over time. Additionally, the transmission/reception system 106 of the module 22 may be configured for a plurality of different types of electronic communication. It is further understood that the external device 110 as described herein may be embodied by two or more external devices in communication with the module 22, the port 14, and/or each other, including one or more intermediate devices that pass information to the external device 110, and that the processing, execution of programs/algorithms, and other functions of the external device 110 may be performed by a combination of external devices Many different types of sensors can be incorporated into sensor systems according to the present invention. FIGS. 7-10 illustrate one example embodiment of a sole structure 130 for a shoe 100 that contains a sensor system 212 that includes a sensor assembly 213 incorporating a plurality of force-sensitive resistor (FSR) sensors 216. The sensor system 212 is similar to the sensor system 12 described above, and also includes a port 14 in communication with an electronic module 22 and a plurality of leads 218 connecting the FSR sensors 216 to the port 14. The module 22 is contained within a housing 24 in a well or cavity 135 in the sole structure 130 of the shoe 100, and the port 14 is connected to the well 135 to enable connection to the module 22 within the well 135. The port 14 and the module 22 include complementary interfaces 220, 223 for connection and communication. The sensors 216 and sensor leads 218 of the sensor system 212 are positioned on an insert 237 that is adapted to be engaged with the sole structure 130. In the embodiment shown in FIGS. 7-10, the insert 237 is positioned on top of the midsole 131, between the foot contacting member 133 and the midsole 131 of the sole structure 130, and the housing 24 is positioned within a well 135 in the midsole 131 and is covered by the foot contacting member 133. During assembly, the insert 237 can be inserted above the midsole member 131 (and above the strobel, if present) during manufacturing of the shoe 100 after connection of the upper 120 to the midsole 131 and outsole 132, and then the foot-contacting member 133 can be inserted over the sensor system 212, although other assembly methods can be used. In other embodiments, the sensor system 212 can be differently configured or positioned, such as by placing the insert 237, the sensors 216, and/or the port 14 in a different location. For example, the well 135, the housing 24 and/or the port 14 may be positioned wholly or partially within the foot contacting member 133, as shown in FIG. 5, or the sensor system 212 and/or the insert 237 can be positioned on top of the foot contacting member 133. Any of the configurations of sensor systems, including any of the types and configurations of sensors, ports, inserts, etc., shown and described in U.S. Patent Application Publications Nos. 2010/0063778 and 2010/0063779, both filed on Jun. 12, 2009, can be used, which applications are incorporated by reference herein in their entireties and made part hereof. It is understood that the sensor system 12 shown in FIGS. 3-5 can have a configuration similar to the sensor system 212 of FIGS. 7-10, or any other configuration described herein, including any configuration shown and described in U.S. Patent Application Publications Nos. 2010/0063778 and 2010/0063779.

The sensor system 212 in FIGS. 7-10 includes four sensors 216, with a first sensor 216 positioned in the first phalange (big toe) area, a second sensor 216 positioned in the first metatarsal head area, a third sensor 216 positioned in the fifth metatarsal head area, and a fourth sensor 216 positioned in the heel area. The sensors 216 each have a sensor lead 218 connecting the sensor 216 to the port 14. Additionally, a power lead 218A extends from the port 14 and is connected to all four sensors 216. The power lead 218A may be connected in a parallel, series, or other configuration in various embodiments, and each sensor 216 may have an individual power lead in another embodiment. All of the leads 218, 218A are connected to the port 14 for connection and transfer of data to a module 22 connected to the port 14. It is understood that the port 14 may have any configuration described herein. In this embodiment, the leads 218, 218A are positioned suitably for a 5-pin connection.

The FSR sensors 216 shown in FIGS. 7-9 contain first and second electrodes or electrical contacts 240, 242 and a force-sensitive resistive material 244 disposed between the electrodes 240, 242 to electrically connect the electrodes 240, 242 together. When force/pressure is applied to the force-sensitive material 244, the resistivity and/or conductivity of the force-sensitive material 244 changes, which changes the electrical potential and/or the current between the electrodes 240, 242. The change in resistance can be detected by the sensor system 212 to detect the force applied on the sensor 216. The force-sensitive resistive material 244 may change its resistance under pressure in a variety of ways. For example, the force-sensitive material 244 may have an internal resistance that decreases when the material is compressed, similar to the quantum tunneling composites described in greater detail below. Further compression of this material may further decrease the resistance, allowing quantitative measurements, as well as binary (on/off) measurements. In some circumstances, this type of force-sensitive resistive behavior may be described as "volume-based resistance," and materials exhibiting this behavior may be referred to as "smart materials." As another example, the material 244 may change the resistance by changing the degree of surface-to-surface contact. This can be achieved in several ways, such as by using microprojections on the surface that raise the surface resistance in an uncompressed condition, where the surface resistance decreases when the microprojections are compressed, or by using a flexible electrode that can be deformed to create increased surface-to-surface contact with another electrode. This surface resistance may be the resistance between the material 244 and the electrode 240, 242 and/or the surface resistance between a conducting layer (e.g. carbon/graphite) and a force-sensitive layer (e.g. a semiconductor) of a multi-layer material 244. The greater the compression, the greater the surface-to-surface contact, resulting in lower resistance and enabling quantitative measurement. In some circumstances, this type of force-sensitive resistive behavior may be described as "contact-based resistance." It is understood that the force-sensitive resistive material 244, as defined herein, may be or include a doped or non-doped semiconducting material.

The electrodes 240, 242 of the FSR sensor 216 can be formed of any conductive material, including metals, carbon/graphite fibers or composites, other conductive composites, conductive polymers or polymers containing a conductive material, conductive ceramics, doped semiconductors, or any other conductive material. The leads 218 can be connected to the electrodes 240, 242 by any suitable method, including welding, soldering, brazing, adhesively joining, fasteners, or any other integral or non-integral joining method. Alternately, the electrode 240, 242 and associated lead 218 may be formed of a single piece of the same material. As described below, the force sensitive resistive material 244 can be carbon (such as carbon black) in one embodiment, however other types of sensors may utilize a different type of force-sensitive resistive material 244, such as a quantum tunneling composite, a custom conductive foam, a force transducing rubber, and other force-sensitive resistive materials described herein.

In the example embodiment shown in FIGS. 7-9, the electrodes 240, 242 of the FSR sensor 216 have a plurality of interlocking or intermeshing fingers 246, with the force-sensitive resistive material 244 positioned between the fingers 246 to electrically connect the electrodes 240, 242 to each other. In the embodiment shown in FIG. 8, each of the leads 218 independently supplies power from the module 22 to the sensor 216 to which each respective lead 218 is connected. It is understood that the sensor leads 218 may include separate leads extending from each electrode 240, 242 to the port 14, and that the module 22 may provide electrical power to the electrodes 240, 242 through such separate leads, such as through a separate power lead 218A.

Force-sensitive resistors suitable for use in the sensor system 212 are commercially available from sources such as Sensitronics LLC. Examples of force-sensitive resistors which may be suitable for use are shown and described in U.S. Pat. Nos. 4,314,227 and 6,531,951, which are incorporated herein by reference in their entireties and made parts hereof.

In the embodiment of the sensor system 212 shown in FIGS. 7-10, each sensor 216 includes two contacts 240, 242 constructed of a conductive metallic layer and a carbon layer (such as carbon black) forming a contact surface on the metallic layer (not shown). The sensors 216 also include a force-sensitive resistive material 244 that is constructed of a layer or puddle of carbon (such as carbon black), which is in contact with the carbon contact surfaces of the electrodes 240, 242. The carbon-on-carbon contact can produce greater conductivity changes under pressure, increasing the effectiveness of the sensors 216. The leads 218, 218A in this embodiment are constructed of a conductive metallic material that may be the same as the material of the metallic layer of the contacts 240, 242. In one embodiment, the leads 218, 218A and the metallic layers of the contacts 240, 242 are constructed of silver.

As shown in FIG. 9, in this example embodiment, the sensor system 212 is constructed of two flexible layers 241 and 245 that combine to form an insert member 237 for insertion into an article of footwear, such as between the foot contacting member 133 and the midsole member 131 as discussed above. The layers 241, 245 can be formed of any flexible material, such as a flexible polymer material. In one embodiment, the layers 241, 245 are formed of a 0.05-0.2 mm thick pliable thin Mylar material. The insert 237 is constructed by first depositing the conductive metallic material on the first layer 241, such as by printing, in the traced pattern of the leads 218, 218A and the electrodes 240, 242 of the sensors 216, to form the configuration shown in FIGS. 7-9. Then, the additional carbon contact layer is deposited on the first layer 241, tracing over the electrodes 240, 242 of the sensors 216, and the carbon force-sensitive resistive material 244 is deposited as puddles on the second layer 245, as also shown in FIG. 9. After all the materials have been deposited, the layers 241, 245 are positioned in a superimposed manner, as shown in FIG. 9, so that the electrodes 240, 242 are aligned with the puddles of force-sensitive resistive material 244, to form the insert member 237 for insertion into the article of footwear 100. It is understood that the conductive metallic material and the carbon material 244 are deposited on the faces of the layers 266, 268 that face each other (e.g. the top surface of the bottom-most layer 266, 268 and the bottom surface of the top-most layer 266, 268). In one embodiment, the sensor system 212 constructed in this manner can detect pressures in the range of 10-750 kPa. In addition, the sensor system 1312 may be capable of detecting pressures throughout at least a portion of this range with high sensitivity. The insert member 237 may further include one or more additional layers, such as a graphic layer (not shown).

Figure 11:
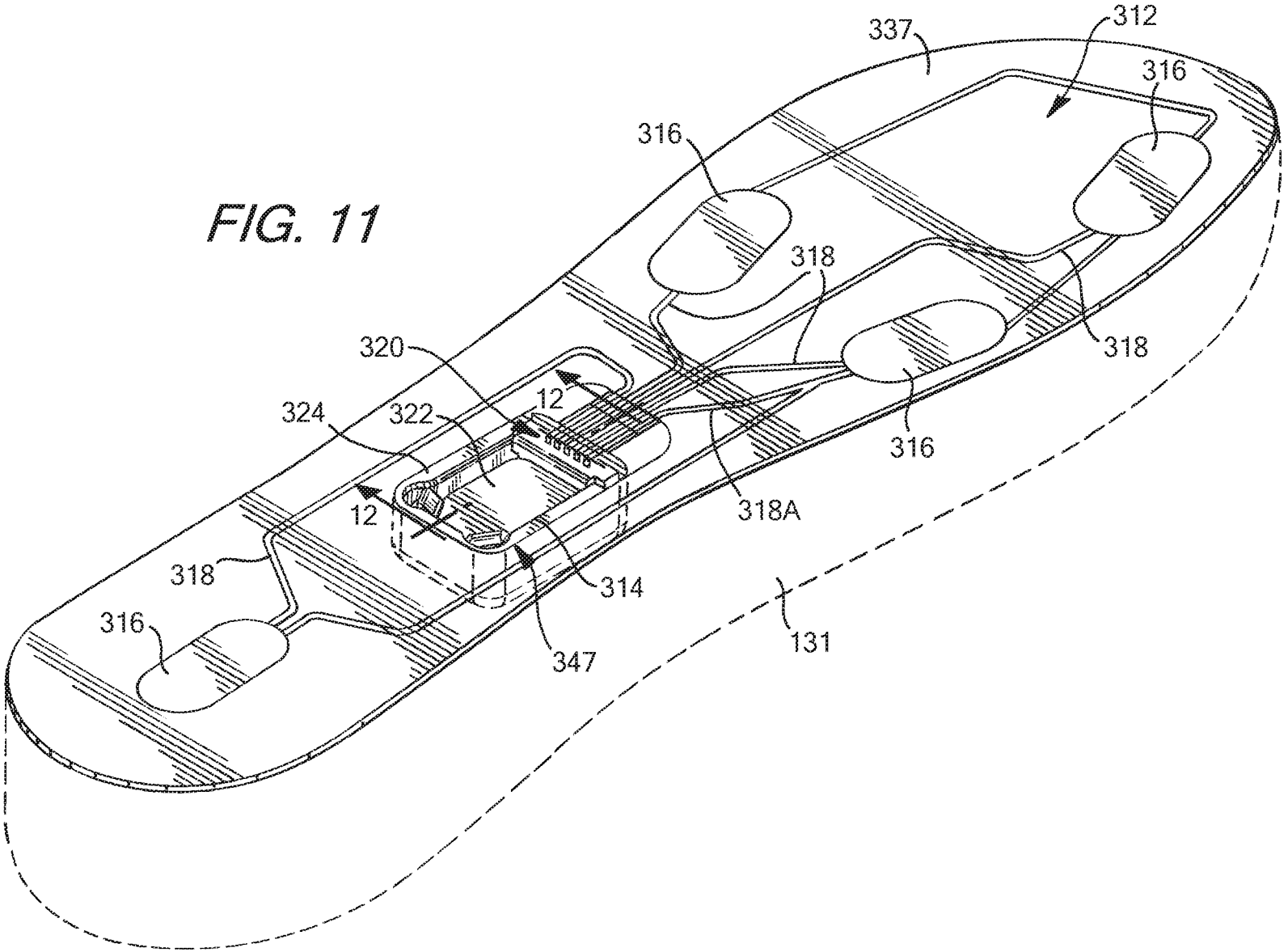
FIG. 11 is a perspective view of another embodiment of a sensor system according to aspects of the invention, for use with an article of footwear, with a sole structure of the article of footwear being depicted schematically by broken lines.
Figure 12:
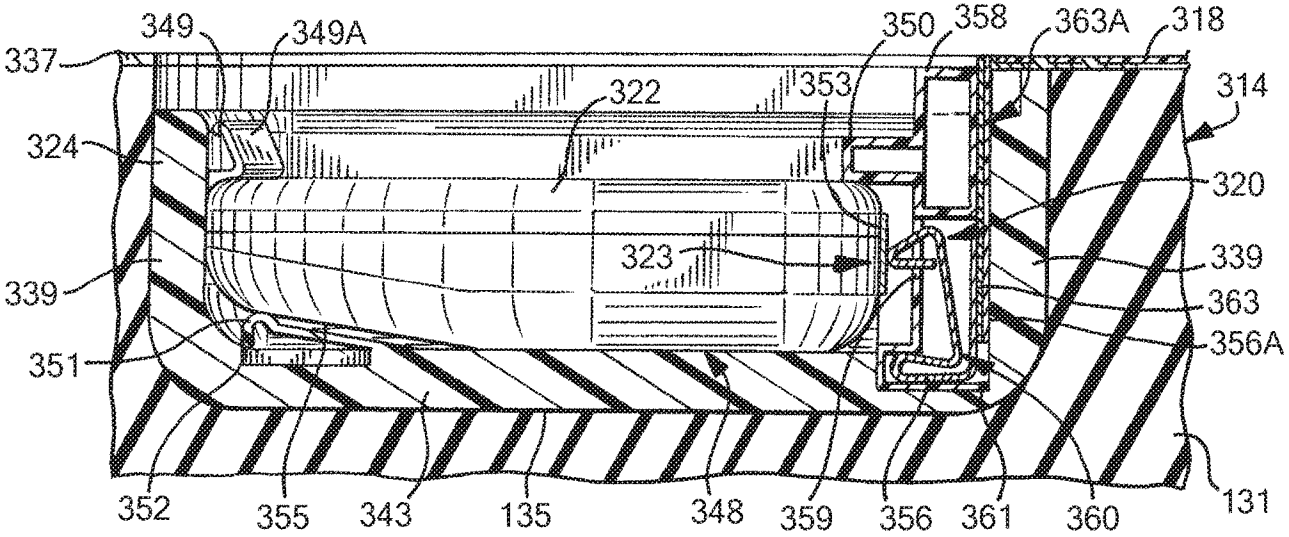
FIG. 12 is a cross-sectional view taken along lines 12-12 of FIG. 11, showing a port of the sensor system of FIG. 11 and an electronic module being received in a housing of the sensor system.
Figure 13:
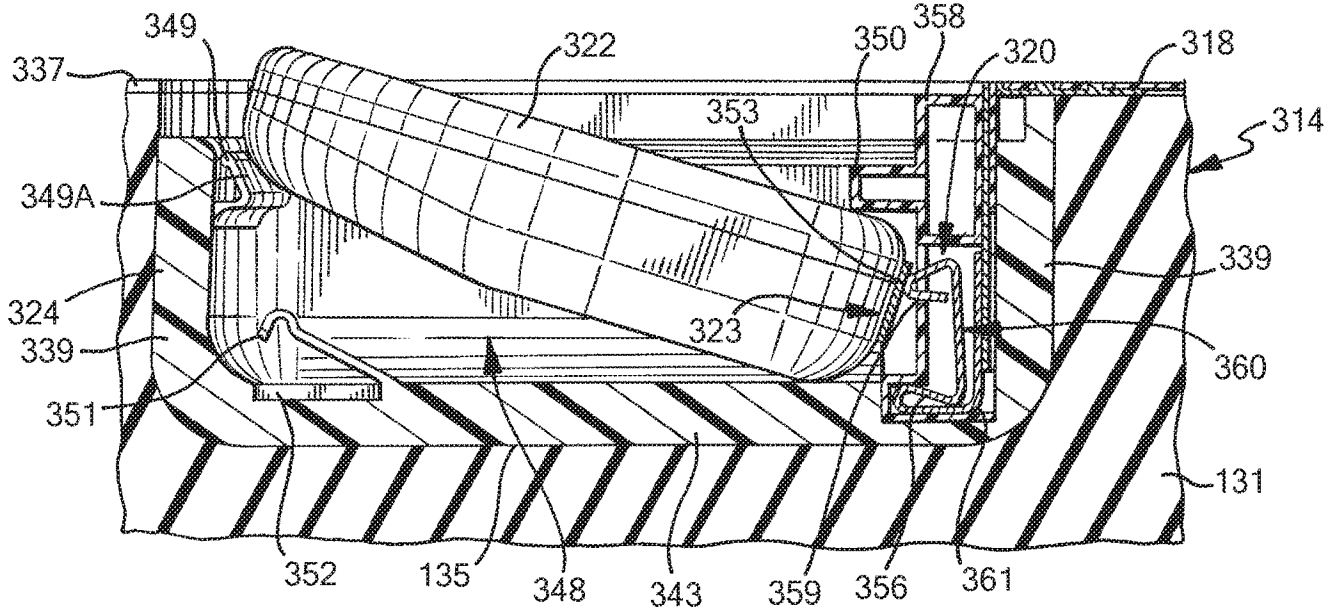
FIG. 13 is a cross-sectional view showing the port and the module of FIG. 12, with the module being inserted into the port.

FIGS. 11-35 and 40-49 illustrate various embodiments of ports 14 that can be used with sensor systems 12, 212 as shown in FIGS. 1-10, or with other embodiments of sensor systems, as well as modules 22 that can be used in connection with such ports 14. FIGS. 11-23 illustrate one embodiment of a port 314 that can be used in connection with a sensor system 312 according to aspects and features described herein. FIGS. 11-13 illustrate the port 314 as part of the sensor system 312 configured similarly to the sensor system 212 described above, with four sensors 316 positioned in the first phalange (big toe) area, the first metatarsal head area, the fifth metatarsal head area, and the heel area. The sensors 316 may be FSR sensors or a different type of sensor or combination of such sensors, as described above. The sensors 316 and the leads 318, including the power lead 318A, are disposed on an insert 337 that is positioned to engage the midsole member 131 of the sole structure 130 of an article of footwear, similarly to the sensor system 212 described above and shown in FIGS. 7-10. Additionally, the port 314 includes an interface 320 for electrical connection to an electronic module 322, and the sensor leads 318, 318A all end at the interface 320. The port 314 is at least partially received in a well 135 in the sole structure 130, and in this embodiment, the well 135 is located entirely within the midsole member 131.

Figure 14:
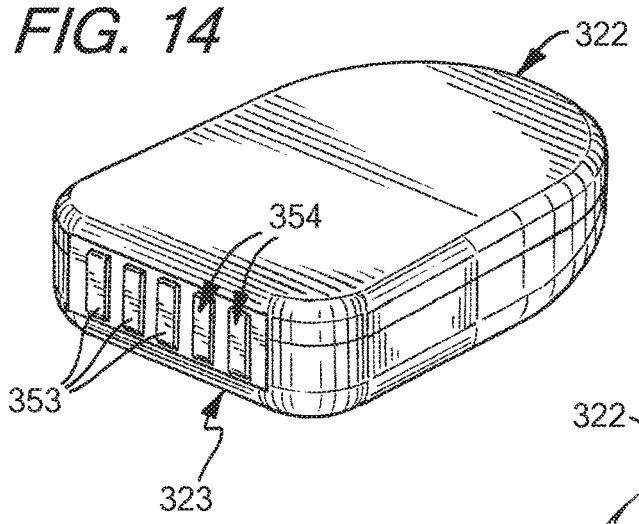
FIG. 14 is a perspective view of the module shown in FIG. 12.
Figure 15:
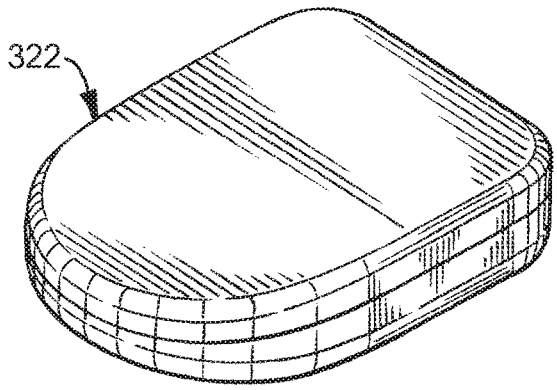
FIG. 15 is a rear perspective view of the module of FIG. 14.
Figure 16:
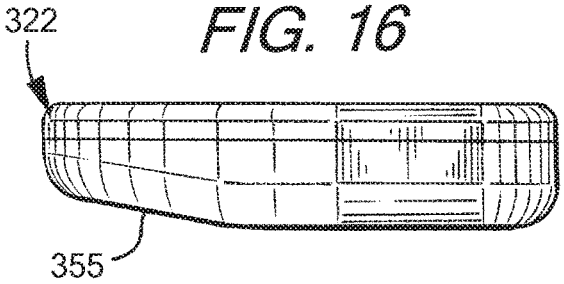
FIG. 16 is a side view of the module of FIG. 14.
Figure 17:
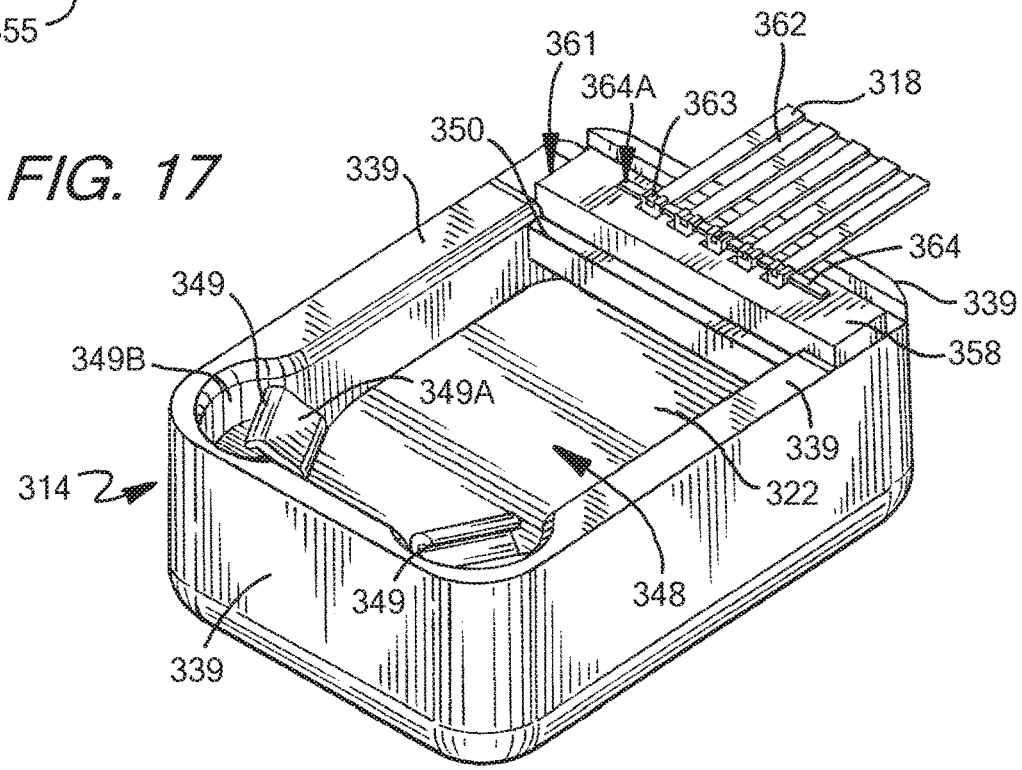
FIG. 17 is a perspective view of the port of FIG. 11, showing the module received in the housing thereof.
Figure 36:
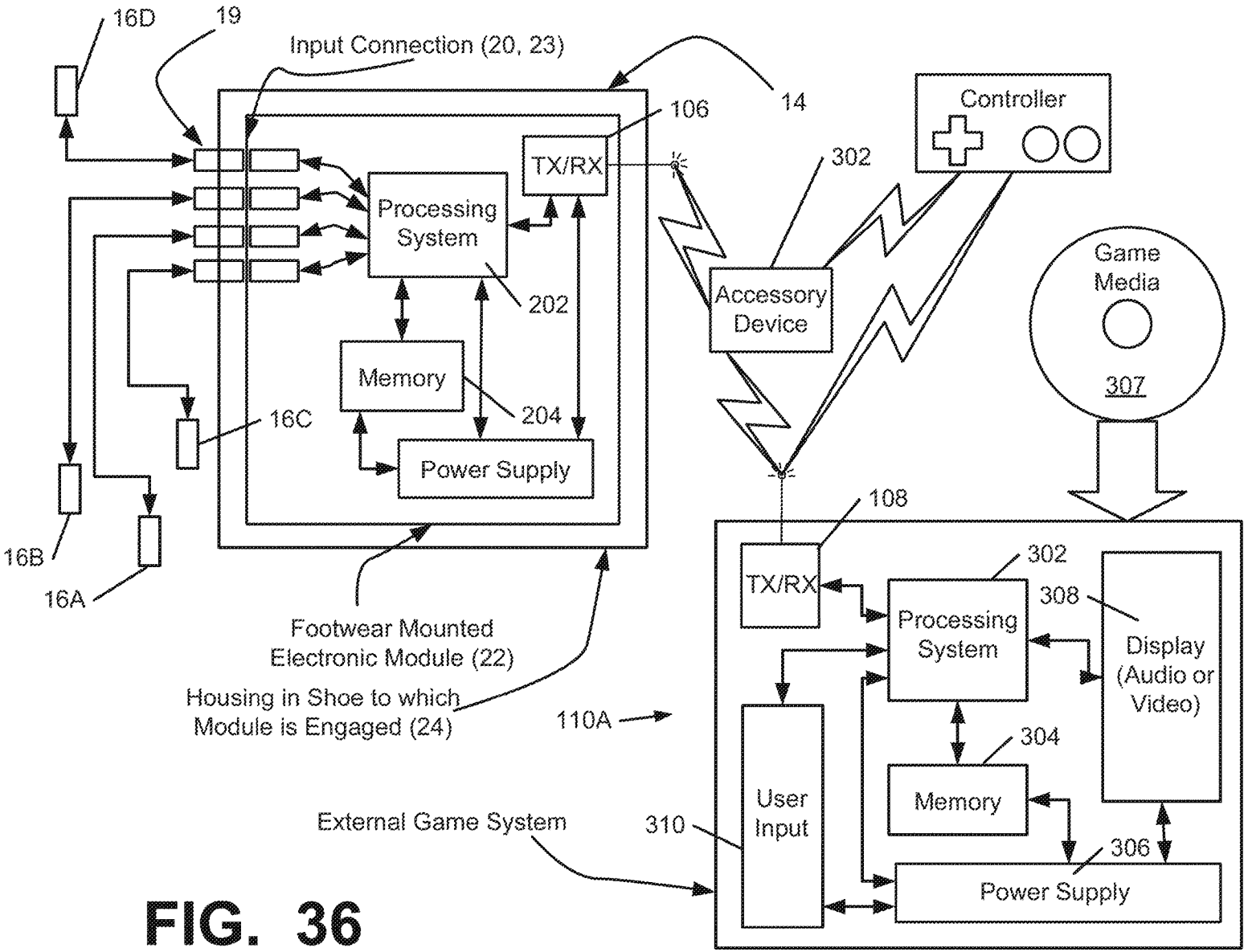
FIG. 36 is a schematic diagram of the electronic module of FIG. 6, in communication with an external gaming device.

One embodiment of an electronic module 322 as described above is illustrated in FIGS. 12-16. The shape of the module 322 is generally rectangular at the front end, with a rounded rear end, as seen in FIGS. 14 and 15. Additionally, the module 322 has a tapered portion 355 on the bottom side thereof, as shown in FIGS. 12-13 and 16, the significance of which is described below. The module 322 has an interface 323 at the front end thereof, having one or more electrical contacts 353 and being adapted for forming an electrical connection with the interface 320 of the port 314. The contacts 353 in this embodiment are in the form of electrical contact pads 353 with flat contact surfaces 354. The module 322 may include any additional features described herein, such as in FIGS. 6 and 36, including any necessary hardware and software for collecting, processing, and/or transmitting data.

In the embodiment illustrated in FIGS. 11-23, the port 314 includes a housing 324 that is adapted to be received in the well 135 of the sole structure 130 and the interface 320 engaged with the housing 324. As shown in FIG. 11, the housing 324 in this embodiment is engaged with the insert 337 of the sensor system 312, and is positioned in an opening 347 in the insert 337 to be accessible through the insert 337. In other embodiments, the housing 324 may be differently configured with respect to the insert 337, such as being positioned below the insert 337 so that the insert 337 must be raised to access the housing 324. The housing 324 has a chamber 348 that is defined by a plurality of side walls 339 and a bottom wall 343 and is adapted to receive the module 322 therein. In this embodiment, the chamber 348 is substantially rectangular and defined by four side walls 339, but the chamber 348 may have a different shape in other embodiments, such as some embodiments described below.

Figure 19:
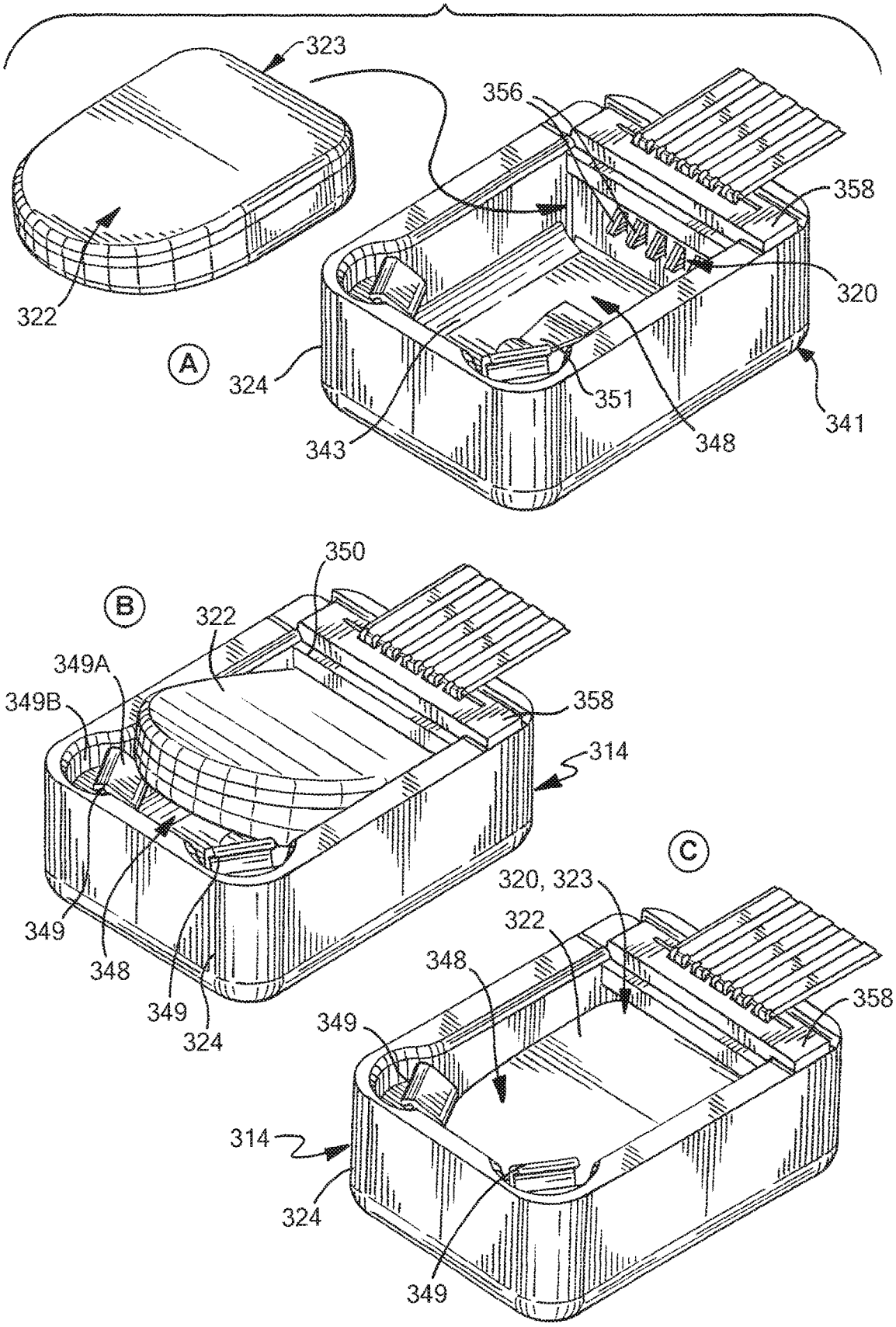
FIG. 19 is a schematic view illustrating the insertion of the module into the housing of the port of FIG. 11.

The housing 324 also includes retaining structure to retain the module 322 within the chamber 348. In this embodiment, the retaining structure includes retaining members 349, 350 adapted to engage the module 322 and exert a downward retaining force on the module 322 and a biasing member 351 adapted to engage the module 322 and exert an upward biasing force on the module 322. The retaining members 349, 350 include one or more flexible retaining tabs 349 and a rigid retaining member 350 in the form of a lip. The retaining lip 350 is positioned proximate the interface 320, and is configured to hold the front of the module 322 near the interface 320, and the flexible retaining tabs 349 are positioned at the opposite end of the chamber 348 from the interface 320. As shown in FIGS. 13 and 19, the module 322 can be inserted into the chamber 348 by first placing the front of the module 322 underneath the retaining lip 350 and then pressing the back of the module 322 downward. The retaining tabs 349 are flexible and resilient and have ramped surfaces 349A that permit the tabs 349 to flex slightly to allow the module 322 to pass by, whereupon the tabs 349 flex back to their original positions to retain the module 322. To remove the module 322, the tabs 349 can be manipulated by the user to flex backward to enable the module 322 to be released from the chamber 348. Notches 349B are provided behind the retaining tabs 349 to provide room for the retaining tabs 349 to flex. The biasing member 351 is a flexible biasing tab that is connected to the bottom wall 343 of the housing 324. The biasing tab 351 is engaged by the module 322 and flexes downward when the module 322 is pushed into the chamber 348, and thereby exerts an upward biasing force on the module 322. The upward biasing force assists in holding the module 322 in place securely against the retaining members 349, 350, and also facilitates removal of the module 322 by pushing the module 322 upward when the retaining tabs 349 are pulled backward. The bottom wall 343 of the housing 324 further includes a detent 352 beneath the biasing tab 351 to permit room for the biasing tab 351 to flex downward. In other embodiments, the housing 324 may contain a different accommodating structure for the biasing tab 351, such as a window completely through the bottom wall 343, or may contain no accommodating structure. The tapered surface 355 of the module 322 is engaged by the biasing tab 351 and provides room for the biasing tab 351 when the module 322 is received in the chamber 348. Additionally, the engagement between the biasing tab 351 and the tapered surface 355 exerts a forward force on the module 322, pushing the interface 323 of the module 322 into contact with the interface 320 of the port 314.

Figure 20:
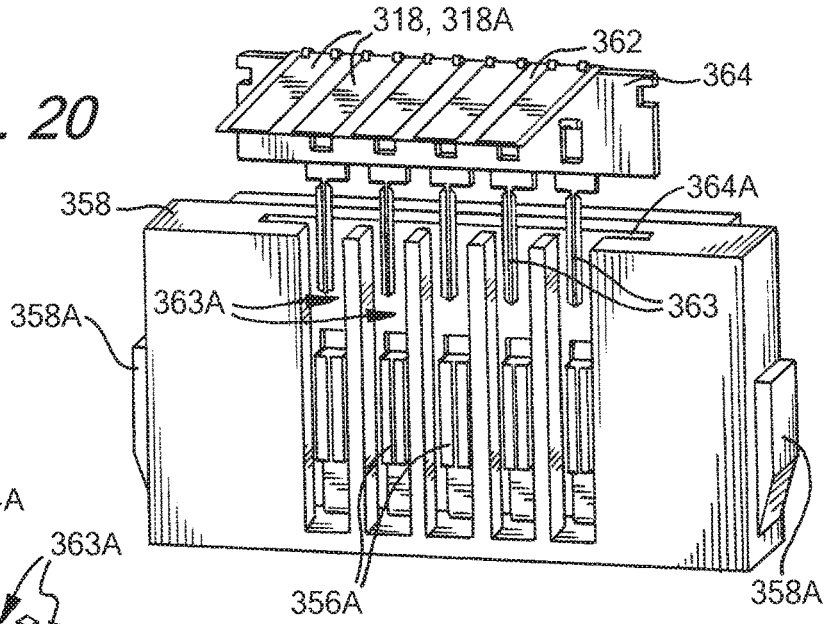
FIG. 20 is a rear view of the interface of FIG. 18, showing part of the assembly thereof.
Figure 21:
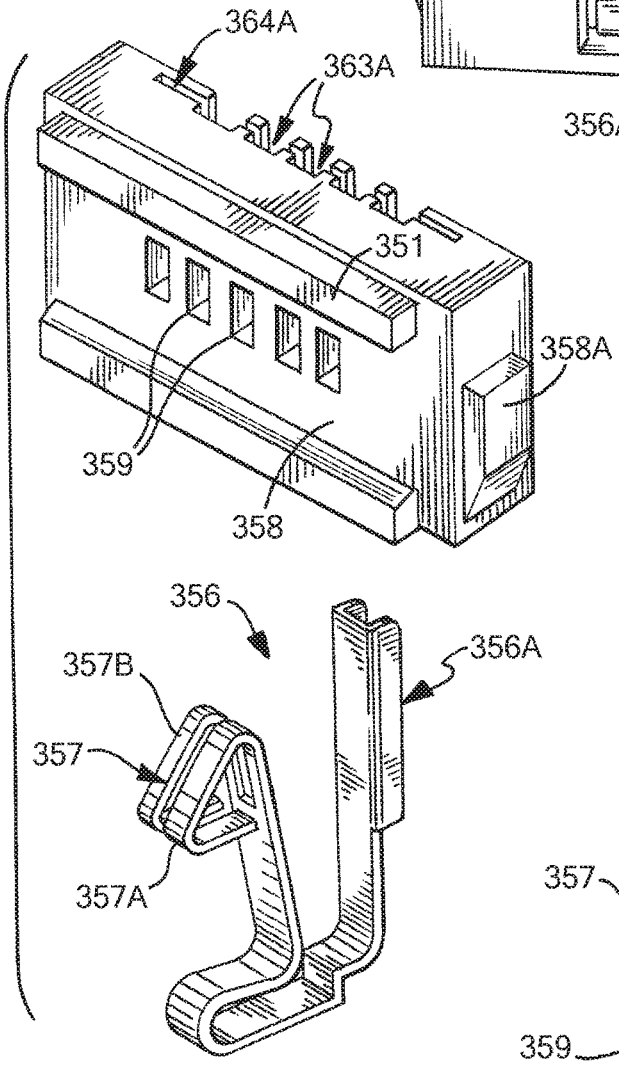
FIG. 21 is a perspective view of a base and an electrical contact of the interface of FIG. 18.
Figure 22:
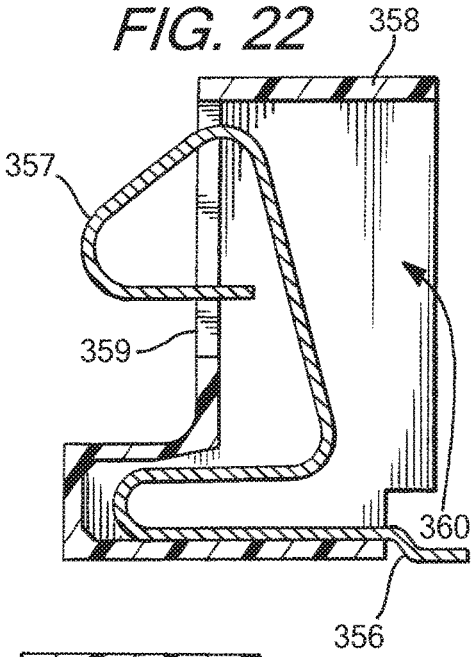
FIG. 22 is a cross-sectional view of a portion of the interface of FIG. 11, showing the electrical contact in an outwardly-flexed position.
Figure 23:
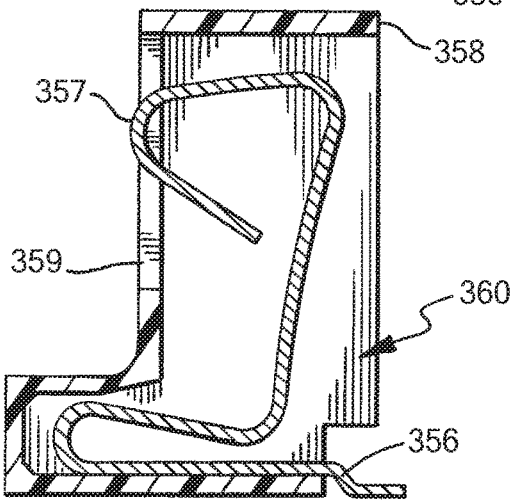
FIG. 23 is a cross sectional view of a portion of the interface as illustrated in FIG. 22, showing the electrical contact in an inwardly-flexed position.

The interface 320 is engaged with the housing 324 and is adapted for electrical connection to the module interface 323 when the module 322 is received in the chamber 348. The interface 320 contains one or more electrical contacts 356 having contact surfaces 357 that are exposed to the chamber 348 and are adapted to form an electrical connection by engaging the contact surface(s) 354 of the electrical contact(s) 353 of the module interface 323. In the embodiment illustrated in FIGS. 12-13 and 18-23, the contacts 356 of the interface 320 are in the form of contact springs 356 received in a base or support frame 358 to hold the contact springs 356 in place. As shown in FIGS. 12-13, the contact surfaces 357 of the contact springs 356 extend outwardly of the base 358 through windows 359 facing the chamber 348, to engage the contacts 353 of the module 322, and have the ability to flex inwardly when engaged by the module 322. Additionally, the contact springs 356 are biased outwardly when flexed by engagement with the module 322, in order to provide more secure engagement with the contacts 353 of the module 322. FIGS. 22 and 23 illustrate flexing of the contact springs 356. Further, as shown in FIG. 21, the contact surfaces 357 of the contact springs 356 are split into two portions 357A,B in this embodiment. One of these portions 357A is wider than the other portion 357B, with the narrower portion 357B having ⅔ the width of the wider portion 357A to provide differential contact areas.

Figure 18:
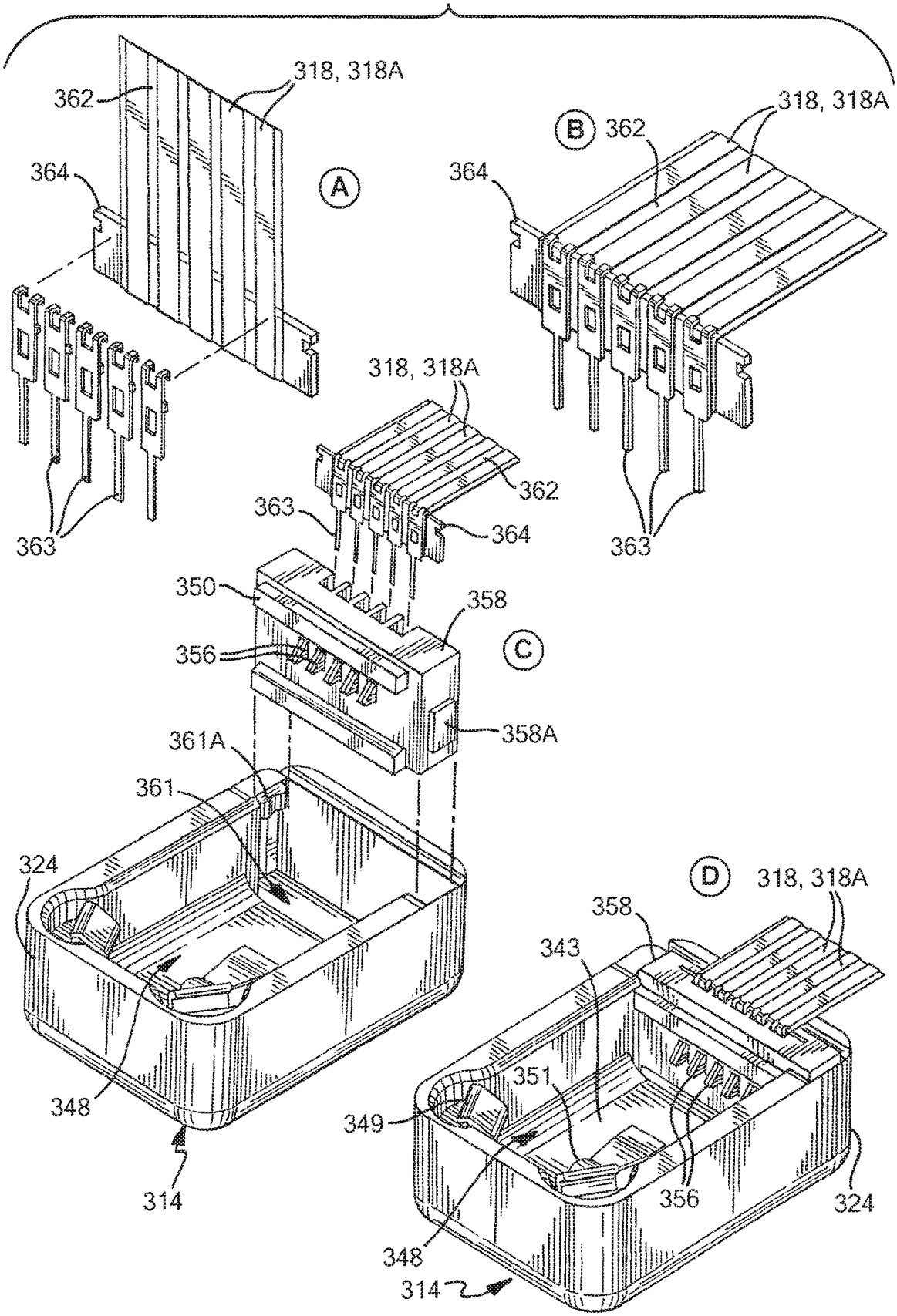
FIG. 18 is a schematic view illustrating the assembly of an interface of the port as shown in FIG. 11.

In this embodiment, the base 358 holds the contact springs 356 within an internal cavity or cavities 360 so that the contact springs 356 are at least partially exposed to the chamber 348 for engagement by the module 322. The base 358 is engaged with the housing 324 to properly position the contact springs 356. As shown in FIGS. 12, 13, and 18, the base 358 is received in a slot 361 in the housing 324 at the end of the housing 324 opposite the retaining tabs 349. The slot 361 extends within the bottom wall 343 and the side walls 339 to securely hold the bottom and edges of the base 358. Additionally, the base 358 includes retaining tabs 358A that are adapted to engage retaining tabs 361A positioned on the sides of the slot 361 to lock the base 358 in the slot 361. The base 358 also provides the retaining lip 350 for retaining the module 322 in the chamber 348, in this embodiment. In other embodiments, the interface 320 may include a different type of base 358, or the base 358 may be absent.

The contact springs 356 are each connected to one of the sensor leads 318, 318A of the sensor system 312, in order to form an electrical connection for communication between the sensors 316 and the module 322. As shown in FIG. 8, the sensor leads 318, 318A are bound together near the interface 320 with a band or strip 362 of Mylar or other material and are connected to electrical connectors 363 adapted for connection with the contact springs 356 of the interface 320. The connectors 363 are crimped around the ends of the sensor leads 318, 318A to form an electrical connection, with a plate 364 being provided for support of the connection. The ends of the connectors 363 can then be engaged with the contact springs 356 by inserting the ends of the connectors 363 into receivers 356A in the contact springs 356, as shown in FIG. 20. The base 358 includes slots 363A, 364A for receiving the plate 364 and the connectors 363 to form this connection. In other embodiments, the sensor leads 318, 318A may be connected to the interface 320 in another manner, such as in the configurations described below with respect to other embodiments.

Figure 24:
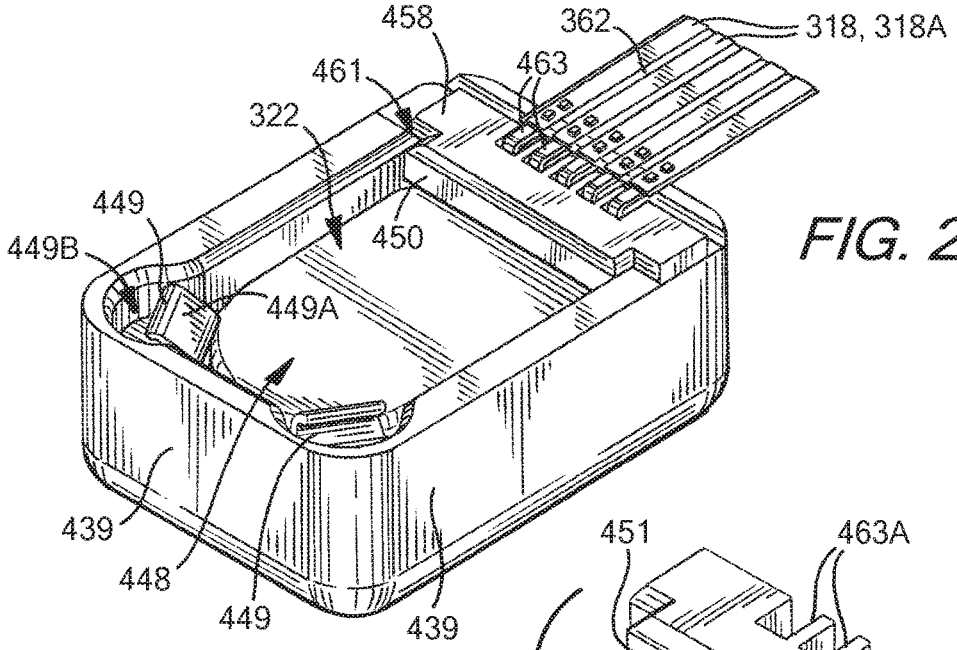
FIG. 24 is a perspective view of another embodiment of a port for a sensor system according to aspects of the present invention, having an electronic module as shown in FIG. 14 received in a housing of the port.
Figure 26:
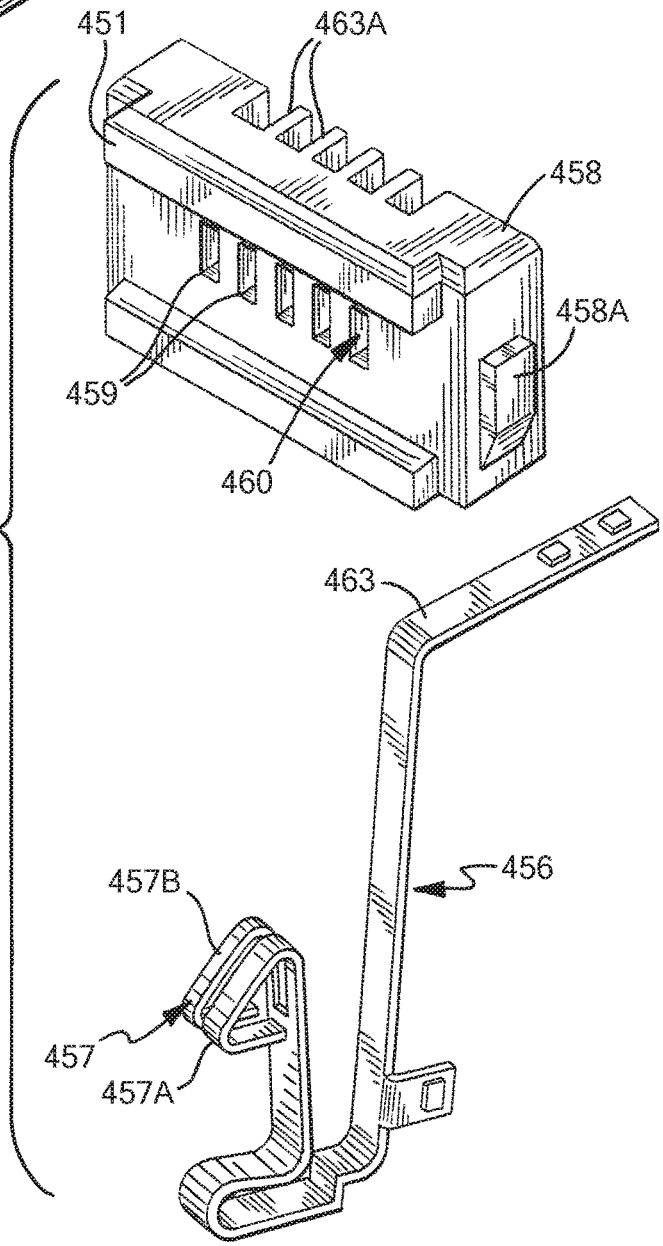
FIG. 26 is a perspective view of a base and an electrical contact of the interface of FIG. 25.
Figure 25:
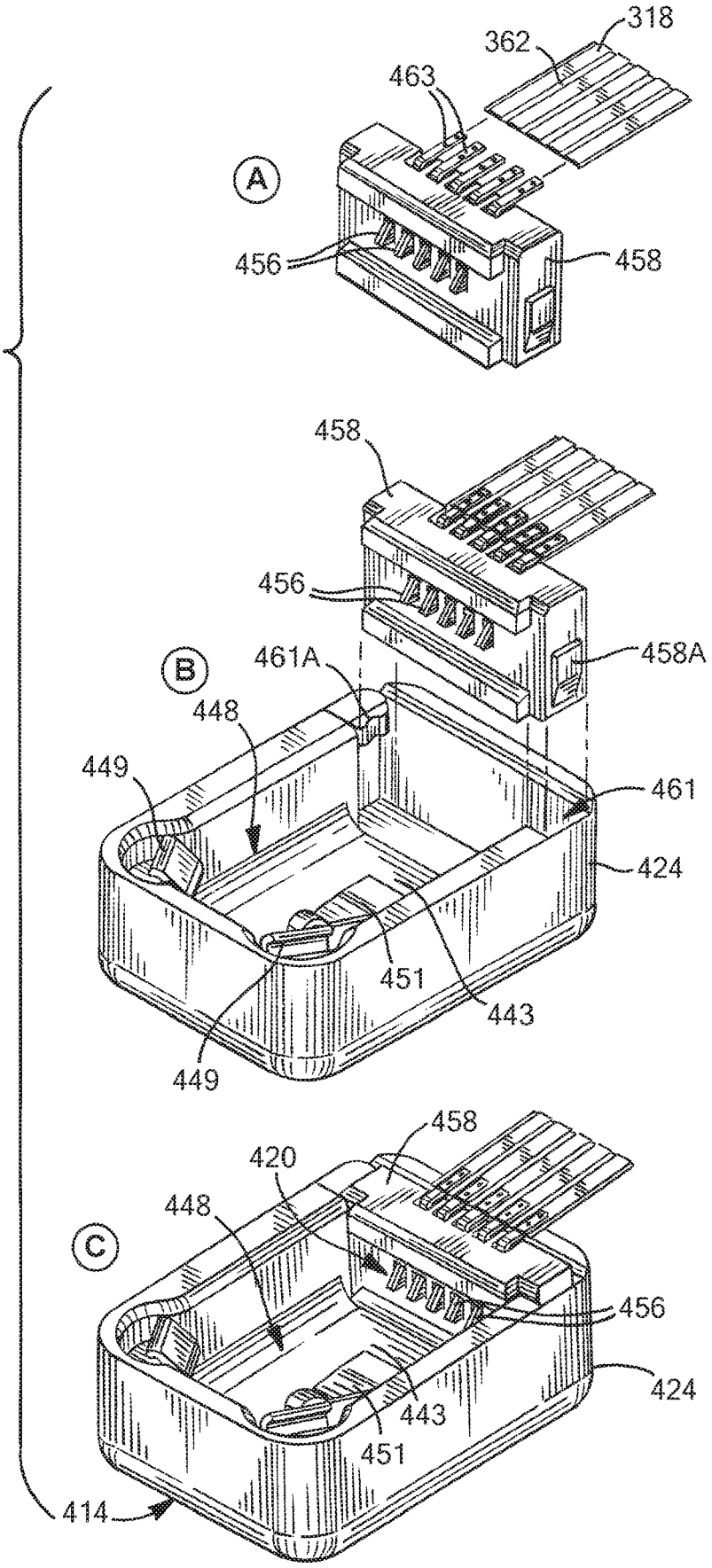
FIG. 25 is a schematic view illustrating the assembly of an interface of the port of FIG. 24.

Another embodiment of a port 414 is shown in FIGS. 24-26. Many features of this embodiment are similar or comparable to features of the port 314 described above and shown in FIGS. 11-23, and such features are referred to using similar reference numerals under the "4xx" series of reference numerals, rather than "3xx" as used in the embodiment of FIGS. 11-23. Accordingly, certain features of the port 414 that were already described above with respect to the port 314 of FIGS. 11-23 may be described in lesser detail, or may not be described at all. Additionally, the port 414 may be used in connection with any sensor systems 12, 212, 312 described above. Further, the port 414 is configured for use with the same module 322 described above and shown in FIGS. 12-17 and 19.

In the embodiment illustrated in FIGS. 24-26, the port 414 includes a housing 424 that is adapted to be received in the well 135 of the sole structure 130 and an interface 420 engaged with the housing 424. The housing 424 has a chamber 448 that is defined by a plurality of side walls 439 and a bottom wall 443 and is adapted to receive the module 322 therein. In this embodiment, the chamber 448 is substantially rectangular and defined by four side walls 439, similarly to the port 314 described above.

The housing 424 also includes retaining structure that includes retaining members 449, 450 adapted to engage the module 322 and exert a downward retaining force on the module 322 and a biasing member 451 adapted to engage the module 322 and exert an upward biasing force on the module 322. The retaining members 449, 450 include one or more flexible retaining tabs 449 and a rigid retaining member 450 in the form of a lip, which are configured and function similarly to the retaining members 349, 350 described above. Notches 449B are provided behind the retaining tabs 449 to provide room for the retaining tabs 449 to flex. The biasing member 451 is a flexible biasing tab that is connected to the bottom wall 443 of the housing 424, and is configured and functions similarly to the biasing member 351 described above.

The interface 420 is engaged with the housing 424 and is adapted for electrical connection to the module interface 323 when the module 322 is received in the chamber 448. The interface 420 contains one or more electrical contacts 456 having contact surfaces 457 that are exposed to the chamber 448 and are adapted to form an electrical connection by engaging the contact surface(s) 354 of the electrical contact(s) 353 of the module interface 323. In the embodiment illustrated in FIGS. 24-26, the contacts 456 of the interface 420 are in the form of contact springs 456 received in a base or support frame 458 to hold the contact springs 456 in place. As shown in FIG. 25, the contact surfaces 457 of the contact springs 456 extend outwardly of the base 458 through windows 459 facing the chamber 448, to engage the contacts 353 of the module 322, and have the ability to flex inwardly when engaged by the module 422. The contact spring 456 have similar split contact surfaces 457 as the contact springs 356 described above, and function similarly to the contact springs 356 described above. In this embodiment, the contact springs 456 have a different connecting structure for connection to the sensor leads 318, 318A of the sensor system 312. The contact springs 456 in this embodiment have connecting portions 463 that are integral with the contact springs 456, forming a single piece, as shown in FIG. 26.

In this embodiment, the base 458 holds the contact springs 456 within an internal cavity or cavities 460 so that the contact springs 456 are at least partially exposed to the chamber 448 for engagement by the module 322. The base 458 is engaged with the housing 424 to properly position the contact springs 456. As shown in FIG. 25, the base 458 is received in a slot 461 in the housing 424, similarly to the port 314 of FIGS. 11-23. Additionally, the base 458 includes retaining tabs 458A that are adapted to engage retaining tabs 461A positioned on the sides of the slot 461 to lock the base 458 in the slot 461, as also described above. The base 458 further provides the retaining lip 450 for retaining the module 322 in the chamber 448.

The contact springs 456 are each connected to one of the sensor leads 318, 318A of the sensor system 312, in order to form an electrical connection for communication between the sensors 316 and the module 322. As shown in FIG. 25, the sensor leads 318, 318A are bound together near the interface 320 with a band 362 of Mylar or other material and are connected to connecting portions 463 of the contact springs 456 by crimping around the ends of the sensor leads 318, 318A. The base 458 includes slots 463A for allowing the connecting portions 463 to form this connection.

Figure 27:
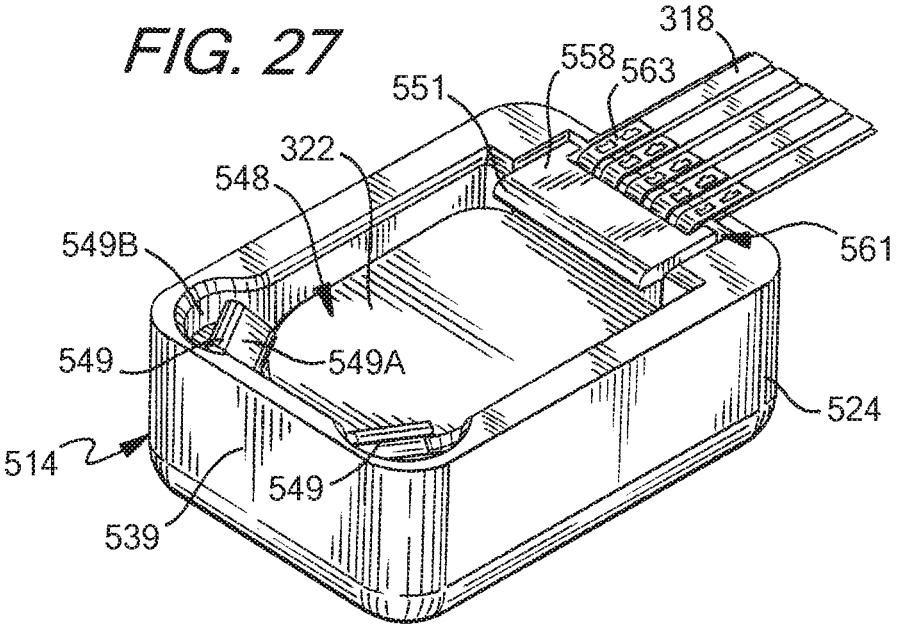
FIG. 27 is a perspective view of another embodiment of a port for a sensor system according to aspects of the present invention, having an electronic module as shown in FIG. 14 received in a housing of the port.
Figure 29:
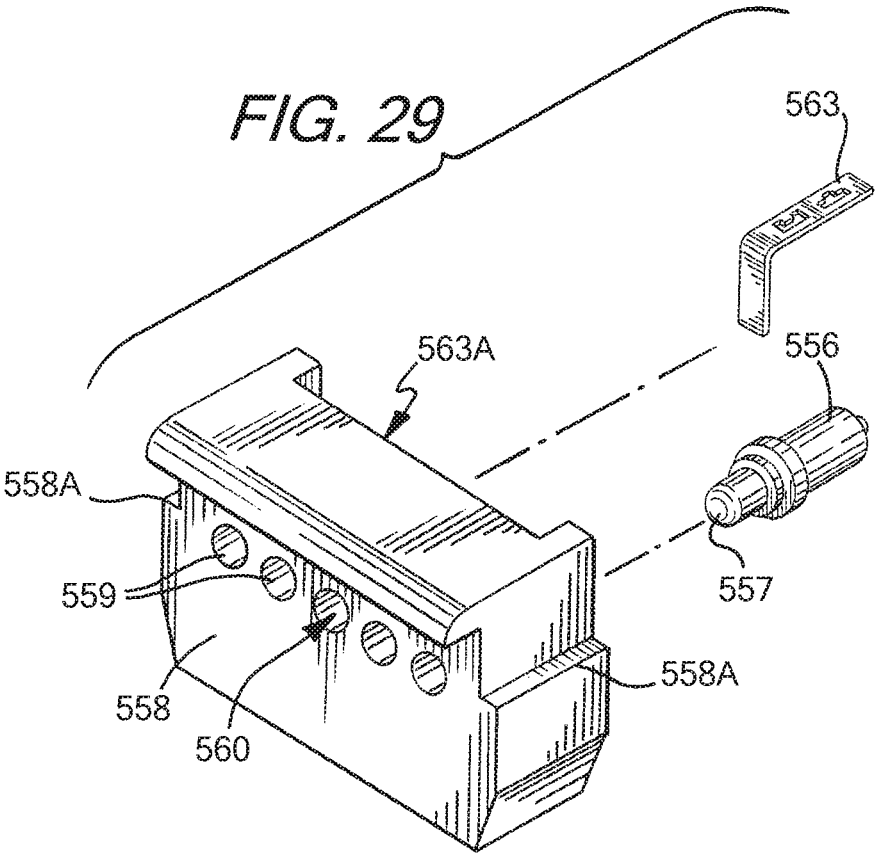
FIG. 29 is a perspective view of a base and an electrical contact of the interface of FIG. 25.
Figure 28:
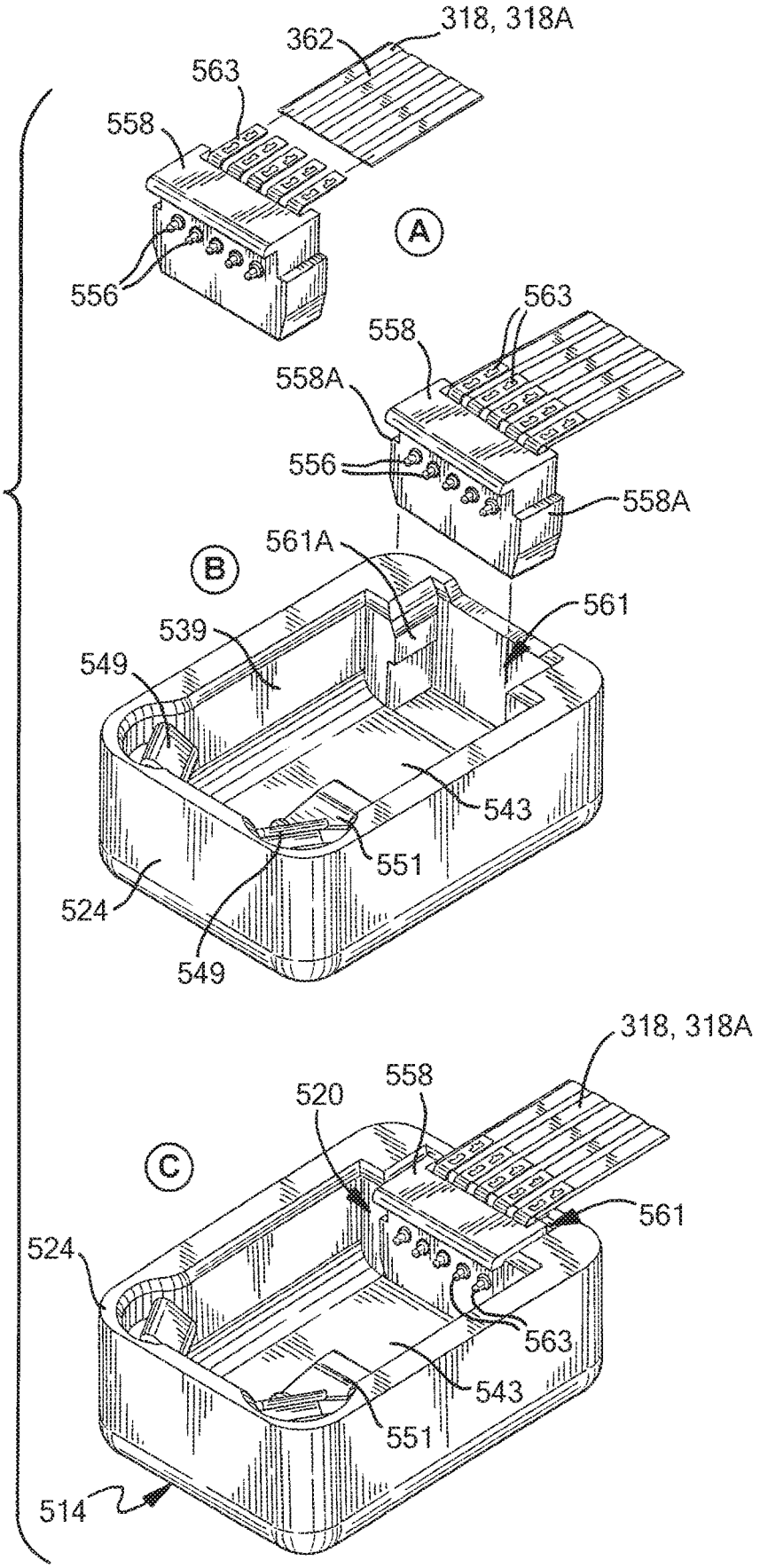
FIG. 28 is a schematic view illustrating the assembly of an interface of the port of FIG. 24.

Another embodiment of a port 514 is shown in FIGS. 27-29. Many features of this embodiment are similar or comparable to features of the port 314 described above and shown in FIGS. 11-23, and such features are referred to using similar reference numerals under the "5xx" series of reference numerals, rather than "3xx" as used in the embodiment of FIGS. 11-23. Accordingly, certain features of the port 514 that were already described above with respect to the port 314 of FIGS. 11-23 may be described in lesser detail, or may not be described at all. Additionally, the port 514 may be used in connection with any sensor systems 12, 212, 312 described above. Further, the port 514 is configured for use with the same module 322 described above and shown in FIGS. 12-17 and 19.

In the embodiment illustrated in FIGS. 27-29, the port 514 includes a housing 524 that is adapted to be received in the well 135 of the sole structure 130 and an interface 520 engaged with the housing 524. The housing 524 has a chamber 548 that is defined by a plurality of side walls 539 and a bottom wall 543 and is adapted to receive the module 522 therein. In this embodiment, the chamber 548 is substantially rectangular and defined by four side walls 539, similarly to the port 314 described above.

The housing 524 also includes retaining structure that includes retaining members 549, 550 adapted to engage the module 322 and exert a downward retaining force on the module 322 and a biasing member 551 adapted to engage the module 322 and exert an upward biasing force on the module 322. The retaining members 549, 550 include one or more flexible retaining tabs 549 and a rigid retaining member 550 in the form of a lip, which are configured and function similarly to the retaining members 349, 350 described above. Notches 549B are provided behind the retaining tabs 549 to provide room for the retaining tabs 549 to flex. The biasing member 551 is a flexible biasing tab that is connected to the bottom wall 543 of the housing 524, and is configured and functions similarly to the biasing member 351 described above.

The interface 520 is engaged with the housing 524 and is adapted for electrical connection to the module interface 323 when the module 322 is received in the chamber 548. The interface 520 contains one or more electrical contacts 556 having contact surfaces 557 that are exposed to the chamber 548 and are adapted to form an electrical connection by engaging the contact surface(s) 354 of the electrical contact(s) 353 of the module interface 323. In the embodiment illustrated in FIGS. 27-29, the contacts 556 of the interface 520 are in the form of contact pins 456 received in apertures 559 in a base or support frame 558 to hold the contact pins 556 in place. As shown in FIG. 29, the contact surfaces 557 of the contact pins 556 extend outwardly of the base 558 through the apertures 559 facing the chamber 548, to engage the contacts 353 of the module 322, and have the ability to slide inwardly when engaged by the module 522. In this embodiment, the contact pins 556 engage connectors 563 that are connected to the ends of the sensor leads 318, 318A, as described below. The connectors 563 form an electrical connection between the contact pins 556 and the sensor leads 318, 318A.

In this embodiment, the base 558 holds the contact pins 556 within an internal cavity or cavities 560 so that the contact pins 556 are at least partially exposed to the chamber 548 for engagement by the module 322. The base 558 is engaged with the housing 524 to properly position the contact pins 556. As shown in FIG. 28, the base 558 is received in a slot 561 in the housing 524, similarly to the port 314 of FIGS. 11-23. Additionally, the base 558 includes retaining tabs 558A that are adapted to engage retaining tabs 561A positioned on the sides of the slot 561 to lock the base 558 in the slot 561, as also described above. The base 558 further provides the retaining lip 550 for retaining the module 322 in the chamber 548. The retaining tabs 558A in this embodiment are slightly different structurally as compared to the retaining tabs 358A and the retaining lip 350 shown in FIGS. 11-23, but function in substantially the same manner.

The contact pins 556 are each connected to one of the sensor leads 318, 318A of the sensor system 312, via the connectors 563, in order to form an electrical connection for communication between the sensors 316 and the module 322. As shown in FIG. 28, the sensor leads 318, 318A are bound together near the interface 320 with a band 362 of Mylar or other material and are connected to the connectors 563 by crimping around the ends of the sensor leads 318, 318A, similar to the connectors 363 described above and shown in FIG. 18. The connectors 563 then extend into the base 558 to engage the contact pins 556 to form the electrical connection. The base 558 includes slots 563A for allowing the connectors 563 to form this connection. It is understood that the connectors 563 may have sufficient resilience to flex a small amount when the contact pins 556 are pressed inwardly into the base 558, such as by contact with the module 322. Additionally, the connectors 563 may be joined to the contact pins 556 in some way, such as by welding, brazing, soldering, etc.

Additional embodiments of a port 614 and a module 622 adapted for connection to the port 614 are shown in FIGS. 30-35. Many features of this embodiment are similar or comparable to features of the port 314 and the module 322 described above and shown in FIGS. 11-23, and such features are referred to using similar reference numerals under the "6xx" series of reference numerals, rather than "3xx" as used in the embodiment of FIGS. 11-23. Accordingly, certain features of the port 614 and the module 622 that were already described above with respect to the port 314 of FIGS. 11-23 may be described in lesser detail, or may not be described at all. Additionally, the port 614 and the module 622 may be used in connection with any sensor systems 12, 212, 312 described above.

Figure 30:
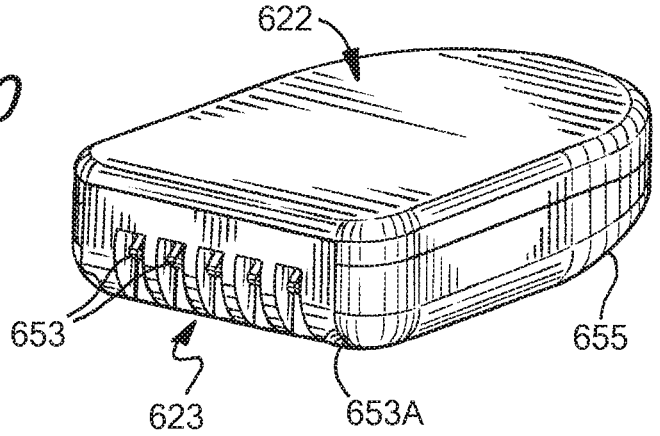
FIG. 30 is a perspective view of another embodiment of an electronic module according to aspects of the present invention.
Figure 31:
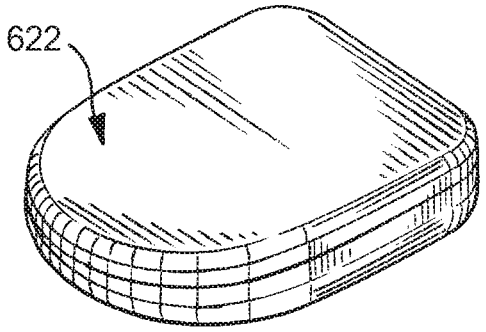
FIG. 31 is a rear perspective view of the module of FIG. 30.
Figure 32:
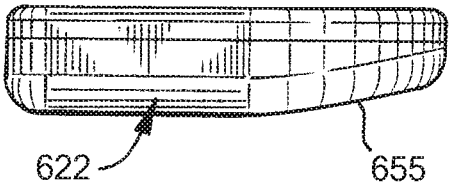
FIG. 32 is a side view of the module of FIG. 30.
Figure 33:
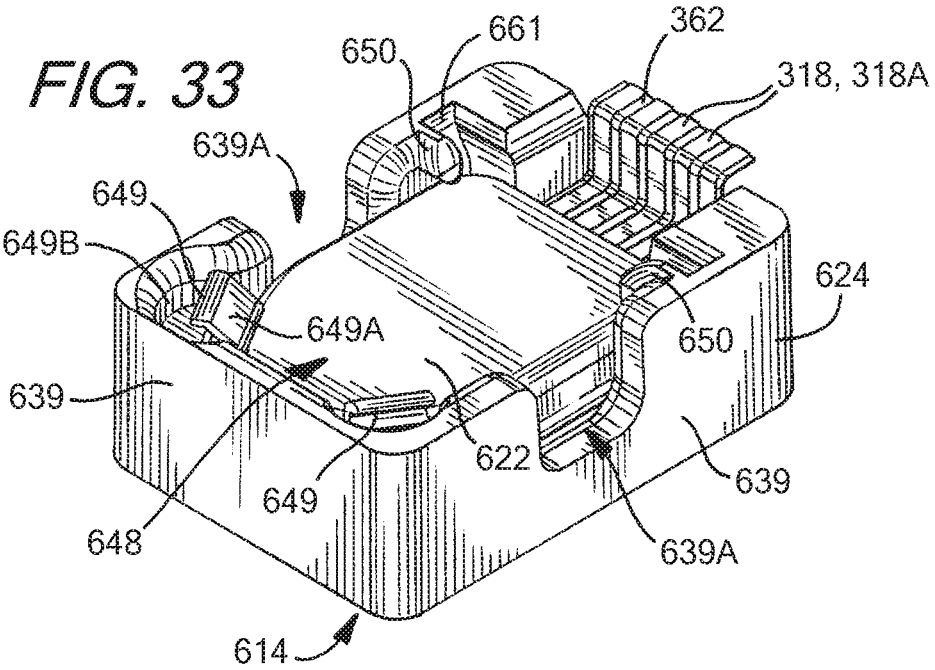
FIG. 33 is a perspective view of another embodiment of a port for a sensor system according to aspects of the present invention, having an electronic module as shown in FIG. 30 received in a housing of the port.

The module 622 illustrated in FIGS. 30-32 is shaped similarly to the module 322 described above, having a generally rectangular front end with a rounded rear end. Additionally, the module 622 has a tapered portion 655 on the bottom side thereof, as also similarly described above. The module 622 has an interface 623 at the front end thereof, having one or more electrical contacts 653 and being adapted for forming an electrical connection with the interface 620 of the port 614. The contacts 653 in this embodiment are in the form of electrical contact springs 653, each having a split contact surface 654, as similarly described above with respect to the contact springs 356 shown in FIGS. 20-21. The contact springs 653 are held in place by a mount 653A at the front of the module 622, and are able to flex inwardly when contacted by the electrical contacts 656 of the interface 620, as also described above with respect to the contact springs 356 in FIGS. 12-13 and 20-21. The module 622 may include any additional features described herein, such as in FIGS. 6 and 36, including any necessary hardware and software for collecting, processing, and/or transmitting data.

In the embodiment illustrated in FIGS. 30-35, the port 614 includes a housing 624 that is adapted to be received in the well 135 of the sole structure 130 and an interface 620 engaged with the housing 624. The housing 624 has a chamber 648 that is defined by a plurality of side walls 639 and a bottom wall 643 and is adapted to receive the module 622 therein. In this embodiment, the chamber 648 is substantially rectangular and defined by four side walls 639, similarly to the port 614 described above. The housing 624 illustrated in FIGS. 33-34 has notches 639A in the side walls 639, which permit easier gripping of the module 622 during removal of the module 622 from the chamber 648.

The housing 624 also includes retaining structure that includes retaining members 649, 650 adapted to engage the module 622 and exert a downward retaining force on the module 622 and a biasing member 651 adapted to engage the module 622 and exert an upward biasing force on the module 622. The retaining members 649, 650 include one or more flexible retaining tabs 649, which are configured and function similarly to the retaining tabs 349 described above, having notches 649B provided behind the retaining tabs 649 to provide room for flexing. The housing 624 also includes one or more rigid retaining tabs 650 extending from the side walls 639 of the housing 624 at the end opposite the flexible retaining tabs 649. The rigid tabs 650 may take the place of the retaining lip 350 described above, and function in substantially the same manner. The biasing member 651 is a flexible biasing tab that is connected to the bottom wall 643 of the housing 624, and is configured and functions similarly to the biasing member 351 described above.

Figure 34:
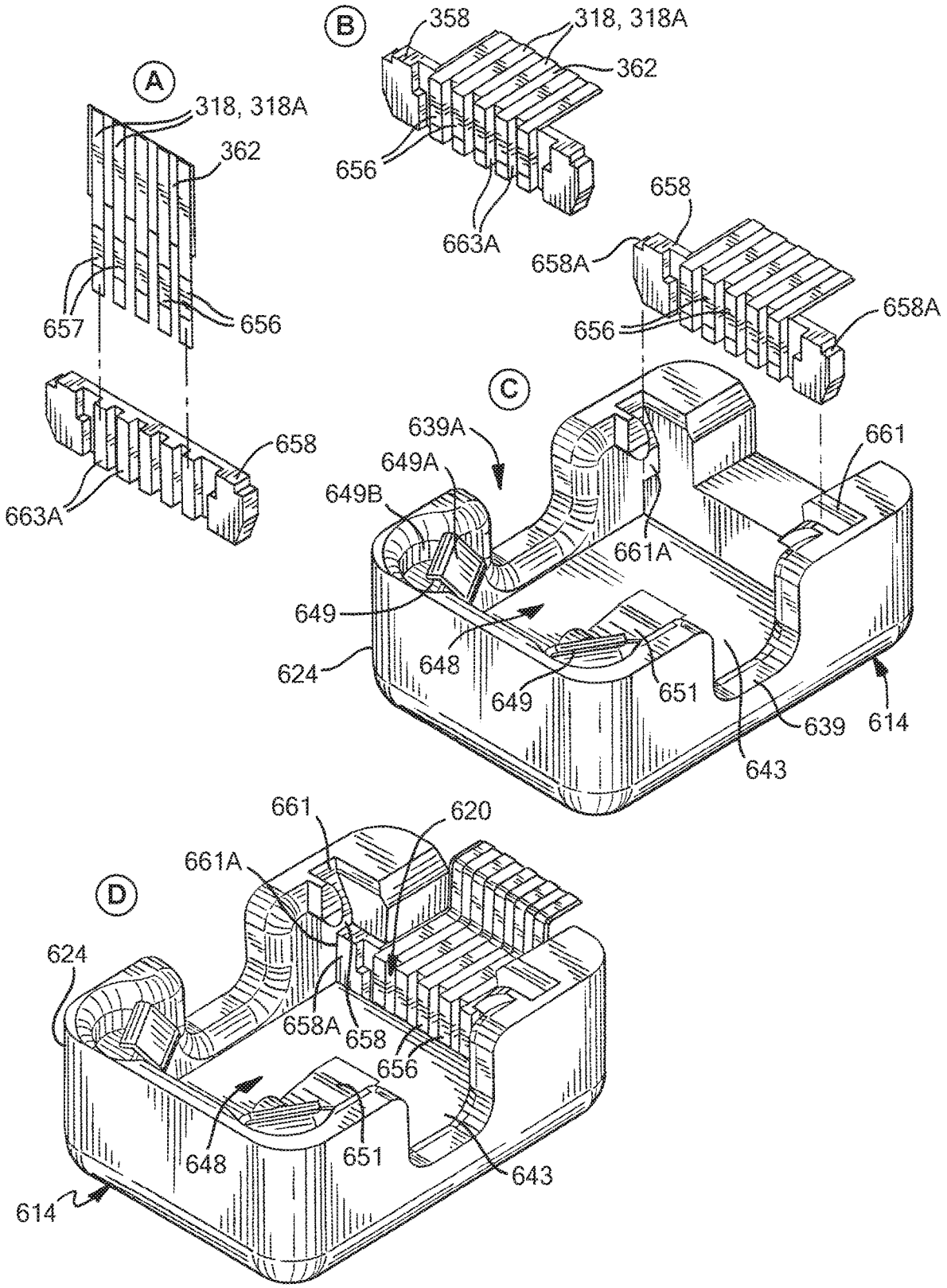
FIG. 34 is a schematic view illustrating the assembly of an interface of the port of FIG. 33.
Figure 35:
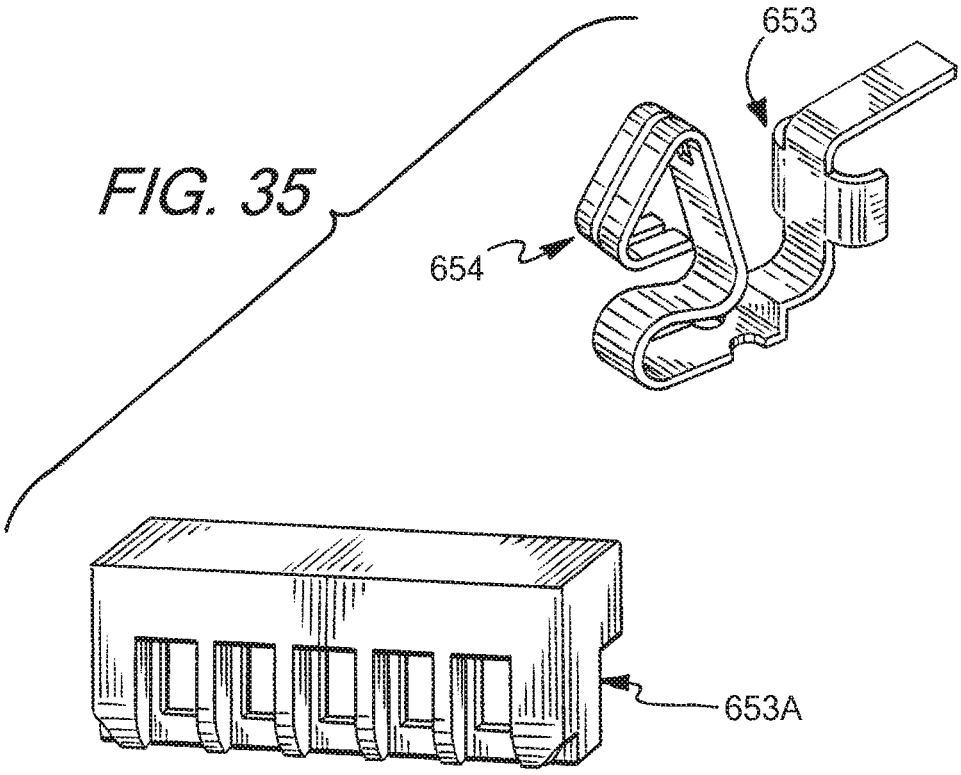
FIG. 35 is a perspective view of a portion of the module of FIG. 30 and an electrical contact configured for use with the module.

The interface 620 is engaged with the housing 624 and is adapted for electrical connection to the module interface 623 when the module 622 is received in the chamber 648. The interface 620 contains one or more electrical contacts 656 having contact surfaces 657 that are exposed to the chamber 648 and are adapted to form an electrical connection by engaging the contact surface(s) 654 of the electrical contact(s) 653 of the module interface 623. In the embodiment illustrated in FIGS. 30-35, the contacts 656 of the interface 620 are in the form of contact pads 656 having flat contact surface 657. A base or support frame 658 engages the housing 624 and the contact pads 656 to hold the contact pads 656 in place. As shown in FIG. 34, the contact surfaces 657 of the contact pads 656 are positioned at the end of the chamber 648, facing into the chamber 648, to engage the contacts 653 of the module 622.

In this embodiment, the base 658 is a plate-like member that holds the contact pads 656 so that the contact pads 656 are at least partially exposed to the chamber 648 for engagement by the module 622. The base 658 is received in a slot 661 in the housing 624, similarly to the port 314 of FIGS. 11-23. Additionally, the base 658 includes retaining tabs 658A that are adapted to engage retaining tabs 661A positioned on the sides of the slot 661 to lock the base 658 in the slot 661, as also described above. The contact pads 656 are each connected to one of the sensor leads 318, 318A of the sensor system 312, in order to form an electrical connection for communication between the sensors 316 and the module 322. As shown in FIG. 34, the sensor leads 318, 318A are bound together near the interface 320 with a band 362 of Mylar or other material and are connected to the contact pads 656 at the ends of the sensor leads 318, 318A. The contact pads 656 may be attached to the leads 318, 318A, or may be integral with the leads 318, 318A, such as by using exposed portions of the leads 318, 318A as the contact pads 656. The ends of the sensor leads 318, 318A are separate from each other, and each of the ends, with the contact pads 656, is attached to one of a plurality of ridges 663A on the base 658. This connection may be made using adhesives, welding, brazing, soldering, or other known methods. The ridges position the contact pads 656 farther into the chamber 648 for easier engagement by the module 622.

Additional embodiments of a port 714 and a module 722 adapted for connection to the port 714 are shown in FIGS. 40-49. Many features of this embodiment are similar or comparable to features of the port 314 and the module 322 described above and shown in FIGS. 11-23, and such features are referred to using similar reference numerals under the "7xx" series of reference numerals, rather than "3xx" as used in the embodiment of FIGS. 11-23. Accordingly, certain features of the port 714 and the module 722 that were already described above with respect to the port 714 of FIGS. 11-23 may be described in lesser detail, or may not be described at all. Additionally, the port 714 and the module 722 may be used in connection with any sensor systems 12, 212, 312 described above.

The module 722 illustrated in FIGS. 41-46 is shaped similarly to the module 322 described above, having a generally rectangular front end with a rounded rear end. Additionally, the module 722 has a tapered portion 755 on the bottom side thereof, as also similarly described above. The module 722 has an interface 723 at the front end thereof, having one or more electrical contacts 753 and being adapted for forming an electrical connection with the interface 720 of the port 714. The contacts 753 in this embodiment are in the form of electrical contact springs 753, which has a contact surface 754 that may be split, as similarly described above with respect to the contact springs 356 shown in FIGS. 20-21. The contact springs 753 are held in place by a mount 753A at the front of the module 722, and are able to flex inwardly when contacted by the electrical contacts 756 of the interface 720, as also described above with respect to the contact springs 356 in FIGS. 12-13 and 20-21. The module 722 may include any additional features described herein, such as in FIGS. 6 and 36, including any necessary hardware and software for collecting, processing, and/or transmitting data.

In the embodiment illustrated in FIGS. 40-49, the port 714 includes a housing 724 that is adapted to be received in the well 135 of the sole structure 130 and an interface 720 engaged with the housing 724. The housing 724 has a chamber 748 that is defined by a plurality of side walls 739 and a bottom wall 743 and is adapted to receive the module 722 therein. In this embodiment, the chamber 748 is substantially rectangular and defined by four side walls 739, similarly to the port 714 described above. The housing 724 also includes retaining structure that includes a ridge or O-ring 749 on three sides adapted to engage the module 722 and exert a retaining force on the module 722. The ridge 749 may be resilient, and may be made of a variety of different materials including rigid materials (e.g. hard plastics) and more flexible material (e.g. elastomers). The module 722 includes a recess 750 on three sides to form a snap connection with the ridge 749. It is understood that the ridge 749 and recess 750 may be differently configured in other embodiments, and that the relative positions of the ridge 749 and the recess 750 may be transposed in another embodiment. The ridge 749 and recess 750 may also provide water-tight sealing in one embodiment.

Figure 41:
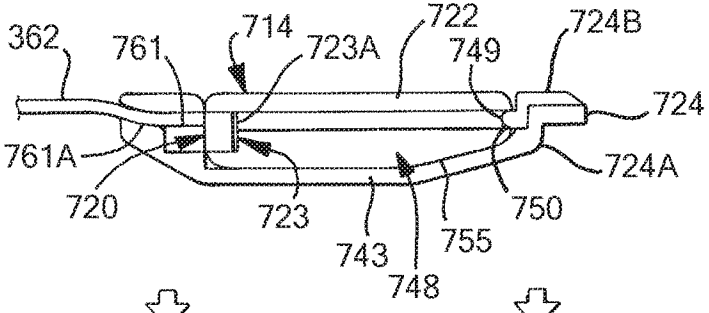
FIG. 41 is a cross-sectional view of the port of FIG. 40, having another embodiment of an electronic module received therein.
Figure 42:
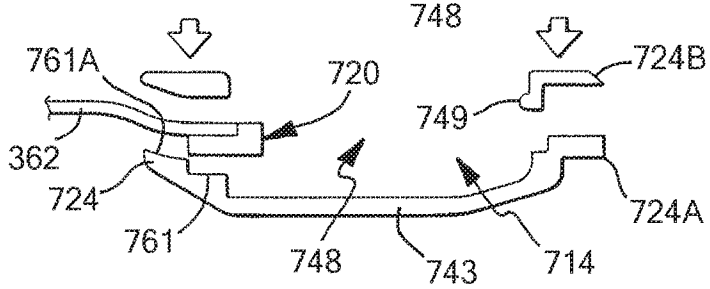
FIG. 42 is a cross-sectional exploded view of the port as shown in FIG. 41.
Figure 44:
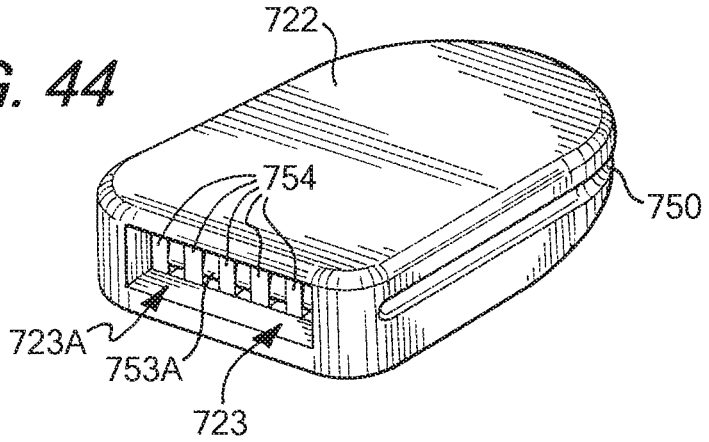
FIG. 44 is a perspective view of the module of FIG. 41.
Figure 45:
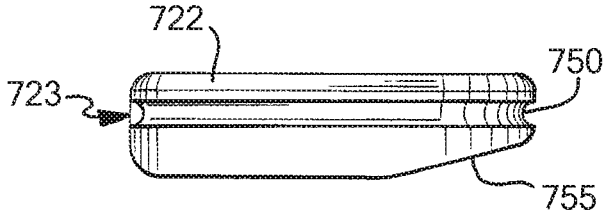
FIG. 45 is a side view of the module of FIG. 44.
Figure 46:
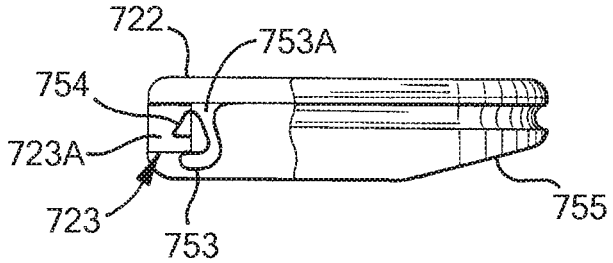
FIG. 46 is a schematic cross-sectional view of the module of FIG. 44.

The interface 720 is engaged with the housing 724 and is adapted for electrical connection to the module interface 723 when the module 722 is received in the chamber 748. The interface 720 contains one or more electrical contacts 756 having contact surfaces 757 that are exposed to the chamber 748 and are adapted to form an electrical connection by engaging the contact surface(s) 754 of the electrical contact(s) 753 of the module interface 723. In the embodiment illustrated in FIGS. 40-49, the contacts 756 of the interface 720 are in the form of L-shaped contact pads 756 having flat contact surface 757 and an arm 757A extending rearward from the contact surface 757 at approximately a 90° angle. In another embodiment, this angle may be different. A base or support frame 758 engages the housing 724 and supports the contact pads 756 to hold the contacts 756 in place within the housing 724. As shown in FIG. 42, the contact surfaces 757 of the contacts 756 are positioned at the end of the chamber 748, facing into the chamber 748, to engage the contacts 753 of the module 722.

Figure 47:
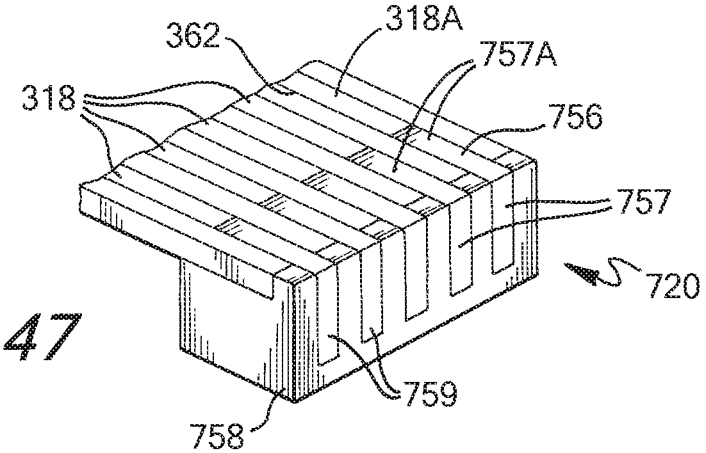
FIG. 47 is a perspective view of an interface of the port of FIG. 40.
Figure 48:
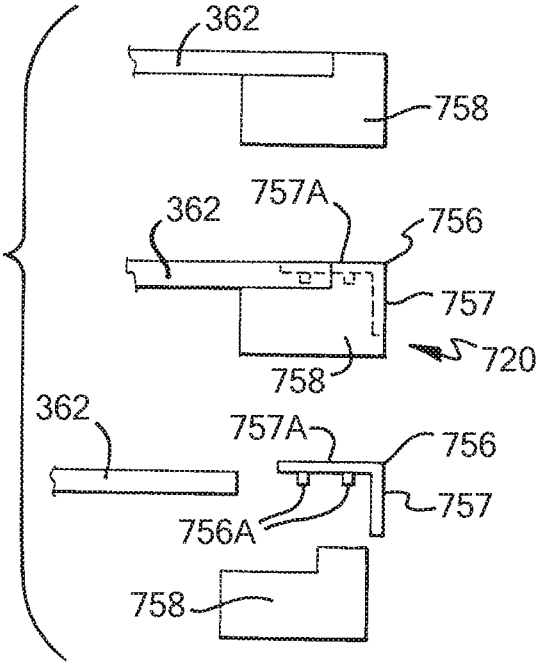
FIG. 48 is a schematic side view illustrating assembly of the interface of FIG. 47.
Figure 49:
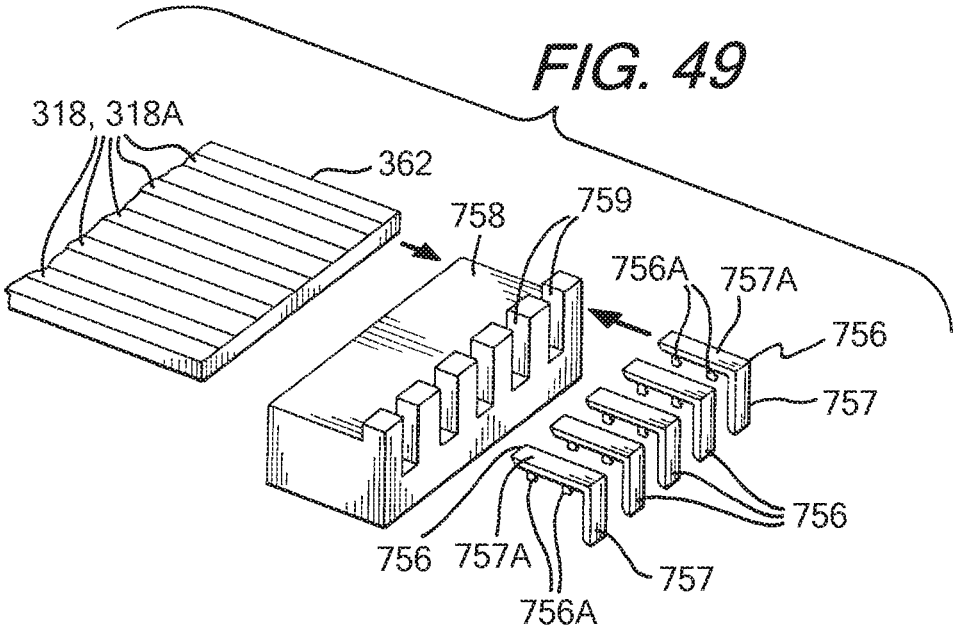
FIG. 49 is a perspective view illustrating assembly of the interface of FIG. 47.

In this embodiment, the base 758 is a block-like member that holds the contact pads 756 so that the contact pads 756 are at least partially exposed to the chamber 748 for engagement by the module 722. The base 758 is received in a slot 761 in the housing 724, similarly to the port 314 of FIGS. 11-23, and may be glued or otherwise held in place within the slot 761 using any technique or structure described herein. In another embodiment, the base 758 may include retaining tabs that are adapted to engage the slot 761 to lock the base 758 in the slot 761, as similarly described above. The contact pads 756 are each connected to one of the sensor leads 318, 318A of the sensor system 312, in order to form an electrical connection for communication between the sensors 316 and the module 322. As shown in FIGS. 47-49, the sensor leads 318, 318A are bound together near the interface 320 with a band 362 of Mylar or other material and are then placed in contact with the base 758. The band 362 may be glued to the base 758 in one embodiment. The contacts 756 are then connected at the ends of the sensor leads 318, 318A. In the embodiment of FIGS. 47-49, the contacts 756 are connected to the leads 318, 318A by crimping connections 756A on the arms 757A that puncture the band 362 to form the connection. The contact pads 756 may be attached to the leads 318, 318A in another configuration in other embodiments, including any configuration described herein. The contact surfaces 757 are received in windows 759 in the base 758 for exposure to the chamber 748. As shown in FIG. 41, the interface 720 projects into the chamber 748 in this embodiment, and the interface 723 of the module 722 includes a recess 723A that receives a portion of the port interface 720 in order to form the connection of the interfaces 720, 723.

The housing 724 is formed of multiple pieces in this embodiment, including a bottom piece 724A and a top piece 724B, as described in greater detail below. The bottom piece 724A includes a slot 761 for receiving the base 758, as described above. The slot 761 also includes a sloped portion 761A for guiding the band 362 to the chamber 748. The combination of the sloped portion 761A and the block-like base 758 result in less bending of the band 362 during and after connection. The band 362 may additionally or alternately be glued within the sloped portion 761A in one embodiment. As shown in FIG. 42, the assembled interface 720 can be inserted into the slot 761 in one embodiment and connected in place, and the top piece 724B can then be connected on top of the bottom piece 724A. The bottom piece 724A includes a recess 748A around the chamber 748 to receive a portion of the top member 724B. The top and bottom members 724A,B may be connected together using one or more of a variety of connection techniques, including adhesives, ultrasonic welding, fasteners, snap connections, or other techniques, including any techniques described herein. In the embodiment of FIGS. 40-49, the top piece 724B includes the ridge 749 or other retaining structure, but in another embodiment, the bottom piece 724A may include the ridge 749 and/or additional or alternate retaining structure. In one embodiment, the top piece 724A may be formed at least partially of a relatively flexible material, in order to secure the band 362 in place while also forming a water- and dust-resistant cover to the interface connections.

The operation and use of the sensor systems 12, 212, including the ports 14, et seq. shown and described herein, are described below with respect to the sensor system 12 shown in FIGS. 3-5, and it is understood that the principles of operation of the sensor system 12, including all embodiments and variations thereof, are applicable to the other embodiments of the sensor systems 212, et seq. and ports 214, et seq. described above. In operation, the sensors 16 gather data according to their function and design, and transmit the data to the port 14. The port 14 then allows the electronic module 22 to interface with the sensors 16 and collect the data for later use and/or processing. In one embodiment, the data is collected, stored, and transmitted in a universally readable format, so the data is able to be accessed and/or downloaded by a plurality of users, with a variety of different applications, for use in a variety of different purposes. In one example, the data is collected, stored, and transmitted in XML format. Additionally, in one embodiment, data may be collected from the sensors 16 in a sequential manner, and in another embodiment, data may be collected from two or more sensors 16 simultaneously.

In different embodiments, the sensor system 12 may be configured to collect different types of data. In one embodiment (described above), the sensor(s) 16 can collect data regarding the number, sequence, and/or frequency of compressions. For example, the system 12 can record the number or frequency of steps, jumps, cuts, kicks, or other compressive forces incurred while wearing the footwear 100, as well as other parameters, such as contact time and flight time. Both quantitative sensors and binary on/off type sensors can gather this data. In another example, the system can record the sequence of compressive forces incurred by the footwear, which can be used for purposes such as determining foot pronation or supination, weight transfer, foot strike patterns, or other such applications. In another embodiment (also described above), the sensor(s) 16 are able to quantitatively measure the compressive forces on the adjacent portions of the shoe 100, and the data consequently can include quantitative compressive force and/or impact measurement. Relative differences in the forces on different portions of the shoe 100 can be utilized in determining weight distribution and "center of pressure" of the shoe 100. The weight distribution and/or center of pressure can be calculated independently for one or both shoes 100, or can be calculated over both shoes together, such as to find a center of pressure or center of weight distribution for a person's entire body. As described above, a relatively densely packed array of on/off binary sensors can be used to measure quantitative forces by changes detected in "puddling" activation of the sensors during moments of greater compression. In further embodiments, the sensor(s) 16 may be able to measure rates of changes in compressive force, contact time, flight time or time between impacts (such as for jumping or running), and/or other temporally-dependent parameters. It is understood that, in any embodiment, the sensors 16 may require a certain threshold force or impact before registering the force/impact.

As described above, the data is provided through the universal port 14 to the module 22 in a universally readable format, so that the number of applications, users, and programs that can use the data is nearly unlimited. Thus, the port 14 and module 22 are configured and/or programmed as desired by a user, and the port 14 and module 22 receive input data from the sensor system 12, which data can be used in any manner desired for different applications. In many applications, the data is further processed by the module 22 and/or the external device 110 prior to use. It is understood that one or more of the sensors 16, the port 14, the module 22, the external device 110 (including the device 110A), and/or any combination of such components may process at least a portion of the data in some embodiments, provided that such components include hardware and/or other structure with processing capability. In configurations where the external device 110 further processes the data, the module 22 may transmit the data to the external device 110. This transmitted data may be transmitted in the same universally-readable format, or may be transmitted in another format, and the module 22 may be configured to change the format of the data. Additionally, the module 22 can be configured and/or programmed to gather, utilize, and/or process data from the sensors 16 for one or more specific applications. In one embodiment, the module 22 is configured for gathering, utilizing, and/or processing data for use in a plurality of applications. Examples of such uses and applications are given below. As used herein, the term "application" refers generally to a particular use, and does not necessarily refer to use in a computer program application, as that term is used in the computer arts. Nevertheless, a particular application may be embodied wholly or partially in a computer program application.

Further, the module 22 can be removed from the footwear 100 and replaced with a second module 22 configured for operating differently than the first module 22. It is understood that the module 22 can be removed and replaced by another module 22 configured in a similar or identical manner, such as replacement due to battery drain, malfunction, etc. The original module 22 can be removed, such as in manners described above, and the second module 22 may be inserted in the same manner as the original module 22. The second module 22 may be programmed and/or configured differently than the first module 22. In one embodiment, the first module 22 may be configured for use in one or more specific applications, and the second module 22 may be configured for use in one or more different applications. For example, the first module 22 may be configured for use in one or more gaming applications and the second module 22 may be configured for use in one or more athletic performance monitoring applications. Additionally, the modules 22 may be configured for use in different applications of the same type. For example, the first module 22 may be configured for use in one game or athletic performance monitoring application, and the second module 22 may be configured for use in a different game or athletic performance monitoring application. As another example, the modules 22 may be configured for different uses within the same game or performance monitoring application. In another embodiment, the first module 22 may be configured to gather one type of data, and the second module 22 may be configured to gather a different type of data. Examples of such types of data are described herein, including quantitative force measurement, relative force measurement (i.e. sensors 16 relative to each other), weight shifting/transfer, impact sequences (such as for foot strike patterns) rate of force change, etc. In a further embodiment, the first module 22 may be configured to utilize or process data from the sensors 16 in a different manner than the second module 22. For example, the modules 22 may be configured to only gather, store, and/or communicate data, or the modules 22 may be configured to further process the data in some manner, such as organizing the data, changing the form of the data, performing calculations using the data, etc. In yet another embodiment, the modules 22 may be configured to communicate differently, such as having different communication interfaces or being configured to communicate with different external devices 110. The modules 22 may function differently in other aspects as well, including both structural and functional aspects, such as using different power sources or including additional or different hardware components, such as additional sensors as described above (e.g. GPS, accelerometer, etc.).

One use contemplated for the data collected by the system 12 is in measuring weight transfer, which is important for many athletic activities, such as a golf swing, a baseball/softball swing, a hockey swing (ice hockey or field hockey), a tennis swing, throwing/pitching a ball, etc. The pressure data collected by the system 12 can give valuable feedback regarding balance and stability for use in improving technique in any applicable athletic field. It is understood that more or less expensive and complex sensor systems 12 may be designed, based on the intended use of the data collected thereby.

The data collected by the system 12 can be used in measurement of a variety of other athletic performance characteristics. The data can be used to measure the degree and/or speed of foot pronation/supination, foot strike patterns, balance, and other such parameters, which can be used to improve technique in running/jogging or other athletic activities. With regard to pronation/supination, analysis of the data can also be used as a predictor of pronation/supination. Speed and distance monitoring can be performed, which may include pedometer-based measurements, such as contact measurement or loft time measurement. Jump height can also be measured, such as by using contact or loft time measurement. Lateral cutting force can be measured, including differential forces applied to different parts of the shoe 100 during cutting. The sensors 16 can also be positioned to measure shearing forces, such as a foot slipping laterally within the shoe 100. As one example, additional sensors may be incorporated into the sides of the upper 120 of the shoe 100 to sense forces against the sides. As another example, a high-density array of binary sensors could detect shearing action through lateral changes in "puddling" of the activated sensors.

In another embodiment (not shown) one or more sensors 16 can additionally or alternately be incorporated into the upper 120 of the shoe 100. In this configuration, additional parameters can be measured, such as kick force, such as for soccer or football, as well as number and/or frequency of "touches" in soccer.

The data, or the measurements derived therefrom, may be useful for athletic training purposes, including improving speed, power, quickness, consistency, technique, etc. The port 14, module 22, and/or external device 110 can be configured to give the user active, real-time feedback. In one example, the port 14 and/or module 22 can be placed in communication with a computer, mobile device, etc., in order to convey results in real time. In another example, one or more vibration elements may be included in the shoe 100, which can give a user feedback by vibrating a portion of the shoe to help control motion, such as the features disclosed in U.S. Pat. No. 6,978,684, which is incorporated herein by reference and made part hereof. Additionally, the data can be used to compare athletic movements, such as comparing a movement with a user's past movements to show consistency, improvement, or the lack thereof, or comparing a user's movement with the same movement of another, such as a professional golfer's swing. Further, the system 12 may be used to record biomechanical data for a "signature" athletic movement of an athlete. This data could be provided to others for use in duplicating or simulating the movement, such as for use in gaming applications or in a shadow application that overlays a movement over a user's similar movement.

The system 12 can also be configured for "all day activity" tracking, to record the various activities a user engages in over the course of a day. The system 12 may include a special algorithm for this purpose, such as in the module 22, the external device 110, and/or the sensors 16.

The system 12 may also be used for control applications, rather than data collection and processing applications. In other words, the system 12 could be incorporated into footwear, or another article that encounters bodily contact, for use in controlling an external device 110, such as a computer, television, video game, etc., based on movements by the user detected by the sensors 16. In effect, the footwear with the incorporated sensors 16 and leads 18 extending to a universal port 14 allows the footwear to act as an input system, and the electronic module 22 can be configured, programmed, and adapted to accept the input from the sensors 16 and use this input data in any desired manner, e.g., as a control input for a remote system. For example, a shoe with sensor controls could be used as a control or input device for a computer, or for a program being executed by the computer, similarly to a mouse, where certain foot movements, gestures, etc. (e.g., a foot tap, double foot tap, heel tap, double heel tap, side-to-side foot movement, foot-point, foot-flex, etc.) can control a pre-designated operation on a computer (e.g., page down, page up, undo, copy, cut, paste, save, close, etc.). Software can be provided to assign foot gestures to different computer function controls for this purpose. It is contemplated that an operating system could be configured to receive and recognize control input from the sensor system 12. Televisions or other external electronic devices can be controlled in this manner. Footwear 100 incorporating the system 12 can also be used in gaming applications and game programs, similarly to the Nintendo Wii controller, where specific movements can be assigned certain functions and/or can be used to produce a virtual representation of the user's motion on a display screen. As one example, center of pressure data and other weight distribution data can be used in gaming applications, which may involve virtual representations of balancing, weight shifting, and other performance activities. The system 12 can be used as an exclusive controller for a game or other computer system, or as a complementary controller. Examples of configurations and methods of using sensor systems for articles of footwear as controls for external devices and foot gestures for such controls are shown and described in U.S. Provisional Application No. 61/138,048, which is incorporated by reference herein in its entirety.

Additionally, the system 12 may be configured to communicate directly with the external device 110 and/or with a controller for the external device. As described above, FIG. 6 illustrates one embodiment for communication between the electronic module 22 and the external device. In another embodiment, shown in FIG. 36, the system 12 can be configured for communication with an external gaming device 110A. The external gaming device 110A contains similar components to the exemplary external device 110 shown in FIG. 6. The external gaming device 110A also includes at least one game media 307 containing a game program (e.g. a cartridge, CD, DVD, Blu-Ray, or other storage device), and at least one remote controller 305 configured to communicate by wired and/or wireless connection through the transmitting/receiving element 108. In the embodiment shown, the controller 305 complements the user input 310, however in one embodiment, the controller 305 may function as the sole user input. In this embodiment, the system 12 is provided with an accessory device 303, such as a wireless transmitter/receiver with a USB plug-in, that is configured to be connected to the external device 110 and/or the controller 305 to enable communication with the module 22. In one embodiment, the accessory device 303 may be configured to be connected to one or more additional controllers and/or external devices, of the same and/or different type than the controller 305 and the external device 110. It is understood that if the system 12 includes other types of sensors described above (e.g., an accelerometer), such additional sensors can also be incorporated into controlling a game or other program on an external device 110.

An external device 110, such as a computer/gaming system, can be provided with other types of software to interact with the system 12. For example, a gaming program may be configured to alter the attributes of an in-game character based on a user's real-life activities, which can encourage exercise or greater activity by the user. In another example, a program may be configured to display an avatar of the user that acts in relation or proportion to the user activity collected by the sensing system of the shoe. In such a configuration, the avatar may appear excited, energetic, etc., if the user has been active, and the avatar may appear sleepy, lazy, etc., if the user has been inactive. The sensor system 12 could also be configured for more elaborate sensing to record data describing a "signature move" of an athlete, which could then be utilized for various purposes, such as in a gaming system or modeling system.

Figure 37:
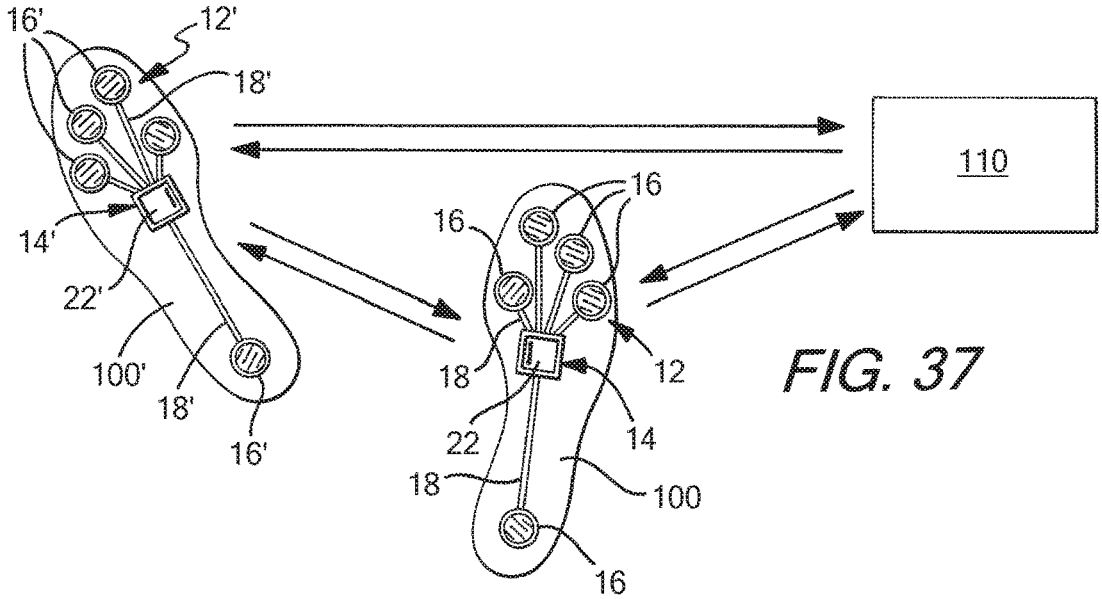
FIG. 37 is a schematic diagram of a pair of shoes, each containing a sensor system, in a mesh communication mode with an external device.
Figure 38:
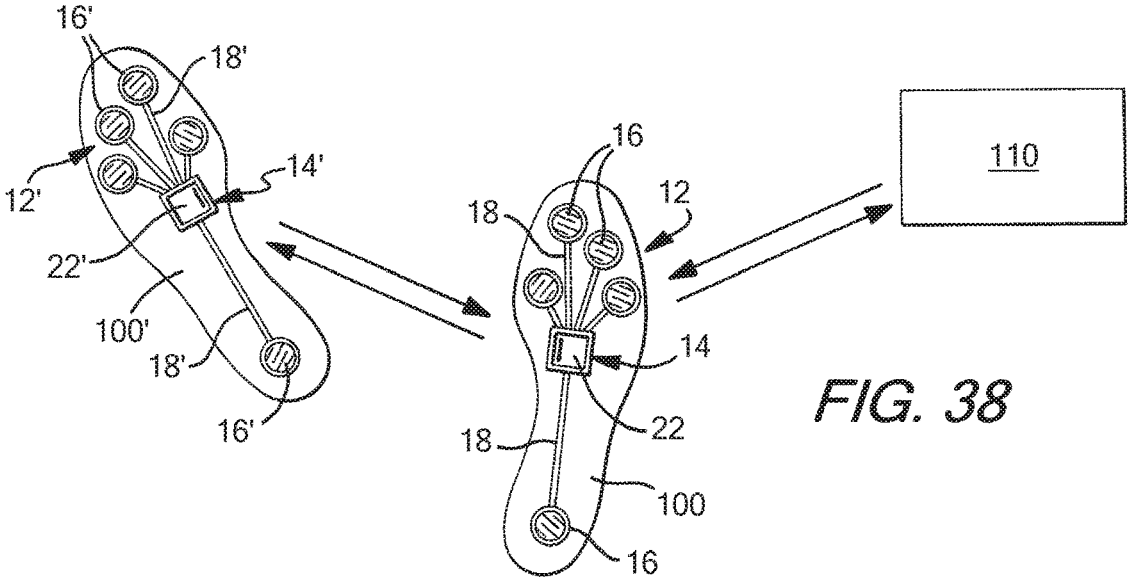
FIG. 38 is a schematic diagram of a pair of shoes, each containing a sensor system, in a "daisy chain" communication mode with an external device.
Figure 39:
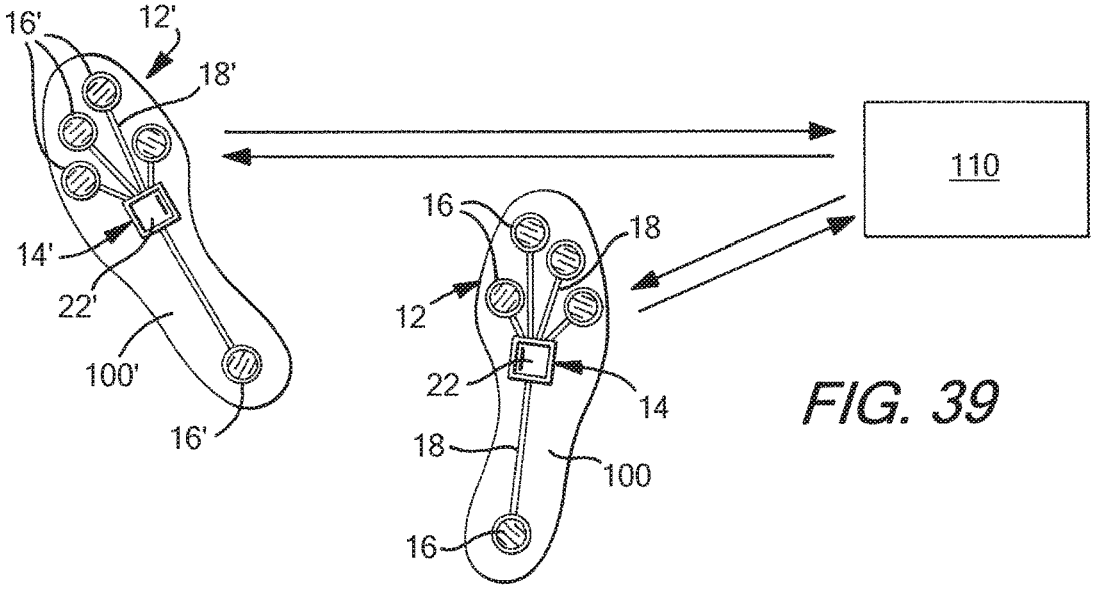
FIG. 39 is a schematic diagram of a pair of shoes, each containing a sensor system, in an independent communication mode with an external device.
Figure 43:
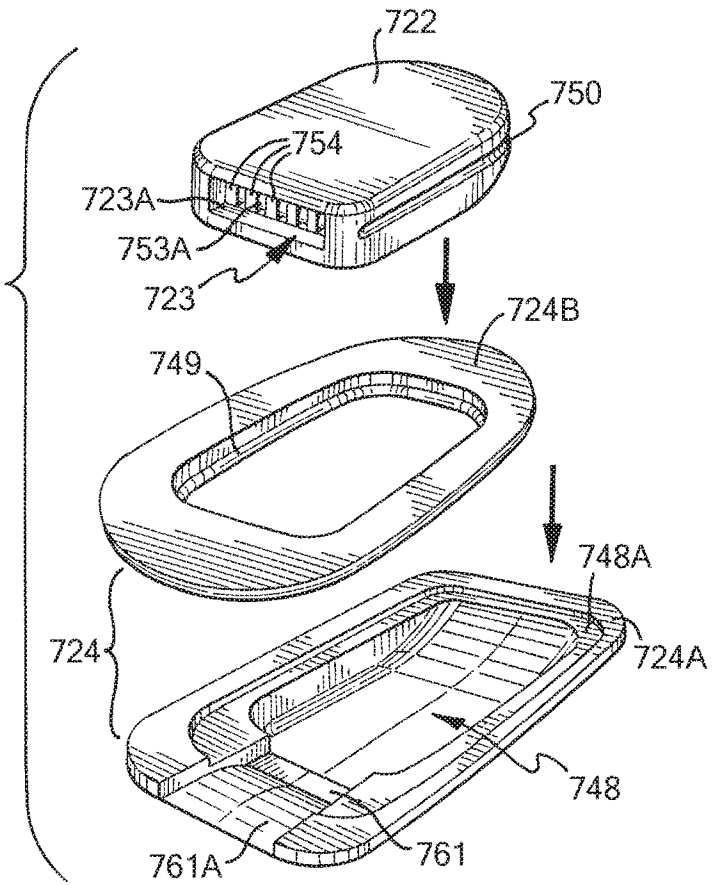
FIG. 43 is an exploded view of the port of FIG. 40.
Figure 40:
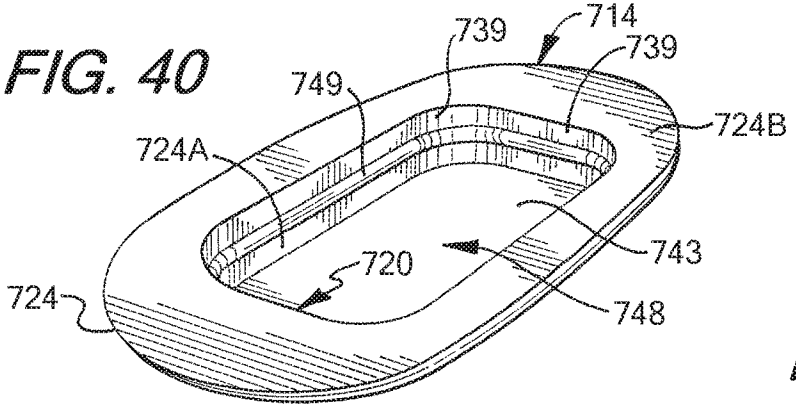
FIG. 40 is a perspective view of another embodiment of a port for a sensor system according to aspects of the present invention.

A single article of footwear 100 containing the sensor system 12 as described herein can be used alone or in combination with a second article of footwear 100' having its own sensor system 12', such as a pair of shoes 100, 100' as illustrated in FIGS. 37-39. The sensor system 12' of the second shoe 100' generally contains one or more sensors 16' connected by sensor leads 18' to a port 14' in communication with an electronic module 22'. The second sensor system 12' of the second shoe 100' shown in FIGS. 37-39 has the same configuration as the sensor system 12 of the first shoe 100. However, in another embodiment, the shoes 100, 100' may have sensor systems 12, 12' having different configurations. The two shoes 100, 100' are both configured for communication with the external device 110, and in the embodiment illustrated, each of the shoes 100, 100' has an electronic module 22, 22' configured for communication with the external device 110. In another embodiment, both shoes 100, 100' may have ports 14, 14' configured for communication with the same electronic module 22. In this embodiment, at least one shoe 100, 100' may be configured for wireless communication with the module 22. FIGS. 37-39 illustrate various modes for communication between the modules 22, 22'

FIG. 37 illustrates a "mesh" communication mode, where the modules 22, 22' are configured for communicating with each other, and are also configured for independent communication with the external device 110. FIG. 38 illustrates a "daisy chain" communication mode, where one module 22' communicates with the external device 110 through the other module 22. In other words, the second module 22' is configured to communicate signals (which may include data) to the first module 22, and the first module 22 is configured to communicate signals from both modules 22, 22' to the external device 110. Likewise, the external device communicates with the second module 22' through the first module 22, by sending signals to the first module 22, which communicates the signals to the second module 22'. In one embodiment, the modules 22, 22' can also communicate with each other for purposes other than transmitting signals to and from the external device 110. FIG. 39 illustrates an "independent" communication mode, where each module 22, 22' is configured for independent communication with the external device 110, and the modules 22, 22' are not configured for communication with each other. In other embodiments, the sensor systems 12, 12' may be configured for communication with each other and/or with the external device 110 in another manner.

Still other uses and applications of the data collected by the system 12 are contemplated within the scope of the invention and are recognizable to those skilled in the art.

Sensor systems 12, 212 as described above can be customized for use with specific software for the electronic module 22 and/or the external device 110. Such software may be provided along with a sensor system 12, 212, such as in the form of a sole insert 237 having a customized sensor assembly 213, as a kit or package.

As will be appreciated by one of skill in the art upon reading the present disclosure, various aspects described herein may be embodied as a method, a data processing system, or a computer program product. Accordingly, those aspects may take the form of an entirely hardware embodiment, an entirely software embodiment or an embodiment combining software and hardware aspects. Furthermore, such aspects may take the form of a computer program product stored by one or more tangible computer-readable storage media or storage devices having computer-readable program code, or instructions, embodied in or on the storage media. Any suitable tangible computer readable storage media may be utilized, including hard disks, CD-ROMs, optical storage devices, magnetic storage devices, and/or any combination thereof. In addition, various intangible signals representing data or events as described herein may be transferred between a source and a destination in the form of electromagnetic waves traveling through signal-conducting media such as metal wires, optical fibers, and/or wireless transmission media (e.g., air and/or space).

As described above, aspects of the present invention may be described in the general context of computer-executable instructions, such as program modules, being executed by a computer and/or a processor thereof. Generally, program modules include routines, programs, objects, components, data structures, etc. that perform particular tasks or implement particular abstract data types. Such a program module may be contained in a tangible computer-readable medium, as described above. Aspects of the present invention may also be practiced in distributed computing environments where tasks are performed by remote processing devices that are linked through a communications network. Program modules may be located in a memory, such as the memory 204 of the module 22 or memory 304 of the external device 110, or an external medium, such as game media 307, which may include both local and remote computer storage media including memory storage devices. It is understood that the module 22, the external device 110, and/or external media may include complementary program modules for use together, such as in a particular application. It is also understood that a single processor 202, 302 and single memory 204, 304 are shown and described in the module 22 and the external device 110 for sake of simplicity, and that the processor 202, 302 and memory 204, 304 may include a plurality of processors and/or memories respectively, and may comprise a system of processors and/or memories.

The various embodiments of the sensor system described herein, as well as the articles of footwear, foot contacting members, inserts, and other structures incorporating the sensor system, provide benefits and advantages over existing technology. For example, many of the port embodiments described herein provide relatively low cost and durable options for use with sensor systems, so that a sensor system can be incorporated into articles of footwear with little added cost and good reliability. As a result, footwear can be manufactured with integral sensor systems regardless of whether the sensor systems are ultimately desired to be used by the consumer, without appreciably affecting price. Additionally, sole inserts with customized sensor systems can be inexpensively manufactured and distributed along with software designed to utilize the sensor systems, without appreciably affecting the cost of the software. As another example, the sensor system provides a wide range of functionality for a wide variety of applications, including gaming, fitness, athletic training and improvement, practical controls for computers and other devices, and many others described herein and recognizable to those skilled in the art. In one embodiment, third-party software developers can develop software configured to run using input from the sensor systems, including games and other programs. The ability of the sensor system to provide data in a universally readable format greatly expands the range of third party software and other applications for which the sensor system can be used. As a further example, the various sole inserts containing sensor systems, including liners, insoles, and other elements, permit interchangeability and customization of the sensor system for different applications. Still further, various port and module configurations described herein can provide for secure connections with reasonable expense and minimal to no negative effect on shoe performance or response. The connecting structures may also be water-resistant or watertight to resist interference from sweat and other fluids. Additionally, the connecting structures of the various port configurations described herein may provide quick and easy interchanging of one module for another. Those skilled in the art will recognize yet other benefits and advantages from the configurations described herein.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "first," "second," "top," "bottom," etc., as used herein, are intended for illustrative purposes only and do not limit the embodiments in any way. Additionally, the term "plurality," as used herein, indicates any number greater than one, either disjunctively or conjunctively, as necessary, up to an infinite number. Further, "Providing" an article or apparatus, as used herein, refers broadly to making the article available or accessible for future actions to be performed on the article, and does not connote that the party providing the article has manufactured, produced, or supplied the article or that the party providing the article has ownership or control of the article. Accordingly, while specific embodiments have been illustrated and described, numerous modifications come to mind without significantly departing from the spirit of the invention and the scope of protection is only limited by the scope of the accompanying Claims.

What is claimed is:

1. An insert configured for use in an article of footwear, comprising:

an insert member adapted to be placed in contact with a sole structure of the article of footwear, the insert member being formed of a flexible polymer material;

a sensor system comprising a plurality of force sensors connected to the insert member and a plurality of sensor leads extending away from the force sensors, the force sensors being adapted to sense a force exerted on the sole structure by a foot; and a port connected to the insert member and the sensor system, the port comprising:

a housing connected to the insert member, the housing comprising a chamber adapted to receive an electronic module therein, wherein the housing has a slot adjacent to the chamber; and an interface engaged with the housing and having a plurality of electrical contacts in communication with the plurality of sensor leads, the interface further comprising a base engaged with the housing and received within the slot, wherein the base is positioned at least partially within the chamber and supports the electrical contacts to position the electrical contacts to be exposed to the chamber, and wherein the interface is adapted to form an electrical connection with the electronic module such that the electronic module engages the electrical contacts when the electronic module is received within the chamber.

2. The insert of claim 1, wherein the slot is positioned at a first end of the chamber.

3. The insert of claim 2, wherein the housing further comprises a retaining member located at a second end of the chamber opposite the first end, wherein the retaining member is configured to engage the electronic module to retain the electronic module within the chamber.

4. The insert of claim 3, wherein the base further comprises a lip located at the first end of the chamber and configured to engage a top of the electronic module to retain the electronic module within the chamber.

5. The insert of claim 1, wherein the housing comprises a bottom wall and a plurality of side walls extending upward from the bottom wall, with the bottom wall and the side walls defining the chamber, and wherein the slot is located in one of the side walls.

6. The insert of claim 1, wherein the housing further comprises a retaining tab located within the slot and engaging the base to retain the base within the slot.

7. The insert of claim 6, wherein the base further comprises a complementary retaining tab engaging the retaining tab of the housing.

8. The insert of claim 6, wherein the base further comprises a second retaining tab located within the slot and engaging the base to retain the base within the slot, wherein the retaining tab and the second retaining tab are located at opposite ends of the slot.

9. The insert of claim 1, wherein the insert member has an opening and the housing is received within the opening of the insert member.

10. A port for use with an article of footwear adapted to engage a foot, the article of footwear having a sole structure and an upper portion connected to the sole structure, the port comprising:

a housing adapted to be at least partially received within the sole structure of the article of footwear, the housing comprising a chamber adapted to receive an electronic module therein, wherein the housing has a slot adjacent to the chamber; and an interface engaged with the housing and having a plurality of electrical contacts, the interface further comprising a base engaged with the housing and received within the slot, wherein the base is positioned at least partially within the chamber and supports the electrical contacts to position the electrical contacts to be exposed to the chamber, and wherein the interface is adapted to form an electrical connection with the electronic module such that the electronic module engages the electrical contacts when the electronic module is received within the chamber.

11. The port of claim 10, wherein the slot is positioned at a first end of the chamber.

12. The port of claim 11, wherein the housing further comprises a retaining member located at a second end of the chamber opposite the first end, wherein the retaining member is configured to engage the electronic module to retain the electronic module within the chamber.

13. The port of claim 12, wherein the base further comprises a lip located at the first end of the chamber and configured to engage a top of the electronic module to retain the electronic module within the chamber.

14. The port of claim 10, wherein the housing comprises a bottom wall and a plurality of side walls extending upward from the bottom wall, with the bottom wall and the side walls defining the chamber, and wherein the slot is located in one of the side walls.

15. The port of claim 10, wherein the housing further comprises a retaining tab located within the slot and engaging the base to retain the base within the slot.

16. The port of claim 15, wherein the base further comprises a complementary retaining tab engaging the retaining tab of the housing.

17. The port of claim 15, wherein the base further comprises a second retaining tab located within the slot and engaging the base to retain the base within the slot, wherein the retaining tab and the second retaining tab are located at opposite ends of the slot.

18. An insert configured for use in an article of footwear, comprising:

an insert member adapted to be placed in contact with a sole structure of the article of footwear, the insert member being formed of a flexible polymer material;

a sensor system comprising a plurality of force sensors connected to the insert member and a plurality of sensor leads extending away from the force sensors, the force sensors being adapted to sense a force exerted on the sole structure by a foot; and a port connected to the insert member and the sensor system, the port comprising:

a housing connected to the insert member, the housing comprising a chamber adapted to receive an electronic module therein; and an interface engaged with the housing and having a plurality of electrical contacts in communication with the plurality of sensor leads, the interface further comprising a base engaged with the housing at a first end of the chamber, wherein the base is positioned at least partially within the chamber and supports the electrical contacts to position the electrical contacts to be exposed to the chamber, and wherein the interface is adapted to form an electrical connection with the electronic module such that the electronic module engages the electrical contacts when the electronic module is received within the chamber, wherein the housing has a retaining member at a second end of the chamber opposite the first end and configured to engage the electronic module to retain the electronic module within the chamber, and wherein the base comprises a lip located at the first end of the chamber and configured to engage a top of the electronic module to retain the electronic module within the chamber in combination with the retaining member.

19. The insert of claim 18, wherein the housing further comprises a slot, and the base is received within the slot.

20. The insert of claim 18, wherein the insert member has an opening and the housing is received within the opening of the insert member.

21. The insert of claim 18, wherein the retaining member is a flexible member that is moveable between a first position, where the retaining member is configured to engage the electronic module to retain the electronic module within the chamber, and a second position, wherein the retaining member is adapted to permit the electronic module to be inserted into or removed from the chamber.

22. The insert of claim 21, wherein the retaining member is a flexible tab having a ramped surface that is adapted to be engaged by the electronic module during insertion into the chamber to flex the flexible tab to the second position to permit insertion of the electronic module into the chamber.

23. The insert of claim 18, wherein the housing further comprises a second retaining member at the second end of the chamber and configured to engage the electronic module to retain the electronic module within the chamber.

24. The insert of claim 18, wherein the retaining member is also configured to engage the top of the electronic module to retain the electronic module within the chamber.

25. The insert of claim 18, wherein the lip and the retaining member are both configured to exert a downward force on the electronic module to retain the electronic module within the chamber, and wherein the housing further comprises a biasing member adapted to engage the electronic module and exert an upward biasing force on the electronic module when the electronic module is received in the chamber.

26. A port for use with an article of footwear adapted to engage a foot, the article of footwear having a sole structure and an upper portion connected to the sole structure, the port comprising:

a housing adapted to be at least partially received within the sole structure of the article of footwear, the housing comprising a chamber adapted to receive an electronic module therein; and an interface engaged with the housing and having a plurality of electrical contacts, the interface further comprising a base engaged with the housing at a first end of the chamber, wherein the base is positioned at least partially within the chamber and supports the electrical contacts to position the electrical contacts to be exposed to the chamber, and wherein the interface is adapted to form an electrical connection with the electronic module such that the electronic module engages the electrical contacts when the electronic module is received within the chamber, wherein the housing has a retaining member at a second end of the chamber opposite the first end and configured to engage the electronic module to retain the electronic module within the chamber, and wherein the base comprises a lip located at the first end of the chamber and configured to engage a top of the electronic module to retain the electronic module within the chamber in combination with the retaining member.

27. The port of claim 26, wherein the retaining member is a flexible member that is moveable between a first position, where the retaining member is configured to engage the electronic module to retain the electronic module within the chamber, and a second position, wherein the retaining member is adapted to permit the electronic module to be inserted into or removed from the chamber.

28. The port of claim 27, wherein the retaining member is a flexible tab having a ramped surface that is adapted to be engaged by the electronic module during insertion into the chamber to flex the flexible tab to the second position to permit insertion of the electronic module into the chamber.

29. The port of claim 26, wherein the housing further comprises a second retaining member at the second end of the chamber and configured to engage the electronic module to retain the electronic module within the chamber.

30. The port of claim 26, wherein the lip and the retaining member are both configured to exert a downward force on the electronic module to retain the electronic module within the chamber, and wherein the housing further comprises a biasing member adapted to engage the electronic module and exert an upward biasing force on the electronic module when the electronic module is received in the chamber.

* * * * *